US009310702B2

(12) United States Patent
Kajiwara et al.

(10) Patent No.: US 9,310,702 B2
(45) Date of Patent: Apr. 12, 2016

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventors: Kenji Kajiwara, Kanagawa (JP); Katsumi Nukada, Kanagawa (JP); Hidekazu Hirose, Kanagawa (JP); Yuko Iwadate, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/483,736

(22) Filed: Sep. 11, 2014

(65) Prior Publication Data

US 2015/0277245 A1 Oct. 1, 2015

(30) Foreign Application Priority Data

Mar. 26, 2014 (JP) ..... 2014-064257
Mar. 26, 2014 (JP) ..... 2014-064258

(51) Int. Cl.

| | |
|---|---|
| ***G03G 5/14*** | (2006.01) |
| ***G03G 5/047*** | (2006.01) |
| ***G03G 5/06*** | (2006.01) |
| ***G03G 5/05*** | (2006.01) |
| ***G03G 5/07*** | (2006.01) |
| ***G03G 5/147*** | (2006.01) |

(52) U.S. Cl.

CPC ..... *G03G 5/047* (2013.01); *G03G 5/0564* (2013.01); *G03G 5/062* (2013.01); *G03G 5/0614* (2013.01); *G03G 5/0618* (2013.01); *G03G 5/071* (2013.01); *G03G 5/14708* (2013.01); *G03G 5/14756* (2013.01); *G03G 5/14795* (2013.01)

(58) Field of Classification Search

CPC ... G03G 5/056; G03G 5/0592; G03G 5/0614; G03G 5/071

See application file for complete search history.

(56) References Cited

U.S. PATENT DOCUMENTS

| | | | |
|---|---|---|---|
| 3,501,294 | A | 3/1970 | Joseph |
| 3,664,300 | A | 5/1972 | Joseph |
| 5,411,827 | A | 5/1995 | Tamura et al. |
| 5,427,880 | A | 6/1995 | Tamura et al. |
| 5,456,989 | A | 10/1995 | Nogami et al. |
| 5,496,671 | A | 3/1996 | Tamura et al. |

(Continued)

FOREIGN PATENT DOCUMENTS

| | | | |
|---|---|---|---|
| JP | S51-22380 | B | 2/1976 |
| JP | S62-251757 | A | 11/1987 |

(Continued)

OTHER PUBLICATIONS

Translation of H08-272126 published Oct. 1996.*

(Continued)

*Primary Examiner* — Peter Vajda

(74) *Attorney, Agent, or Firm* — Oliff PLC

(57) ABSTRACT

An electrophotographic photoreceptor includes a conductive substrate and a photosensitive layer provided on the conductive substrate, wherein an outermost surface layer of the electrophotographic photoreceptor is composed of a cured film of a composition containing a reactive charge transport material, a zinc stearate coverage of the surface of the outermost surface layer is 5.0% or more, and an oxygen permeability coefficient of the outermost surface layer before coating with zinc stearate is $2.0\times10^{12}$ $fm^2/Pa\cdot s$ or more.

16 Claims, 5 Drawing Sheets

(56) References Cited

U.S. PATENT DOCUMENTS

| | | | | |
|---|---|---|---|---|
| 5,695,898 | A | 12/1997 | Go et al. | |
| 7,893,185 | B2 * | 2/2011 | Hikosaka | C08G 64/04 399/159 |
| 2002/0119382 | A1 | 8/2002 | Nakata et al. | |
| 2004/0043312 | A1 | 3/2004 | Kikuchi et al. | |
| 2004/0248024 | A1 | 12/2004 | Suzuki et al. | |
| 2004/0253527 | A1 | 12/2004 | Suzuki et al. | |
| 2007/0122724 | A1 | 5/2007 | Suzuki et al. | |
| 2007/0178400 | A1 | 8/2007 | Kikuchi et al. | |
| 2008/0020305 | A1 | 1/2008 | Suzuki et al. | |
| 2012/0052424 | A1 * | 3/2012 | Asano | G03G 5/0525 430/56 |
| 2013/0052572 | A1 * | 2/2013 | Nukada | G03G 15/75 430/56 |

FOREIGN PATENT DOCUMENTS

| | | | | |
|---|---|---|---|---|
| JP | H05-40360 | A | 2/1993 | |
| JP | H05-216249 | A | 8/1993 | |
| JP | H07-72640 | A | 3/1995 | |
| JP | H07-146564 | A | 6/1995 | |
| JP | H07-152162 | A | 6/1995 | |
| JP | H08-272126 | * | 10/1996 | G03G 5/147 |
| JP | 2000-019749 | A | 1/2000 | |
| JP | 2000-206715 | A | 7/2000 | |
| JP | 2002-082469 | A | 3/2002 | |
| JP | 3287678 | B2 | 6/2002 | |
| JP | 2004-012986 | A | 1/2004 | |
| JP | 2004-198662 | A | 7/2004 | |
| JP | 2004-302450 | A | 10/2004 | |
| JP | 2005-275367 | A | 10/2005 | |
| JP | 2006-084711 | A | 3/2006 | |

OTHER PUBLICATIONS

Woods, "Rules of Thumb in Engineering Practice," Wiley, 2007. p. 344.*

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application Nos. 2014-064257 and 2014-064258, filed Mar. 26, 2014.

BACKGROUND

1. Technical Field

The present invention relates to an electrophotographic photoreceptor, a process cartridge, and an image forming apparatus.

2. Related Art

In the related art, it has been proposed to improve the strength by providing a protective layer on a surface of an electrophotographic photoreceptor which is used in an electrophotographic image forming apparatus.

Recently, a protective layer using an acrylic material is paid attention.

SUMMARY

According to an aspect of the invention, there is provided an electrophotographic photoreceptor including a conductive substrate and a photosensitive layer provided on the conductive substrate, wherein an outermost surface layer of the electrophotographic photoreceptor is composed of a cured film of a composition containing a reactive charge transport material, a zinc stearate coverage of the surface of the outermost surface layer is 5.0% or more, and an oxygen permeability coefficient of the outermost surface layer before coating with zinc stearate is $2.0\times10^{12}$ $fm^2/Pa\cdot s$ or more.

BRIEF DESCRIPTION OF THE DRAWINGS

Exemplary embodiments of the present invention will be described in detail based on the following figures, wherein.

DETAILED DESCRIPTION

Figure 1:
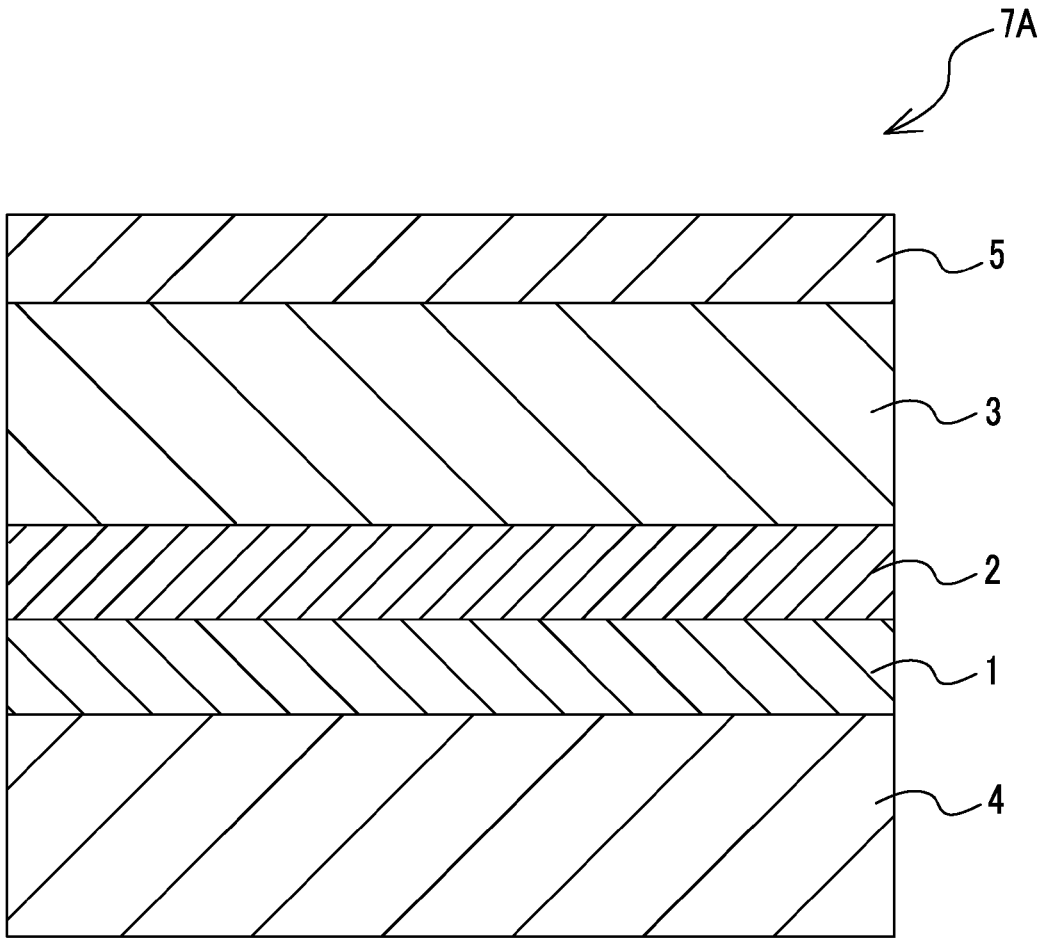
FIG. 1 is a schematic partial cross-sectional view showing an example of a layer configuration of an electrophotographic photoreceptor according to a present exemplary embodiment.

Hereinbelow, the present exemplary embodiment which is an example of the invention will be described.

Electrophotographic Photoreceptor

An electrophotographic photoreceptor according to the present exemplary embodiment has a conductive substrate and a photosensitive layer provided on the conductive substrate.

The outermost surface layer is composed of a cured film of a composition containing a reactive charge transport material. Further, the coverage of zinc stearate on the surface of the outermost surface layer (hereinafter also simply referred to as a "zinc stearate coverage") is 5.0% or more, and further, the oxygen permeability coefficient of the outermost surface layer before coating with zinc stearate (hereinafter simply referred to as an "the oxygen permeability coefficient of the outermost surface layer) is $2.0\times10^{12}$ $fm^2/Pa\cdot s$ or more.

Here, the outermost surface layer is a layer provided farthest from the conductive substrate among the layers provided on the conductive substrate in the electrophotographic photoreceptor. Specifically, the outermost surface layer is, for example, a layer that functions as a protective layer, a layer that functions as a charge transport layer, or a layer that has both of these functions.

The electrophotographic photoreceptor according to the present exemplary embodiment becomes an electrophotographic photoreceptor having an outermost surface layer excellent in stability in electrical characteristics and in scratch resistance by the above-described configuration. Although the reason is not clear, but it is presumed to be as follows.

First, an oxygen permeability coefficient of the outermost surface layer of $2.0\times10^{12}$ $fm^2/Pa\cdot s$ or more indicates that a number of pores are present on the outermost surface layer to make the outermost surface layer have an oxygen permeability. On the other hand, a zinc stearate coverage of 5.0% or more indicates that a large amount of zinc stearate is coated on the outermost surface layer. That is, the zinc stearate coverage and the oxygen permeability coefficient of the outermost surface layer, both satisfying the above ranges, indicates a state where the pores on the surface of the outermost surface layer are coated to make the zinc stearate embedded in the pores, and specifically, a state where an outermost surface layer having a high oxygen permeability coefficient is coated with zinc stearate and thus, the oxygen permeability coefficient is reduced.

By reducing the oxygen permeability coefficient, the reduction in the electrical characteristics by oxidation of the charge transport material in the outermost surface layer is prevented. Further, when the pores on the surface of the outermost surface layer are coated to make the zinc stearate embedded in the pores, the lubricity of the surface of the outermost surface layer increases and the scratch resistance thus increases.

From the above, it is presumed that the electrophotographic photoreceptor according to the present exemplary embodiment is an electrophotographic photoreceptor having an outermost surface layer excellent in stability in electrical characteristics and in scratch resistance.

Further, since the lubricity of the surface of the outermost surface layer increases, unevenness of a load (torque) in the photoreceptor axis direction of an outermost surface layer with a cleaning blade is prevented, and the cleaning blade turned-up is easily prevented.

In addition, a long lifetime is achieved in an image forming apparatus (or a process cartridge) equipped with the electrophotographic photoreceptor according to the present exemplary embodiment.

In the electrophotographic photoreceptor according to the present exemplary embodiment, the zinc stearate coverage is 5.0% or more, and from the viewpoints of stability in electrical characteristics and scratch resistance, the zinc stearate coverage is preferably from 5.0% to 80.0%, and more preferably from 10.03 to 70.0%.

The oxygen permeability coefficient of the outermost surface layer is $2.0\times10^{12}$ $fm^2/Pa\cdot s$ or more, and from the viewpoints of the stability in electrical characteristics and the scratch resistance, the oxygen permeability coefficient is preferably from $2.0\times10^{12}$ $fm^2/Pa\cdot s$ to $15.0\times10^{12}$ $fm/Pa\cdot s$, and more preferably from $3.0\times10^{12}$ $fm^2/Pa\cdot s$ to $12.0\times10^{12}$ $fm^2/Pa\cdot s$.

Further, the zinc stearate coverage and the oxygen permeability coefficient of the outermost surface layer are values measured by the methods described in Examples as described later.

Further, examples of the coating with zinc stearate include those using 1) a method in which zinc stearate is coated in advance onto an electrophotographic photoreceptor before being mounted on an image forming apparatus, 2) a method in which an electrophotographic photoreceptor is mounted on an image forming apparatus including a developing unit that stores a developer containing zinc stearate particles, and zinc stearate is supplied to and coated onto the electrophotographic photoreceptor by the developer, 3) a method in which an electrophotographic photoreceptor is mounted on an image forming apparatus including a supply unit that supplies zinc stearate to the surface of the electrophotographic photoreceptor apart from a developing unit, and zinc stearate is supplied with the supply unit and coated.

In the electrophotographic photoreceptor according to the present exemplary embodiment, as the reactive charge transport material, a cured film of a composition containing at least one selected from the group consisting of reactive compounds represented by the formulae (I) and (II) (hereinafter also referred to as "specific reactive charge transport materials") may be used in the outermost surface layer. When the cured film of this composition is used as the outermost surface layer, the zinc stearate coverage and the oxygen permeability coefficient of the outermost surface layer are easily in the ranges above, the stability in electrical characteristics and the scratch resistance of the outermost surface layer easily increases. Although the reason is not clear, it is presumed to be as follows.

First, a specific reactive charge transport material is a styryl group which has excellent charge transport performance, has a small number of polar groups interfering with a charge transport property, such as —OH and —NH—, and has a $\pi$ electron effective for a charge transport property, and since this material is connected by polymerization, the residual stress is prevented and the formation of a structural trap that traps charges is prevented. In addition, since the specific reactive charge transport material has a property that it is more hydrophobic than acrylic materials and moisture hardly sticks to the materials, the electrical characteristics are thought to be maintained over a long period of time.

Further, the specific reactive charge transport material has properties of high reaction rates and ease of generation of pores on a film formed (outermost surface layer). In addition, the specific reactive charge transport material is more hydrophobic than the acrylic materials, and has higher affinity to zinc stearate. Therefore, zinc stearate is easily embedded in the pores on the surface of the outermost surface layer, and the zinc stearate coverage is easily adjusted to the above ranges.

Therefore, it is presumed that if a cured film of a composition containing at least one selected from the group consisting of the specific reactive charge transport materials is used as the reactive charge transport material in the outermost surface layer, an electrophotographic photoreceptor having an outermost surface layer excellent in stability in electrical characteristics and in scratch resistance is easily obtained.

In the electrophotographic photoreceptor according to the present exemplary embodiment, a lower layer in contact with the outermost surface layer preferably includes a non-reactive charge transport material and a polycarbonate copolymer having a solubility parameter as calculated by a Feders method of from 11.40 to 11.75.

Here, the outermost surface layer is formed by coating a coating liquid containing the respective materials onto a photosensitive layer (for example, a charge transport layer) which will be a lower layer. However, according to the kind of solvent used to prepare a coating liquid, when the outermost surface layer is coated and formed, the binder resin of a photosensitive layer (for example, a charge transport layer) which will be a lower layer is swollen by a solvent of the coating liquid, mixing of the components between the outermost surface layer and the lower layer occurs, and thus, the electrical characteristics and the mechanical strength are deteriorated in some cases.

Particularly, in the case where resin particles are included in the outermost surface layer, when the binder resin of a photosensitive layer (for example, a charge transport layer) which will be a lower layer is swollen, the resin particles are unevenly distributed (that is, segregated at a high concentration) on the surface layer of the outermost surface layer in some cases. If the resin particles are unevenly distributed (that is, segregated at a high concentration) on the surface layer of the outermost surface layer, for example, the proportion of the resin components in the surface layer portion of the outermost surface layer is reduced, and thus, abrasion resistance at a time of initial use is reduced.

Meanwhile, in the lower layer (the photosensitive layer (for example, a charge transport layer)) in contact with the outermost surface layer, a polycarbonate copolymer having a solubility parameter as calculated by a Feders method of from 11.40 to 11.75 is applied as a binder resin. Thus, mixing of the components between the outermost surface layer and the lower layer is prevented, and thus, electrical characteristics and mechanical strength easily increase. Thus, the stability in electrical characteristics and the scratch resistance of the outermost surface layer easily increase.

Particularly, in the case where the outermost surface layer includes resin particles, uneven distribution of the resin particles to the side of the surface layer of the outermost surface layer is prevented. That is, a state where the resin particles are uniformly dispersed in the outermost surface layer is easily obtained.

Although the reason is not clear, it is thought that if a polycarbonate copolymer having a solubility parameter in the above range is included as a binder resin in the lower layer in contact with the outermost surface layer, the polycarbonate copolymer has a low solubility in a solvent of a coating liquid when forming the outermost surface layer, and swelling of the binder resin due to the solvent is prevented.

Further, in the electrophotographic photoreceptor according to the present exemplary embodiment, the outermost surface layer may form an uppermost surface of the electrophotographic photoreceptor itself, and is provided as a layer functioning as a protective layer or a layer functioning as a charge transport layer. In the case where the outermost surface layer is a layer functioning as a protective layer, the lower layer of this protective layer has a photosensitive layer including a charge transport layer and charge generation layer, or a single layer type photosensitive layer.

Specifically, in the case where the outermost surface layer is a layer functioning as a protective layer, an aspect may be mentioned, in which a photosensitive layer (a charge generation layer and a charge transport layer, or a single layer type photosensitive layer), and a protective layer as the outermost surface layer are sequentially formed on a conductive substrate. On the other hand, in the case where an outermost surface layer is a layer functioning as a charge transport layer, an aspect may be mentioned, in which a charge generation layer, and a charge transport layer as the outermost surface layer are sequentially formed on a conductive substrate.

Hereinafter, an electrophotographic photoreceptor according to the present exemplary embodiment in the case where the outermost surface layer is a layer functioning as a protective layer will be described with reference to the figures. In the figures, the identical parts or corresponding parts will be assigned with identical symbols, and overlapping explanations will be omitted.

Figure 2:
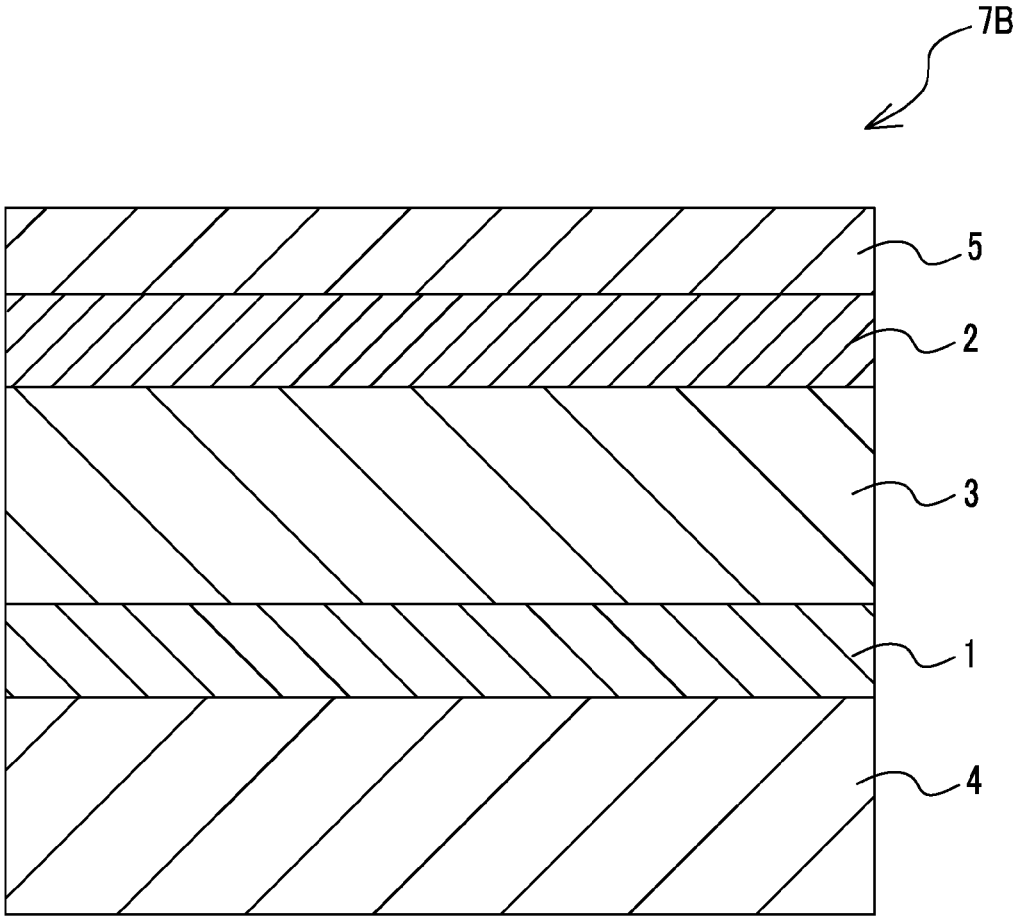
FIG. 2 is a schematic partial cross-sectional view showing another example of the layer configuration of an electrophotographic photoreceptor according to the present exemplary embodiment.
Figure 3:
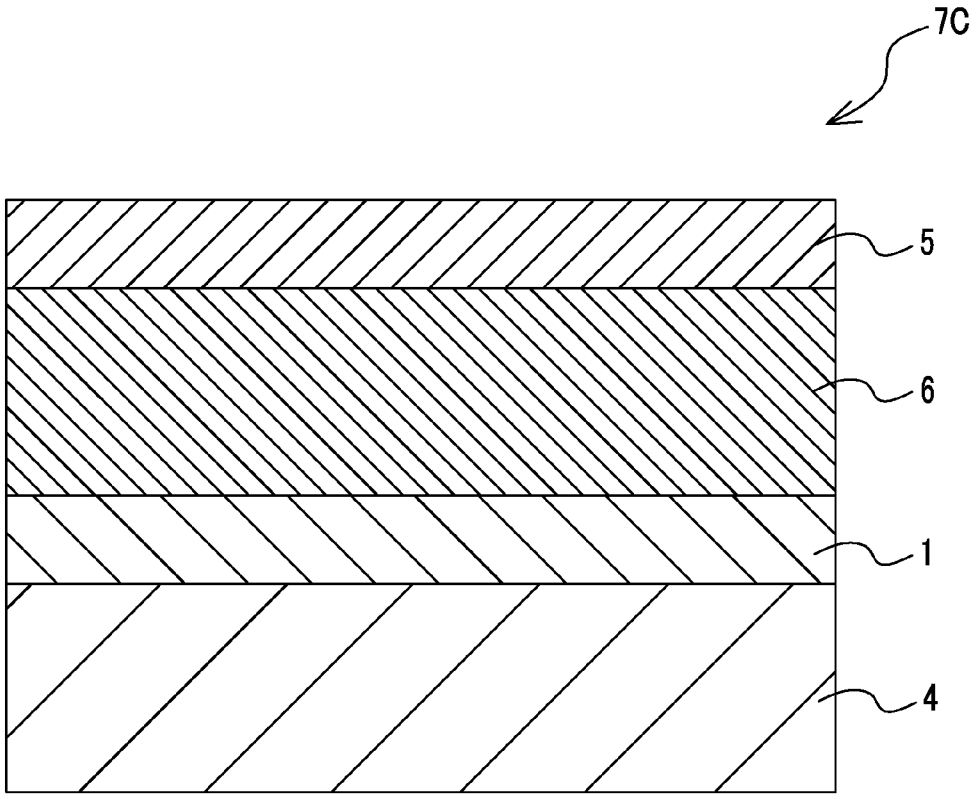
FIG. 3 is a schematic partial cross-sectional view showing still another example of the layer configuration of an electrophotographic photoreceptor according to the present exemplary embodiment.

FIG. 1 is a schematic cross-sectional view showing an example of electrophotographic photoreceptors according to the present exemplary embodiment. FIGS. 2 and 3 are each a schematic cross-sectional view showing another example of electrophotographic photoreceptors according to the present exemplary embodiment.

An electrophotographic photoreceptor 7A shown in FIG. 1 is a so-called function separation type photoreceptor (or a laminate type photoreceptor) and has a structure where an undercoat layer 1 is provided on a conductive substrate 4, and further thereon, a charge generation layer 2, a charge transport layer 3, and a protective layer 5 are sequentially formed. In the electrophotographic photoreceptor 7A, a photosensitive layer is composed of the charge generation layer 2 and the charge transport layer 3.

An electrophotographic photoreceptor 7B shown in FIG. 2 is a function separation type photoreceptor where, similar to the electrophotographic photoreceptor 7A shown in FIG. 1, a function is separated into a charge generation layer 2 and a charge transport layer 3.

The electrophotographic photoreceptor 7B shown in FIG. 2 has a structure where an undercoat layer 1 is provided on a conductive substrate 4, and further thereon, a charge transport layer 3, a charge generation layer 2 and a protective layer 5 are sequentially formed. In the electrophotoqraphic photoreceptor 7B, a photosensitive layer is composed of the charge transport layer 3 and the charge generation layer 2.

An electrophotographic photoreceptor 7C shown in FIG. 3 contains a charge generating material and a charge transport material in the same layer (single layer type photosensitive layer 6). The electrophotographic photoreceptor 7C shown in FIG. 3 has a structure where an undercoat layer 1 is provided on a conductive substrate 4, and further thereon a single layer type photosensitive layer 6 and a protective layer 5 are sequentially formed.

Furthermore, in the electrophotographic photoreceptors 7A, 7B, and 7C shown in FIGS. 1, 2, and 3, the protective layer 5 is an outermost surface layer disposed on a side farthest from the conductive substrate 4, and the outermost surface layer has the above-described configuration.

In addition, in the electrophotographic photoreceptors shown in FIGS. 1, 2, and 3, an undercoat layer 1 may or may not be provided.

Hereinafter, based on the electrophotographic photoreceptor 7A shown in FIG. 1 as a representative example, the respective constituents will be described. Further, the symbols are omitted in description.

Conductive Substrate

Examples of the conductive substrate include metal plates, metal drums, and metal belts, including a metal (aluminum, copper, zinc, chromium, nickel, molybdenum, vanadium, indium, gold, platinum, or the like), or an alloy (stainless steel or the like) thereof. Further, examples of the conductive substrate further include a paper, a resin film, and a belt, on which a conductive compound (for example, a conductive polymer and indium oxide), a metal (for example, aluminum, palladium, and gold), or an alloy thereof is coated, deposited, or laminated. Here, "conductivity" means that volume resistivity is less than $10^{13}$ Ω·cm.

When the electrophotographic photoreceptor is used in a laser printer, the surface of the conductive substrate is preferably roughened so as to be from 0.04 μm to 0.5 μm in the center line average roughness Ra, from the viewpoint of preventing an interference pattern from generating when laser light is applied. Further, when non-interfering light is used as a light source, roughening for preventing the interference pattern from occurring is not particularly required. However, generation of defects caused by irregularities on the surface of the conductive substrate is prevented, which is suitable for attaining a longer lifetime.

Examples of a method for surface roughening include a wet horning method in which a suspension obtained by suspending a polishing agent in water is sprayed on a conductive substrate, centerless grinding in which a conductive substrate is pressed against a rotating grinding stone to continuously grind, and an anodic oxidation treatment.

Other examples of the method for surface roughening include a method in which, without roughening the surface of the conductive substrate, a dispersion obtained by dispersing a conductive or semiconductive powder in a resin is applied to form a layer on the surface of a conductive substrate, and particles dispersed in the layer roughen the surface.

In the surface roughening treatment by anodic oxidation, anodic oxidation is conducted in an electrolytic solution with a metal-made conductive substrate (for example, an aluminum-made conductive substrate) as an anode to form an oxide film on the surface of the conductive substrate. Examples of the electrolytic solution include a solution of sulfuric acid and a solution of oxalic acid. However, a porous anodic oxide film formed by anodic oxidation is chemically active as it is, tends to be contaminated and is large in variation of resistance depending on an environment. In this connection, it is preferable to subject a porous anodic oxide film to a sealing treatment in which micropores of the oxide film are sealed by volume expansion caused by hydration in pressurized vapor or boiling water (a metal salt of nickel or the like may be added) to change it into a stable hydrated oxide.

The film thickness of the anodic oxide film is preferably from 0.3 μm to 15 μm. When the film thickness is within the above range, a barrier property against injection tends to be exerted, and an increase in a residual potential by repeating usage tends to be prevented.

The conductive substrate may be subjected to a treatment with an acidic treatment liquid or a boehmite treatment.

The treatment with an acidic treatment liquid including phosphoric acid, chromic acid and hydrofluoric acid is carried out as follows. First, phosphoric acid, chromic acid, and hydrofluoric acid are mixed to prepare an acidic treatment liquid preferably at a mixing ratio in the range of from 10% by weight to 11% by weight of phosphoric acid, in the range of from 3% by weight to 5% by weight of chromic acid, and in the range of from 0.5% by weight to 2% by weight of hydrofluoric acid. The concentration of the total acid components is preferably in the range of from 13.5% by weight to 18% by weight. The treatment temperature is preferably from 42° C. to 48° C. The film thickness of the film is preferably from 0.3 μm to 15 μm.

The boehmite treatment is carried out by immersing the substrate in pure water at a temperature of from 90° C. to 100° C. for 5 minutes to 60 minutes, or by bringing it into contact with heated water vapor at a temperature of from 90° C. to 120° C. for from 5 minutes to 60 minutes. The film thickness of the film is preferably from 0.1 μm to 5 μm. The film may further be subjected to an anodic oxidation treatment using an electrolyte solution which scarcely dissolves the film such as adipic acid, boric acid, borate, phosphate, phthalate, maleate, benzoate, tartrate, citrate, or the like.

Undercoat Layer

The undercoat layer is, for example, a layer including inorganic particles and a binder resin.

Examples of the inorganic particles include inorganic particles having a powder resistance (volume resistivity) of from $10^2$ Ωcm to $10^{11}$ Ωcm.

Among these, for example, metal oxide particles such as tin oxide particles, titanium oxide particles, zinc oxide particles, and zirconium oxide particles are preferable, and zinc oxide particles are particularly preferable.

The specific surface area by a BET method of the inorganic particles is preferably, for example, 10 $m^2/g$ or more.

The volume average particle size of the inorganic particles is preferably, for example, from 50 nm to 2000 nm (preferably from 60 nm to 1000 nm).

The content of the inorganic particles is, for example, preferably from 10% by weight to 80% by weight and more preferably from 40% by weight to 80% by weight, with respect to the binder resin.

The inorganic particle may be surface-treated, and two or more kinds of differently surface-treated particles or particles having different particle sizes may be mixed and used.

Examples of the surface treatment agent include a silane coupling agent, a titanate-based coupling agent, an aluminum-based coupling agent, and a surfactant. Particularly, the silane coupling agent is preferable, and an amino group-containing silane coupling agent is preferable.

Examples of the amino group-containing silane coupling agent include 3-aminopropyl triethoxysilane, N-2-(aminoethyl)-3-aminopropyl trimethoxysilane, N-2-(aminoethyl)-3-aminopropylmethyl dimethoxysilane, and N,N-bis(2-hydroxyethyl)-3-aminopropyl triethoxysilane, but are not limited thereto.

The silane coupling agents may be used in a mixture of at least two. For example, the amino group-containing silane coupling agent and other silane coupling agents are used in combination. Examples of such other silane coupling agents include vinyltrimethoxysilane, 3-methacryloxypropyltris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

As the surface treatment method using the surface treatment agent, any one of known processes may be used, and a dry method or a wet method may be used.

The amount of the surface treatment agent for treatment is preferably, for example, from 0.5% by weight to 10% by weight with respect to the inorganic particles.

Here, the undercoat layer preferably contains an electron accepting compound (acceptor compound) together with inorganic particles, from the viewpoint of increasing long-term stability in electrical characteristics and carrier blocking properties.

Examples of the electron accepting compound include electron transport materials including quinone-based compounds such as chloranil and bromanil; tetracyanoquinodimethane compounds; fluorenone compounds such as 2,4,7-trinitrofluorenone and 2,4,5,7-tetranitro-9-fluorenone, oxadiazole compounds such as 2-(4-biphenyl)-5-(4-t-butylphenyl)-1,3,4-oxadiazole, 2,5-bis(4-naphthyl)-1,3,4-oxadiazole and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

As the electron accepting compound, a compound having an anthraquinone structure is preferable. As the compound having an anthraquinone structure, for example, hydroxyanthraquinone compounds, aminoanthraquinone compounds and aminohydroxyanthraquinone compounds, and the like are preferable, and specifically, for example, anthraquinone, alizarin, quinizarin, anthrarufin, purpurin, and the like are preferable.

The electron accepting compound may be dispersed together with the inorganic particles in the undercoat layer, or may be included in the state of being previously attached to the surface of the inorganic particles.

Examples of the method of attaching the electron accepting compound to the surface of the inorganic particles include a dry method and a wet method.

In the dry method, the electron accepting compound is added dropwise to the inorganic particles or sprayed thereto together with a dry air or a nitrogen gas, directly or in the form of a solution in which the electron accepting compound is dissolved in an organic solvent, while the inorganic particles are stirred with a mixer or the like having a high shearing force, whereby the electron accepting compound is attached to the surface of the inorganic particles. When the electron accepting compound is added dropwise or sprayed, the addition or spraying is preferably carried out at a temperature of the boiling point of the solvent or lower. After the addition or spraying of the electron accepting compound, the inorganic particles may further be baked at 100° C. or higher. The temperature and time for baking is not particularly limited as long as they are the temperature and the time by which electrophotographic characteristics are obtained.

The wet method is a method in which while the inorganic particles are dispersed in a solvent by means of stirring, ultrasonic wave, a sand mill, an attritor, a ball mill, or the like, the electron accepting compound is added, and the mixture is further stirred or dispersed, followed by removal of the solvent, whereby the electron accepting compound is attached to the surface of the inorganic particles. As for a method for removing the solvent, the solvent is removed by filtration or distillation. After removal of the solvent, baking may be carried out at a temperature of 100° C. or higher. The temperature and time for baking is not particularly limited as long as they are the temperature and the time, by which electrophotographic characteristics are obtained. In the wet method, the moisture contained in the inorganic particles may be removed prior to the addition of the electron accepting compound. Examples of the wet method include a method of stirring and heating the particles in the solvent, or a method of azeotropic removal with the solvent.

Further, the attachment of the electron accepting compound may be carried out before or after subjecting the inorganic particles to the surface treatment using the surface treatment agent, and the attachment of the electron accepting compound and the surface treatment using the surface treatment agent may be carried out at the same time.

The content of the electron accepting compound is preferably, for example, from 0.01% by weight to 20% by weight and more preferably from 0.01% by weight to 10% by weight, with respect to the inorganic particles.

Examples of the binder resin used in the undercoat layer include known materials, for example, known polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titaniumalkoxide compounds; organic titanium compounds; and silane coupling agents.

Examples of the binder resin used in the undercoat layer include charge transport resins having a charge transport group and conductive resins (for example, polyaniline).

Among these, as the binder resin used in the undercoat layer, resins which are insoluble in a coating solvent for the upper layer are suitable, and particularly, thermosetting resins such as urea resins, phenolic resins, phenol-formaldehyde resins, melamine resins, urethane resins, unsaturated polyester resins, alkyd resins, and epoxy resins; and resins obtained by a reaction of at least one resin selected from a group consisting of polyamide resins, polyester resins, polyether resins, methacrylic resins, acrylic resins, polyvinyl alcohol resins, and polyvinyl acetal resins with a curing agent are suitable.

In the case of using a combination of two or more kinds of these binder resins, the mixing ratio thereof is set as necessary.

Various additives may be included in the undercoat layer to improve electrical characteristics, environmental stability, or image quality.

Examples of the additives include known materials, for example, electron transport pigments such as a polycyclic condensed electron transport pigment and an azo-based electron transport pigment, zirconium chelate compounds, titanium chelate compounds, aluminum chelate compounds, titanium alkoxide compounds, organic titanium compounds, and silane coupling agents. The silane coupling agent is used for the surface treatment of the inorganic particles as described above, but may also be added to the undercoat layer as an additive.

Examples of the silane coupling agent as the additive include vinyltrimethoxysilane, 3-methacryloxypropyltris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compound include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compound include tetraisopropyl titanate, tetranormalbutyl titanate, a butyl titanate dimer, tetra(2-ethylhexyl)titanate, titanium acetyl acetonate, polytitanium acetylacetonate, titanium octylene glycolate, a titanium lactate ammonium salt, titanium lactate, titanium lactate ethyl ester, titanium triethanol aminate and polyhydroxytitanium stearate.

Examples of the aluminum chelate compound include aluminum isopropylate, monobutoxy aluminum diisopropylate, aluminum butylate, diethylacetoacetate aluminum diisopropylate, and aluminum tris(ethylacetoacetate).

These additives may be used alone, or as a mixture or a polycondensate of plural compounds.

The undercoat layer preferably has a Vickers hardness of 35 or more.

The surface roughness (ten-point average roughness) of the undercoat layer is preferably adjusted within the range of from ¼n (n represents a refractive index of the upper layer) to ½λ, in which λ represents the wavelength of the laser for exposure used, in order to prevent a moire image.

Resin particles or the like may also be added to the undercoat layer for adjusting the surface roughness thereof. Examples of the resin particles include silicone resin particles and crosslinking polymethyl methacrylate resin particles. Further, the surface of the undercoat layer may be subjected to grinding for adjusting the surface roughness thereof. Examples of the grinding method include buffing grinding, a sandblast treatment, wet honing, and a grinding treatment.

The formation of the undercoat layer is not particularly limited, and known formation methods are used. For example, the formation is carried out by forming a film of a coating liquid for forming an undercoat layer, in which the components are added to a solvent, and drying the coating film, followed by heating, if desired.

Examples of the solvent for preparing the coating liquid for forming an undercoat layer include known organic solvents such as alcohol-based solvents, aromatic hydrocarbon solvents, hydrocarbon halide-based solvents, ketone-based solvents, ketone alcohol-based solvents, ether-based solvents, and ester-based solvents.

Specific examples of the solvent include common organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of the method for dispersing the inorganic particles in the preparation of a coating liquid for forming an undercoat layer include known methods such as methods using a roll mill, a ball mill, a vibration ball mill, an attritor, a sand mill, a colloid mill, a paint shaker, and the like.

Examples of the method of coating the coating liquid for forming an undercoat layer on the conductive substrate include usual methods such as a blade coating method, a wire bar coating method, a spray coating method, a dipping coating method, a bead coating method, an air knife coating method, and a curtain coating method.

The film thickness of the undercoat layer is set in the range of preferably 15 μm or more and more preferably from 20 μm to 50 μm.

Intermediate Layer

Although not shown in the figures, an intermediate layer may further be provided between the undercoat layer and the photosensitive layer.

The intermediate layer is, for example, a layer including a resin. Examples of the resins used in the intermediate layer include polymer compounds such as acetal resins (for example, polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may also be a layer including an organic metal compound. Examples of the organic metal compound used in the intermediate layer include organic metal compounds containing metal atoms such as zirconium, titanium, aluminum, manganese, and silicon.

These compounds used in the intermediate layer may be used alone or as a mixture or a polycondensate of plural compounds.

Among these, the intermediate layer is preferably a layer including an organic metal compound containing a zirconium atom or a silicon atom.

The formation of the intermediate layer is not particularly limited, and known formation methods are used. For example, the formation is carried out by forming a film of a coating liquid for forming an intermediate layer, in which the components are added to a solvent, and drying the coating film, followed by heating, if desired.

Examples of the coating method for forming an intermediate layer include usual methods such as a dipping coating method, an extrusion coating method, a wire bar coating method, a spray coating method, a blade coating method, a knife coating method, and a curtain coating method.

The film thickness of the intermediate layer is, for example, preferably set in the range of 0.1 am to 3 μm. Further, the intermediate layer may also be used as the undercoat layer.

Charge Generation Layer

The charge generation layer is, for example, a layer including a charge generating material and a binder resin. Further, the charge generation layer may be a deposition layer of the charge generating material. The deposition layer of the charge generating material is suitable for a case where non-interfering light sources such as Light Emitting Diode (LED) and an organic Electro-Luminescence (EL) image array are used.

Examples of the charge generating material include azo pigments such as a bisazo pigment and a trisazo pigment; condensed ring aromatic pigments such as dibromoantanthrone; perylene pigments; pyrrolopyrrole pigments; phthalocyanine pigments; zinc oxide; and trigonal selenium.

Among these, to be applicable to laser exposure in the near-infrared region, it is preferable to use a metal phthalocyanine pigment or a nonmetal phthalocyanine pigment as the charge generating material. Specifically, it is more preferable to use hydroxy gallium phthalocyanine disclosed in JP-A-5-263007, 5-279591, and the like, chlorogallium phthalocyanine disclosed in JP-A-5-98181 and the like, dichlorotin phthalocyanine disclosed in JP-A-5-140472, 5-140473, and the like, and titanyl phthalocyanine disclosed in JP-A-4-189873 and the like.

On the other hand, to be applicable to laser exposure in the near-ultraviolet region, as the charge generating material, condensed-ring aromatic pigments such as dibromoantanthrone; thioindigo pigments; porphyrazine compounds; zinc oxide; trigonal selenium; and bisazo pigments disclosed in JP-A-2004-78147 and 2005-181992 are preferable.

Even in the case of using non-interfering light sources such as LED and an organic EL image array having a center wavelength of light emission from 450 nm to 780 nm, the charge generating material may be used, but from the viewpoint of resolution, when the photosensitive layer is used in the form of a thin film having a thickness of 20 μm or less, the electric field strength in the photosensitive layer increases, and thus, reduction in the charging due to charge injection from a substrate, an image defect referred to as a so-called black spot easily occurs. This becomes significant when using a charge generating material which easily generates dark currents in a p-type semiconductor such as trigonal selenium and a phthalocyanine pigment.

Meanwhile, in the case where an n-type semiconductor such as a condensed ring aromatic pigment, a perylene pigment, an azo pigment is used as a charge generating material, dark currents are not easily generated and an image defect referred to as a black spot may be prevented even with a thin film. Examples of the n-type charge generating material include, but not limited to, the compounds (CG-1) to (CG-27) described in paragraph Nos. [0288] to [0291] of JP-A-2012-155282.

Further, as for the determination of the n-type, a time-of-flight method is usually used, and the type is determined by the polarity of flowing photocurrents, and those that more easily flow electrons than holes as a carrier are taken as an n-type.

The binder resin used in the charge generation layer is selected from a wide range of insulating resins, and the binder resin may also be selected from organic photoconductive polymers such as poly-N-vinyl carbazole, polyvinyl anthracene, polyvinyl pyrene, and polysilane.

Examples of the binder resin include polyvinyl butyral resins, polyarylate resins (polycondensates of bisphenols and aromatic divalent carboxylic acid, or the like), polycarbonate resins, polyester resins, phenoxy resins, vinyl chloride-vinyl acetate copolymer, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. Here, the "insulating properties" refers to a volume resistivity of $10^{13}$ Ωcm or more.

These binder resins may be used alone or as a mixture of two or more kinds thereof.

Also, the blending ratio of the charge generating material and the binder resin is preferably, in the weight ratio, in the range from 10:1 to 1:10.

A known additive may further be added to the charge generation layer.

The formation of the charge generation layer is not particularly limited and a known forming method may be used. For example, the charge generation layer is formed by coating a film of a coating liquid for forming a charge generation layer, in which the components are added to a solvent, and the coating film is dried, followed by heating, if desired. Further, the formation of the charge generation layer may be carried out by the deposition of the charge generating material. The formation of the charge generation layer by deposition is particularly suitable for a case where a condensed ring aromatic pigment or a perylene pigment is used as a charge generating material.

Examples of the solvent for the preparation of a coating liquid for forming a charge generation layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents are used alone or as a mixture of two or more kinds thereof.

For the method for dispersing the particles (for example, a charge generating material) in the coating liquid for forming a charge generation layer, for example, media dispersers such as a ball mill, a vibration ball mill, an attritor, a sand mill, and a lateral sand mill, or medialess dispersers such as an agitator, an ultrasonic disperser, a roll mill, and a high-pressure homogenizer are used. Examples of the high-pressure homogenizer include a collision-type homogenizer in which a dispersion is dispersed by liquid-liquid collision, or liquid-wall collision under high pressure, and a passing-through-type homogenizer in which a dispersion is dispersed by passing the dispersion through fine flow paths under high pressure.

Further, during the dispersion, it is effective that the average particle size of the charge generating materials in the coating liquid for forming a charge generation layer be 0.5 μm or less, preferably 0.3 μm or less, and more preferably 0.15 μm or less.

Examples of the method for coating the coating liquid for forming a charge generation layer on the undercoat layer (or on the intermediate layer) include usual methods such as a blade coating method, a wire bar coating method, a spray coating method, a dipping coating method, a bead coating method, an air knife coating method, and a curtain coating method.

The film thickness of the charge generation layer is preferably, for example, set in the range from 0.1 μm to 5.0 μm and more preferably 0.2 μm to 2.0 μm.

Charge Transport Layer

The charge transport layer is, for example, a layer including a charge transport material and a binder resin. The charge transport layer may also be a layer including a polymer charge transport material.

Examples of the charge transport material include electron transport compounds including quinone compounds such as p-benzoquinone, chloranil, bromanil, and anthraquinone, tetracyanoquinodimethane compounds; fluorenone compounds such as 2,4,7-trinitrofluorenone; xanthone compounds; benzophenone compounds; cyanovinyl compounds; and ethylene compounds. Examples of the charge transport material further include hole transporting compounds including triarylamine-based compounds, benzidine-based compounds, arylalkane-based compounds, aryl-substituted ethylene-based compounds, stilbene-based compounds, anthracene-based compounds, and hydrazone compounds. These charge transport materials are used alone or in combination of two or more kinds thereof, but are not limited thereto.

The charge transport material is preferably a triaryl amine derivative represented by the following structural formula (a-1) and a benzidine derivative represented by the following structural formula (a-2) from the viewpoint of charge mobility.

(a-1)

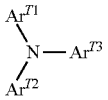

In the structural formula (a-1), $Ar^{T1}$, $Ar^{T2}$, and $Ar^{T3}$ each independently represent a substituted or unsubstituted aryl group, $—C_6H_4—C(R^{T4})=C(R^{T5})(R^{T6})$, or $—C_6H_4—CH=CH—CH=C(R^{T7})(R^{T8})$. $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of a substituent of the respective groups include a halogen atom, an alkyl group having 1 to 5 carbon atoms, and an alkoxy group having 1 to 5 carbon atoms. Other examples of the substituent of the respective groups include a substituted amino group substituted by an alkyl group having 1 to 3 carbon atoms.

(a-2)

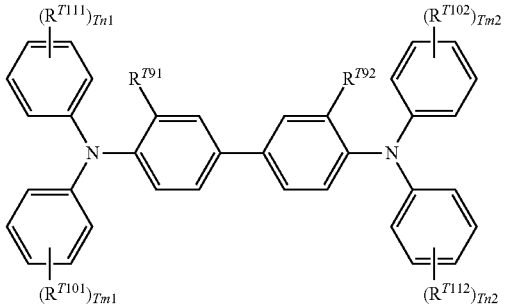

In the structural formula (a-2), $R^{T91}$ and $R^{T92}$ each independently represent a hydrogen atom, a halogen atom, an alkyl group having 1 to 5 carbon atoms, or an alkoxy group having 1 to 5 carbon atoms. $R^{T101}$, $R^{T102}$, $R^{T111}$, and $R^{T112}$ each independently represent a halogen atom, an alkyl group having 1 to 5 carbon atoms, an alkoxy group having 1 to 5 carbon atoms, amino group substituted with an alkyl group having 1 to 2 carbon atoms, a substituted or unsubstituted aryl group, $—C(R^{T12})=C(R^{T13})(R^{T14})$, or $—CH=CH—CH=C(R^{T15})(R^{T16})$, and $R^{T12}$, $R^{T13}$, $R^{T14}$, $R^{T15}$, and $R^{T16}$ each independently represent a hydrogen atom, a substituted or unsubstituted alkyl group, or a substituted or unsubstituted aryl group. Tm1, Tm2, Tn1, and Tn2 each independently represent an integer of 0 to 2.

Examples of a substituent of the respective groups include a halogen atom, an alkyl group having 1 to 5 carbon atoms, and an alkoxy group having 1 to 5 carbon atoms. Other examples of the substituent of the respective groups include a substituted amino group substituted by an alkyl group having 1 to 3 carbon atoms.

Here, between the triarylamine derivative represented by the structural formula (a-1) and the benzidine derivative represented by the structural formula (a-2), a triarylamine derivative having "$—C_6H_4—CH=CH—CH=C(R^{T7})(R^{T8})$", and a benzidine derivative having "$—CH=CH—CH=C(R^{T15})(R^{T16})$" are particularly preferable from the viewpoint of charge mobility.

As a polymer charge transport material, a known charge transport material having the charge transporting property such as poly-N-vinylcarbazole and polysilane is used. In particular, the polyester-based charge transport materials disclosed in JP-A-08-176293 and JP-A-08-208820 are particularly preferable, and further, the polymer charge transport materials may be used alone or in combination with the binder resin.

Examples of the binder resin which is used in the charge transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, as the binder resin, polycarbonate resins and polyarylate resins are preferable. These binder resins are used alone or in combination of two or more kinds thereof.

As the binder resin used in the charge transport layer, polycarbonates are preferably applied. Examples of the polycarbonates include various types of polycarbonates, but from the viewpoint of improving the electrical characteristics and the scratch resistance of the protective layer (outermost surface layer), polycarbonate copolymers (hereinafter referred to as a "specific polycarbonate copolymer") having a solubility parameter (hereinafter also referred to as an "SP value" in some cases) as calculated by a Feders method of from 11.40 to 11.75 (preferably from 11.40 to 11.70) are preferable.

If the SP value of the specific polycarbonate copolymer is within the range, the transfer of the polycarbonate (binder resin) to the protective layer (outermost surface layer) is prevented, and thus, the stability in electrical characteristics and the abrasion resistance are easily improved.

Further, in the case where the protective layer (outermost surface layer) include resin particles, when the SP value of the polycarbonate copolymer is 11.40 or more, the uneven distribution of the resin particles on the side of the surface layer of the protective layer (outermost surface layer) is prevented. On the other hand, when the SP value of the specific polycarbonate copolymer is 11.75 or less, the deterioration of the compatibility with the material (specifically, for example, the charge transport material of a charge transport layer) of the lower layer of the protective layer (outermost surface layer) is prevented, and a decrease in the electrical characteristics of the electrophotographic photoreceptor (particularly an increase in the residual potential due to the repeated use) is easily prevented.

The specific polycarbonate copolymer preferably has repeating structural units having an SP value of from 12.20 to 12.40. It is thought that if the repeating structural units having a high SP value in the above range are included as at least one of the repeating structural units of the polycarbonate copolymer, the entire specific polycarbonate copolymer easily has a decrease in the compatibility with the resin component of a protective layer (outermost surface layer), and thus, the diffusion of the charge transport material of the charge transport layer into the protective layer is easily prevented. As a result, a decrease in the electrical characteristics of the electrophotographic photoreceptor (in particular, an increase in the residual potential due to the repeated use) is easily prevented.

Here, the Feders method refers to a method for conveniently calculating a solubility parameter (SP value) from a structural formula. Specifically, in the Feders method, when the cohesive energy density is denoted as $\Delta E$ and the molar volume is denoted as V, and the solubility parameter is calculated from SP value $\delta=(\Delta E/V)^{1/2}=(\Sigma\Delta ei/\Sigma\Delta vi)^{1/2}$. Further, ei and vi are the cohesive energy and the molar volume of the unit of the structural formula, respectively, and the list thereof is described in, for example, "Fundamentals and Engineering of Coating" (Processing Technology Study Association), p. 55".

Incidentally, $(cal/cm^3)^{1/2}$ is employed as a unit of the solubility parameter (SP value), but according to the customary practice, the solubility parameter is denoted without a dimension with the omission of the unit.

Moreover, a method for calculating the solubility parameter (SP value) according to the Feders method is defined as follows. That is, when the solubility parameter of the repeating structural unit constituting the copolymer is denoted as $\delta n$ and the presence ratio (molar ratio) of the repeating structural unit in the copolymer is denoted as $\chi n$, the solubility parameter (SP value) of the copolymer is denoted as $\delta=\Sigma(\delta n\cdot\chi n)$. When the solubility parameter (SP value) of the repeating structural unit is calculated, as the cohesive energy and the molar volume of the carbonate group, the values of $\Delta ei=4200$ cal/mol and $\Delta vi=22.0\ cm^3/mol$, shown in the list of "Fundamentals and Engineering of Coating" (Processing Technology Study Association), p. 55, are used. For example, the copolymer is a polycarbonate copolymer formed by the polymerization of bisphenol Z monomers and bisphenol F monomers, and in the case where the molar ratio of the respective repeating units is 70% of Z units/30% of F units, the repeating unit structure of the Z unit has the following Z unit (I): $\delta_Z=((1180\times5+350\times1+7630\times2+4200\times1+250\times1)/(16.1\times5+(-19.2)\times1+52.4\times2+22.0\times1+16\times1))^{1/2}=11.28$; the repeating unit structure of the F unit has the following F unit (I): $\delta_F=((1180\times1+7630\times2+4200\times1)/(16.1\times1+52.4\times2+22.0\times1))^{1/2}=12.02$; and the solubility parameter $\delta_{Z70F30}$ of the polycarbonate copolymer is as follows: $\delta_{Z70F30}=11.28\times0.7+12.02\times0.3=11.50$.

Z unit (I)

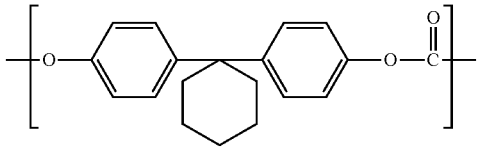

F unit (I)

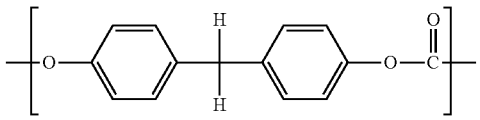

Specific examples of the specific polycarbonate copolymer include a copolymer of at least two or more divalent monomers (hereinafter referred to as a "divalent phenol") selected from a biphenyl monomer and a bisphenol monomer.

Particularly, from the viewpoint of prevention of the transfer of the polycarbonate (binder resin) to the protective layer (outermost surface layer), suitable examples of the polycarbonate copolymer include a polycarbonate copolymer having the repeating structural units represented by the following formula (PC-1) and a polycarbonate copolymer having the repeating structural units represented by the following formula (PC-2).

Specifically, examples of the specific polycarbonate copolymer include:

1) a polycarbonate copolymer having two or more repeating structural units represented by the following formula (PC-1), having different structures from each other, 2) a polycarbonate copolymer having two or more repeating structural units represented by the following formula (PC-2), having different structures from each other, and 3) a polycarbonate copolymer having one or two or more repeating structural units represented by the following formula (PC-1), having different structures from each other, and one or two or more repeating structural units represented by the following formula (PC-2), having different structures from each other.

Further, for the specific polycarbonate copolymer, each repeating structural unit (monomer) is selected so as to allow the SP value to be in the above range.

(PC-1)

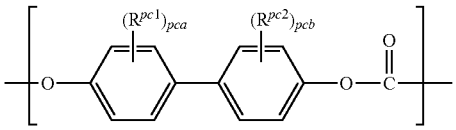

In the formula (PC-1), $R^{pc1}$ and $R^{pc2}$ each independently represent a halogen atom, an alkyl group having 1 to 6 carbon atoms, a cycloalkyl group having 5 to 7 carbon atoms, or an aryl group having 6 to 12 carbon atoms.

pca and pcb each independently represent an integer of 0 to 4.

In the formula (PC-1), $R^{pc1}$ and $R^{pc2}$ each independently preferably represent an alkyl group having 1 to 6 carbon atoms, and more preferably a methyl group.

In the formula (PC-1), pca and pcb each independently represent an integer of 0 to 2 preferably, and in particular, most preferably 0.

(PC-2)

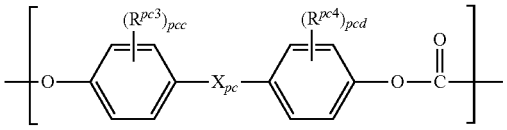

In the formula (PC-2), $R^{pc3}$ and $R^{pc4}$ each independently represent a halogen atom, an alkyl group having 1 to 6 carbon atoms, a cycloalkyl group having 5 to 7 carbon atoms, or an aryl group having 6 to 12 carbon atoms. pcc and pcd each independently represent an integer of 0 to 4. $X_{pc}$ represents —$CR^{pc5}R^{pc6}$— (provided that $R^{pc5}$ and $R^{pc6}$ each independently represent a hydrogen atom, a trifluoromethyl group, an alkyl group having 1 to 6 carbon atoms, or an aryl group having 6 to 12 carbon atoms), a 1,1-cycloalkylene group having 5 to 11 carbon atoms, an α, ω-alkylene group having 2 to 10 carbon atoms, —O—, —S—, —SO—, or —$SO_2$—.

In the formula (PC-2), $R^{pc3}$ and $R^{pc4}$ each independently represent preferably represent an alkyl group having 1 to 6 carbon atoms, and more preferably a methyl group.

pcc and pcd each independently represent preferably an integer of 0 to 2.

$X_{pc}$ preferably represents —$CR^{pc5}R^{pc6}$— (provided that $R^{pc5}$ and $R^{pc6}$ each independently represent a hydrogen atom or an alkyl group having 1 to 6 carbon atoms), or a 1,1-cycloalkylene group having 5 to 11 carbon atoms.

For the specific polycarbonate copolymer, from the viewpoint of the prevention of the transfer of the polycarbonate (binder resin) to the protective layer (outermost surface layer), the ratio (molar ratio) of the repeating structural unit represented by the formula (PC-1) may be from 20% by mole to 40% by mole, and preferably from 23% by mole to 37% by mole, with respect to the specific polycarbonate copolymer (the entire repeating structural units).

Furthermore, from the viewpoint of the prevention of the transfer of the polycarbonate (binder resin) to the protective layer (outermost surface layer), the ratio (molar ratio) of the repeating structural unit represented by the formula (PC-2) may be from 35% by mole to 90% by mole, preferably from 35% by mole to 55% by mole, and more preferably from 38% by mole to 52% by mole, with respect to the polycarbonate copolymer (the entire repeating structural units).

Specific examples of the repeating unit constituting the specific polycarbonate copolymer are shown below. Further, specific examples (units) of the repeating structural unit are shown by exemplifying the structures of the X moiety of the divalent phenol HO—(X)—OH that forms the repeating unit. Specifically, for example, the repeating structural unit represented by "(BP)-0" in the column of Unit No. represents a structural unit represented by "—O— (the structure shown in the column of the structure) —O—C(═O)—".

| Unit No. | Structure | Solubility parameter (SP value) |
|---|---|---|
| (BP)-0 | 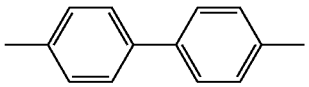 | 12.39 |
| (BP)-1 | 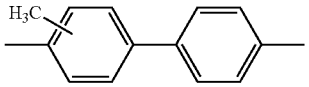 | 12.07 |
| (BP)-2-a | 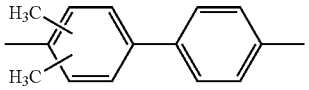 | 11.80 |
| (BP)-2-b | 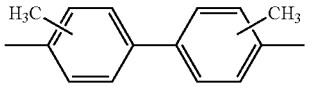 | 11.80 |
| (BP)-3 | 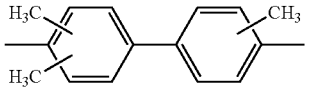 | 11.58 |
| (BP)-4 | 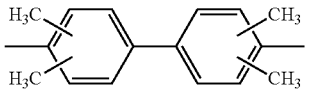 | 11.39 |
| (F)-0 | 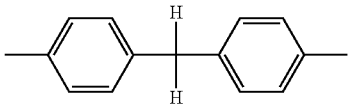 | 12.02 |
| (F)-1 | 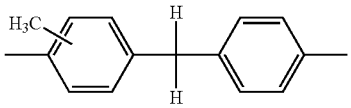 | 11.76 |
| (F)-2-a | 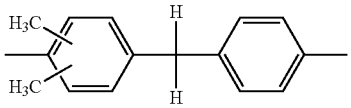 | 11.54 |
| (F)-2-b | 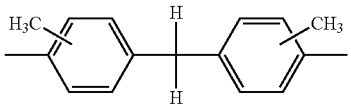 | 11.54 |
| (F)-3 | 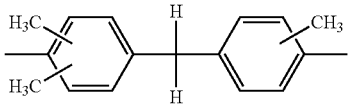 | 11.35 |

-continued
| Unit No. | Structure | Solubility parameter (SP value) |
|---|---|---|
| (F)-4 | 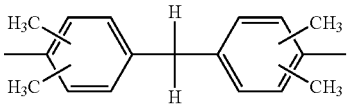 | 11.19 |
| (E)-0 | 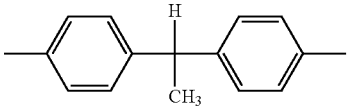 | 11.59 |
| (E)-1 | 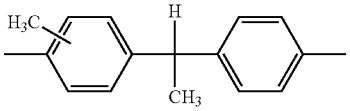 | 11.39 |
| (E)-2-a | 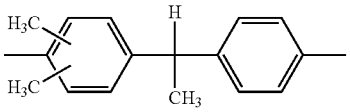 | 11.21 |
| (E)-2-b | 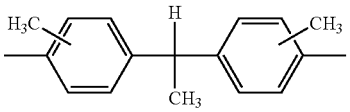 | 11.21 |
| (E)-3 | 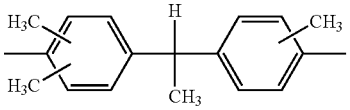 | 11.05 |
| (E)-4 | 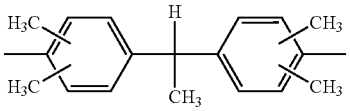 | 10.92 |
| (A)-0 | 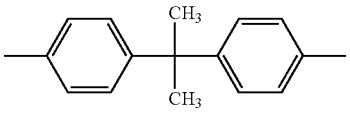 | 11.24 |
| (A)-1 | 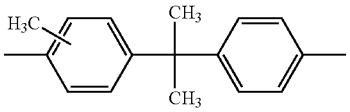 | 11.07 |
| (A)-2-b | 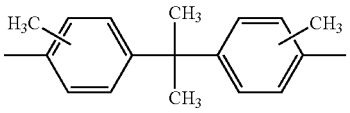 | 10.93 |
| (C)-0 | 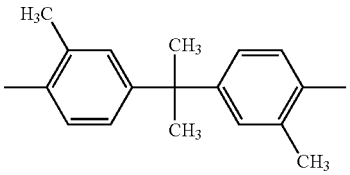 | 10.93 |
-continued
| Unit No. | Structure | Solubility parameter (SP value) |
|---|---|---|
| (A)-2-a | 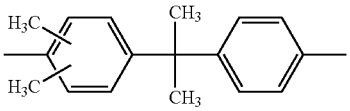 | 10.93 |
| (A)-3 | 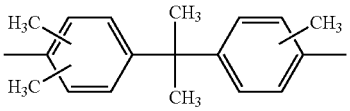 | 10.80 |
| (A)-4 | 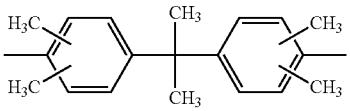 | 10.69 |
| (Oth)-1 | 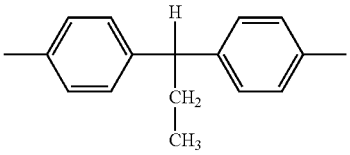 | 11.35 |
| (Oth)-2 | 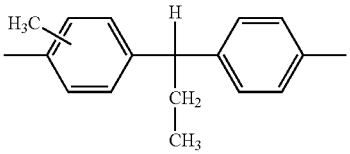 | 11.17 |
| (Oth)-3 | 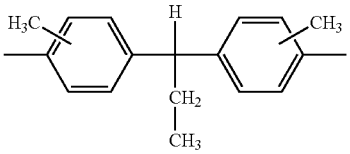 | 11.02 |
| (Oth)-4 | 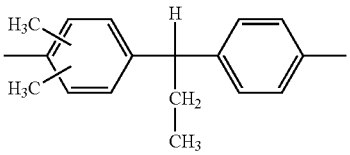 | 10.54 |
| (B)-0 | 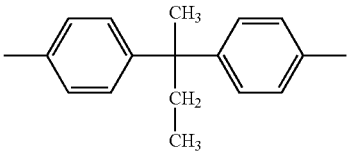 | 11.04 |
| (Oth)-5 | 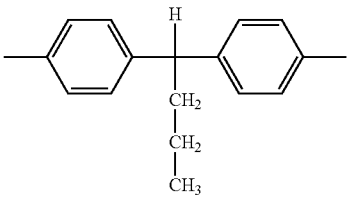 | 11.14 |

| Unit No. | Structure | Solubility parameter (SP value) |
|---|---|---|
| (Oth)-6 | 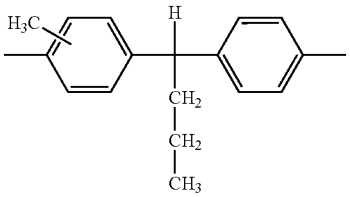 | 10.99 |
| (Oth)-7 | 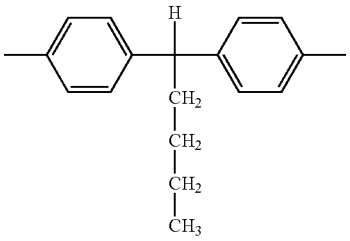 | 10.96 |
| (Oth)-8 | 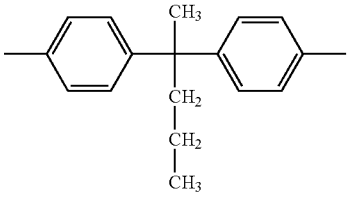 | 10.87 |
| (Oth)-9 | 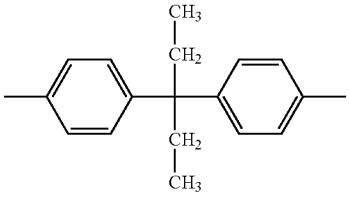 | 10.87 |
| (Oth)-10 | 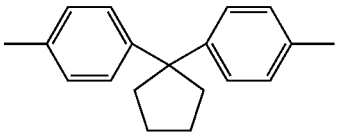 | 11.48 |
| (Oth)-11 | 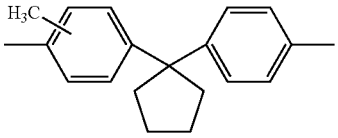 | 11.31 |
| (Oth)-12 | 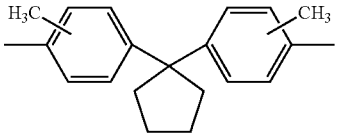 | 11.16 |
| (Oth)-13 | 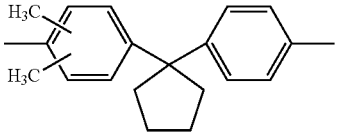 | 11.16 |
| Unit No. | Structure | Solubility parameter (SP value) |
|---|---|---|
| (Oth)-14 | 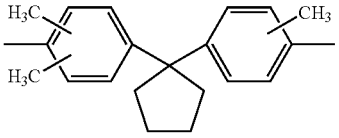 | 11.03 |
| (Oth)-15 | 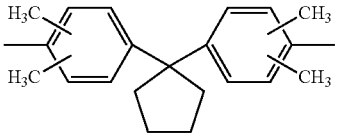 | 10.91 |
| (Z)-0 | 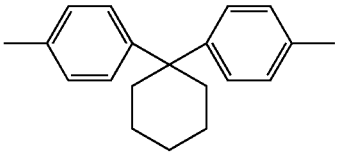 | 11.28 |
| (Z)-1 | 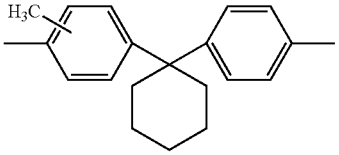 | 11.13 |
| (Z)-2-b | 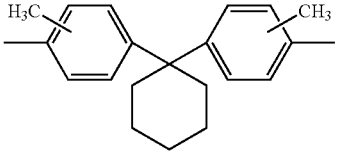 | 11.00 |
| (Z)-2-a | 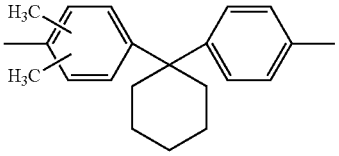 | 11.00 |
| (Z)-3 | 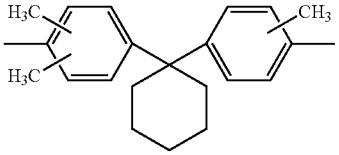 | 10.88 |
| (Z)-4 | 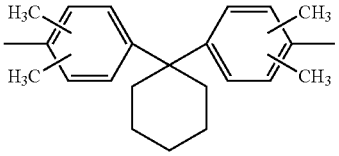 | 10.78 |
| (AP)-0 | 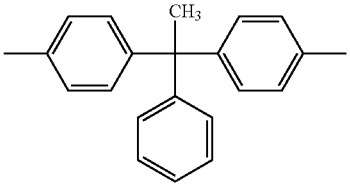 | 11.59 |

-continued

| Unit No. | Structure | Solubility parameter (SP value) |
|---|---|---|
| (TP)-0 | 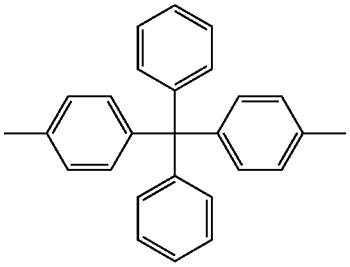 | 11.83 |

The specific polycarbonate copolymers may be used alone or in combination of two or more kinds thereof.

The viscosity average molecular weight of the specific polycarbonate copolymers is preferably 30000 or more, and more preferably 45000 or more. The upper limit of the viscosity average molecular weight of the specific polycarbonate copolymers is preferably 100000 or less.

Here, the viscosity average molecular weight is a value measured by a capillary viscometer.

The specific polycarbonate copolymer is synthesized by a known method, for example, by using a method in which a divalent phenol is reacted with a carbonate precursor material such as phosgene and carbonate diesters. Hereinafter, the basic method for this synthesis method will be briefly described.

For example, in the reaction using, for example, phosgene as a carbonate precursor material, the reaction is usually carried out in the presence of an acid binder and a solvent.

As the acid binder, for example, pyridine, alkali metal hydroxides such as sodium hydroxide and potassium hydroxide, and the like are used. As the solvent, for example, halogenated hydrocarbons such as methylene chloride and chlorobenzene are used. Further, in order to promote the reaction, for example, a catalyst such as a tertiary amine and a quaternary ammonium salt may be used. The reaction temperature is usually from 0° C. to 40° C., the reaction time is from several minutes to 5 hours, and the pH during the reaction may be usually 10 or more, preferably.

In the polymerization reaction, monofunctional phenols that are usually used as a chain terminator may be used. Examples of these monofunctional phenols include phenol, p-tert-butylphenol, p-cumylphenol, and isooctylphenol.

Here, for the polycarbonate, representative of which is the specific polycarbonate copolymer, binder resins other than the polycarbonate may be used in combination. However, the content of the binder resins other than the polycarbonate is, for example, 10% by weight or less, with respect to the entire binder resins.

Examples of the binder resins other than the polycarbonate include insulating resins such as acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinylformal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chlorine rubber, and organic photoconductive polymers such as a polyvinylcarbazole, a polyvinylanthracene, and a polyvinylpyrene. These binder resins may be used alone or as a mixture of two or more kinds thereof.

Further, the blending ratio of the charge transport material to the binder resin is, for example, preferably 10:1 to 1:5 in terms of the weight ratio.

The charge transport layer may contain other known additives.

The formation of the charge transport layer is not particularly limited, and a known formation method is used. For example, the charge transport layer is formed by forming a coating film of coating liquid for forming a charge transport layer, and drying and optionally heating the coating film.

Examples of the solvent for preparing the coating liquid for forming a charge transport layer include usual organic solvents, for example, aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or linear ethers such as tetrahydrofuran and ethyl ether. These solvents may be used alone or as a mixture of two or more kinds thereof.

Examples of the method of coating the coating liquid for forming a charge transport layer on the charge generation layer include usual methods such as a blade coating method, a wire bar coating method, a spray coating method, a dipping coating method, a bead coating method, an air knife coating method, and a curtain coating method.

The film thickness of the charge transport layer is preferably set in the range of 5 μm to 50 μm, and more preferably from 10 μm to 30 μm.

Protective Layer

The protective layer (outermost surface layer) is the outermost surface layer in the electrophotographic photoreceptor, and is composed of a cured film of a composition containing a reactive charge transport material. That is, the protective layer includes a polymer or crosslinked form of the reactive charge transport material.

The protective layer may be composed of a composition further containing other additives such as a non-reactive charge transport material and a compound having an unsaturated bond (unsaturated double bond). That is, the protective layer may further include other additives such as a polymer or crosslinked form of the reactive charge transport material and the compound having an unsaturated bond, resin particles, and a non-reactive charge transport material.

Furthermore, the curing method for the cured film involves carrying out radical polymerization with heat, light, radioactive rays, or the like. If the reaction is controlled not to proceed too quickly, the mechanical strength and the electrical characteristics of the protective layer (outermost surface layer) are improved, and further, unevenness of the film and generation of wrinkles are prevented, and accordingly, it is preferable to perform the polymerization under the condition where the generation of radicals occurs relatively slowly. From this viewpoint, thermal polymerization that allows the polymerization speed to be easily adjusted is suitable. That is, the composition for forming a cured film constituting the protective layer (outermost surface layer) may preferably include a thermal radical generator or a derivative thereof.

Reactive Charge Transport Material

The reactive charge transport material is selected from known compounds, which is a compound having a charge transport skeleton and a reactive group in the same molecule. Here, examples of the reactive group include chain polymerizable groups. For example, functional groups capable of radical polymerization are preferable and examples thereof include functional groups having a group containing at least carbon double bonds. Specifically, the chain polymerizable group is not particularly limited as long as it is a functional group capable of radical polymerization, and it is a functional group having a group containing at least carbon double bonds. Specific examples thereof include a group containing at least one selected from a vinyl group, a vinyl ether group, a vinyl thioether group, a styryl group, an acryloyl group, a methacryloyl group, and derivatives thereof. Among these, in terms of high reactivity, the chain polymerizable functional group is preferably a group containing at least one selected from a vinyl group, a styryl group, an acryloyl group, a methacryloyl group, and derivatives thereof.

Furthermore, the charge transport skeleton is not particularly limited as long as it has a structure known in electrophotographic photoreceptor, and is, for example, a skeleton derived from a nitrogen-containing hole transporting compound such as a triarylamine-based compound, a benzidine-based compound, and a hydrazone-based compound. Examples thereof include structures having conjugation with nitrogen atoms. Among these, a triarylamine skeleton is preferable.

As the reactive charge transport material, specifically, at least one selected from the group consisting of the reactive compounds represented by the formulae (I) and (II) (specific reactive charge transport materials) is preferable, from the viewpoint of the electrical characteristics and the mechanical strength.

(I)

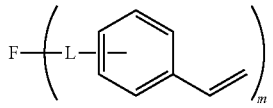

In the formula (I), F represents a charge transport skeleton.

L represents a divalent linking group including two or more selected from the group consisting of an alkylene group, an alkenylene group, —C(═O)—, —N(R)—, —S—, and —O—. R represents a hydrogen atom, an alkyl group, an aryl group, or an aralkyl group.

m represents an integer of 1 to 8.

(II)

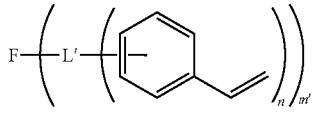

In the formula (II), F represents a charge transport skeleton.

L' represents an (n+1)-valent linking group including two or more selected from the group consisting of a trivalent or tetravalent group derived from an alkane or an alkene, an alkylene group, an alkenylene group, —C(═O)—, —N(R)—, —S—, and —O—. R represents a hydrogen atom, an alkyl group, an aryl group, or an aralkyl group. Further, the trivalent or tetravalent group derived from an alkane or an alkene means a group formed by the removal of 3 or 4 hydrogen atoms from an alkane or an alkene. The same shall apply hereinafter.

m' represents an integer of 1 to 6. n represents an integer of 2 to 3.

In the formulae (I) and (II), F represents a charge transport skeleton, that is, a structure having a charge transport property, and specific examples of the structure include structures having a charge transport property, such as a phthalocyanine-based compound, a porphyrin-based compound, an azobenzene-based compound, a triarylamine-based compound, a benzidine-based compound, an arylalkane-based compound, an aryl-substituted ethylene-based compound, a stilbene-based compound, an anthracene-based compound, a hydrazone-based compound, a quinone-based compound, and a fluorenone-based compound.

In the formula (I), examples of the linking group represented by L include:

a divalent linking group having —C(═O)—O— inserted in an alkylene group, a divalent linking group having —C(═O)—N(R)— inserted in an alkylene group, a divalent linking group having —C(═O)—S— inserted in an alkylene group, a divalent linking group having —O— inserted in an alkylene group, a divalent linking group having —N(R)— inserted in an alkylene group, and a divalent linking group having —S— inserted in an alkylene group.

Furthermore, the linking group represented by L may have two groups of —C(═O)—O—, —C(═O)—N(R)—, —C(═O)—S—, —O—, or —S— inserted in an alkylene group.

In the formula (I), specific examples of the linking group represented by L include:

$*—(CH_2)_p—C(=O)—O—(CH_2)_q—$, $*—(CH_2)_p—O—C(=O)—(CH_2)_r—C(=O)—O—(CH_2)_q—$, $*—(CH_2)_p—C(=O)—N(R)—(CH_2)_q—$, $*—(CH_2)_p—C(=O)—S—(CH_2)_q—$, $*—(CH_2)_p—O—(CH_2)_q—$, $*—(CH_2)_p—N(R)—(CH_2)_q—$, $*—(CH_2)_p—S—(CH_2)_q—$,and $*—(CH_2)_p—O—(CH_2)_r—O—(CH_2)_q—$.

Here, in the linking group represented by L, p represents 0, or an integer of 1 to 6 (preferably 1 to 5). q represents an integer of 1 to 6 (preferably 1 to 5). r represents an integer of 1 to 6 (preferably 1 to 5).

Further, in the linking group represented by L, "*" represents a site linked to F.

On the other hand, in the formula (II), examples of the linking group represented by L' include:

an (n+1)-valent linking group having —C(═O)—O— inserted in an alkylene group linked in a branched form, an (n+1)-valent linking group having —C(═O)—N(R)— inserted in an alkylene group linked in a branched form, an (n+1)-valent linking group having —C(═O)—S— inserted in an alkylene group linked in a branched form, an (n+1)-valent linking group having —O— inserted in an alkylene group linked in a branched form, an (n+1)-valent linking group having —N(R)— inserted in an alkylene group linked in a branched form, and an (n+1)-valent linking group having —S— inserted in an alkylene group linked in a branched form.

Further, the linking group represented by L' may have two groups of —C(═O)—O—, —C(═O)—N(R)—, —C(=O)—S—, —O—, or —S— inserted in an alkylene group linked in a branched form.

In the formula (II), specific examples of the linking group represented by L' include:

$*—(CH_2)_p—CH[C(=O)—O—(CH_2)_q—]_2,$ $*—(CH_2)_p—CH=C[C(=O)—O—(CH_2)_q—]_2,$ $*—(CH_2)_p—CH[C(=O)—N(R)—(CH_2)_q—]_2,$ $*—(CH_2)_p—CH[(C(=O)—S—(CH_2)_q—]_2,$ $*—(CH_2)_p—CH[(CH_2)_x—O—(CH_2)_q—]_2,$ $*—(CH_2)_p—CH[(CH_2)_x—O—(CH_2)_q—]_2,$ $*—(CH_2)_p—CH[(CH_2)_r—N(R)—(CH_2)_q—]_2),$ $*—(CH_2)_p—CH[(CH_2)_x—S—(CH_2)_q—]_2,$

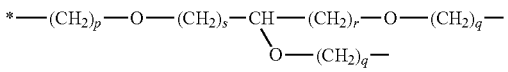

$*—(CH_2)_p—O—C[(CH_2)_r—O—(CH_2)_q—]_3$,and $*—(CH_2)_p—C(=O)—O—C[(CH_2)_r—O—(CH_2)_q—]_3.$ Here, in the linking group represented by L', p represents 0, or an integer of 1 to 6 (preferably 1 to 5). q represents an integer of 1 to 6 (preferably 1 to 5). r represents an integer of 1 to 6 (preferably 1 to 5). s represents an integer of 1 to 6 (preferably 1 to 5).

Further, in the linking group represented by L', "*" represents a site linked to F.

Among these, in the formula (II), the preferable linking groups represented by L' are $*—(CH_2)_p—CH[C(=O)—O—(CH_2)_q—]_2,$ $*—(CH_2)_p—CH=C[C(=O)—O—(CH_2)_q—]_2,$ $*—(CH_2)_p—CH[(CH_2)_r—O—(CH_2)_q—]_2$,and $*—(CH_2)_p—CH=C[(CH_2)_x—O—(CH_2)_q—]_2.$ Specifically, the group (corresponding to a group represented by the formula (IIA-a)) linked to the charge transport skeleton represented by F of the reactive compound represented by the formula (II) is preferably a group represented by the following formula (IIA-a1), (IIA-a2), (IIA-a3), or (IIA-a4).

(IIA-a1)

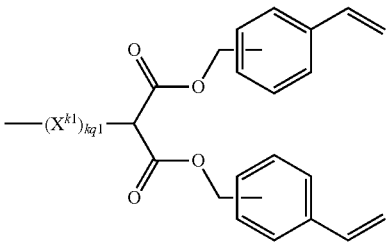

-continued (IIA-a2)

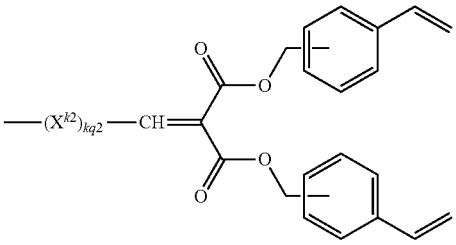

In the formula (IIA-a1) or (IIA-a2), $X^{k1}$ represents a divalent linking group. kq1 represents an integer of 0 or 1. $X^{k2}$ represents a divalent linking group. kq2 represents an integer of 0 or 1.

Here, examples of the divalent linking group represented by $X^{k1}$ and $X^{k2}$ include $—(CH_2)_p—$ (provided that p represents an integer of 1 to 6 (preferably 1 to 5)). Examples of the divalent linking group include an alkyloxy group.

(IIA-a3)

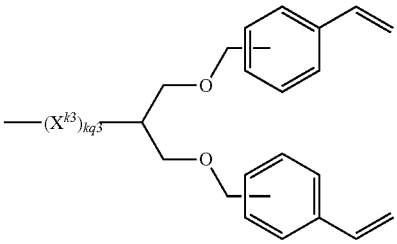

(IIA-a4)

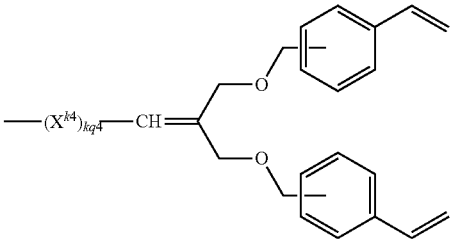

In the formula (IIA-a3) or (IIA-a4), $X^{k3}$ represents a divalent linking group. kq3 represents an integer of 0 or 1. $X^{k4}$ represents a divalent linking group. kq4 represents an integer of 0 or 1. Here, examples of the divalent linking group represented by $X^{k3}$ and $X^{k4}$ include $—(CH_2)_p—$ (provided that p represents an integer of 1 to 6 (preferably 1 to 5)). Examples of the divalent linking group include an alkyloxy group.

In the formulae (I) and (II), examples of the alkyl group represented by R of "—N(R)—" in the linking groups represented by L and L' include linear or branched alkyl groups having 1 to 5 carbon atoms (preferably 1 to 4 carbon atoms), and specific examples thereof include a methyl group, an ethyl group, a propyl group, and a butyl group.

Examples of the aryl group represented by R of "—N(R)—" include aryl groups having 6 to 15 carbon atoms (preferably 6 to 12 carbon atoms), and specific examples thereof include a phenyl group, a toluyl group, a xylidyl group, and a naphthyl group.

Examples of the aralkyl group include aralkyl groups having 7 to 15 carbon atoms (preferably 7 to 14 carbon atoms), and specific examples thereof include a benzyl group, a phenethyl group, and a biphenylmethylene group.

In the formulae (I) and (II), m preferably represents an integer of 1 to 6.

m' preferably represents an integer of 1 to 6.

n preferably represents an integer of 2 to 3.

Next, suitable compounds of the reactive compounds represented by the formulae (I) and (II) will be described.

The reactive compounds represented by the formulae (I) and (II) are preferably reactive compounds having a charge transport skeleton (structure having a charge transport property) derived from a triarylamine compound as F.

Specifically, as the reactive compound represented by the formula (I), at least one compound selected from the reactive compounds represented by the formulae (I-a), (I-b), (I-c), and (I-d) is suitable.

On the other hand, as the reactive compound represented by the formula (II), the reactive compound represented by the formula (II-a) is suitable.

Reactive Compound Represented by Formula (I-a)

The reactive compound represented by the formula (I-a) will be described.

If the reactive compound represented by the formula (I-a) is applied as the specific reactive charge transport material, the deterioration of the electrical characteristics due to the environmental change is easily prevented. The reason is not clear, but it is thought to be as follows.

First, it may be thought that for the reactive compound having a (meth)acryl group used in the related art, the (meth) acryl group is highly hydrophilic with respect to the skeleton site exhibiting the charge transport performance during the polymerization. As a result, a certain kind of layer separation state is formed, and thus, the hopping conduction is disturbed. Therefore, it is thought that the charge transport film including a polymer or crosslinked form of a (meth)acryl group-containing reactive compound exhibits deterioration of the efficiency in the charge transport, and further, the partial moisture adsorption or the like causes a decrease in the environmental stability.

Meanwhile, the reactive compound represented by the formula (I-a) has a vinyl chain polymerizable group having low hydrophilicity, and further, has plural skeletons exhibiting the charge transport performance in one molecule, and the skeletons are linked to each other with a flexible linking group having no aromatic ring and no conjugate bond such as a conjugate double bond. It is thought that such a structure promotes efficient charge transport performance and high strength, and suppresses the formation of the layer separation state during the polymerization. As a result, it is thought that the protective layer (outermost surface layer) including the polymer or crosslinked form of the reactive compound represented by the formula (I-a) is excellent in both of the charge transport performance and the mechanical strength, and further, the environment dependency (temperature and humidity dependency) of the charge transport performance may be decreased.

As described above, it is thought that if the reactive compound represented by the formula (I-a) is applied, the deterioration of the electrical characteristics due to the environmental change is easily prevented.

(I-a)

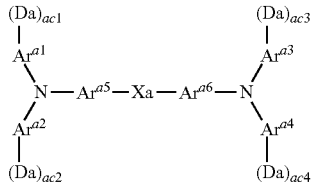

In the formula (I-a), $Ar^{a1}$ to $Ar^{a4}$ each independently represent a substituted or unsubstituted aryl group. $Ar^{a5}$ and $Ar^{a6}$ each independently represent a substituted or unsubstituted arylene group. Xa represents a divalent linking group formed by a combination of the groups selected from an alkylene group, —O—, —S—, and an ester. Da represents a group represented by the following formula (IA-a). ac1 to ac4 each independently represent an integer of 0 to 2. However, the total number of Da's is 1 or 2.

(IA-a)

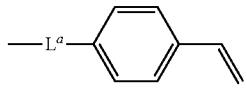

In the formula (IA-a), La is represented by *—$(CH_2)_{az}$—O—$CH_2$— and represents a divalent linking group linked to a group represented by $Ar^{a1}$ to $Ar^{a4}$ at *. az represents an integer of 1 or 2.

Hereinafter, the details of the formula (I-a) will be described.

In the formula (I-a), the substituted or unsubstituted aryl groups represented by $Ar^{a1}$ to $Ar^{a4}$ may be the same as or different from each other.

Here, examples of the substituents in the substituted aryl group, those other than "Da", include an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom.

In the formula (I-a), $Ar^{a1}$ to $Ar^{a4}$ are preferably any one of the following structural formulae (1) to (7).

Furthermore, the following structural formulae (1) to (7) are described together with "$-(D)_C$", which totally refers to "$-(Da)_{ac1}$" to "$-(Da)_{ac1}$" that may be linked to each of $Ar^{a1}$ to $Ar^{a4}$.

(1)

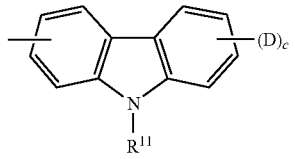

(2)

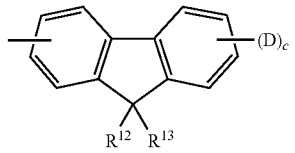

-continued (3)

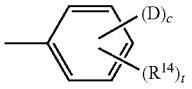

(4)

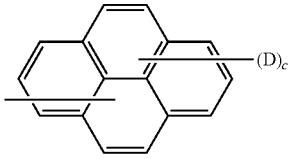

(5)

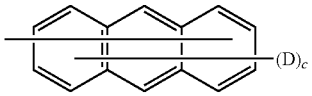

(6)

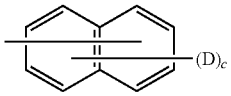

(7)

$$—Ar—(Z')_s—Ar—(D)_c$$

In the structural formulae (1) to (7), $R^{11}$ represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, and an aralkyl group having 7 to 10 carbon atoms. $R^{12}$ and $R^{13}$ each independently represent one selected from the group consisting of a hydrogen atom, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. $R^{14}$'s each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. Ar represents a substituted or unsubstituted arylene group. s represents 0 or 1. t represents an integer of 0 to 3. Z' represents a divalent organic linking group.

Here, in the formula (7), Ar is preferably one represented by the following structural formula (8) or (9).

(8)

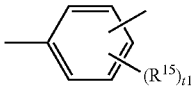

(9)

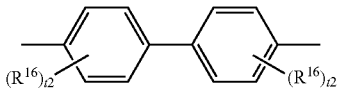

In the structural formulae (8) and (9), $R^{15}$ and $R^{16}$ each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom, and t1 and t2 each represent an integer of 0 to 3.

Furthermore, in the formula (7), Z' preferably represents one represented by any one of the following structural formulae (10) to (17).

(10)

$$—(CH_2)_{q1}—$$

(11)

$$—(CH_2CH_2O)_{r1}—$$

(12)

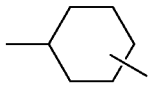

(13)

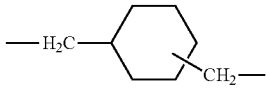

(14)

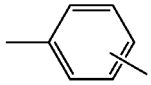

(15)

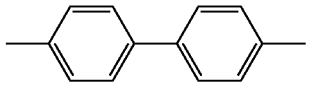

(16)

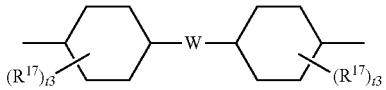

(17)

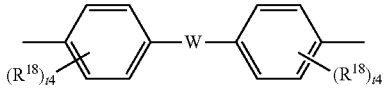

In the structural formulae (10) to (17), $R^{17}$ and $R^{18}$ each independently represent one selected from the group consisting of an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms, and a halogen atom. W represents a divalent group. q1 and r1 each independently represent an integer of 1 to 10. t3 and t4 each represent an integer of 0 to 3.

In the structural formulae (16) to (17), W is preferably any one of the divalent groups represented by the following structural formulae (18) to (26). However, in the formula (25), u represents an integer of 0 to 3.

(18)

$$—CH_2—$$

(19)

$$—C(CH_3)_2—$$

(20)

$$—O—$$

(21)

$$—S—$$

(22)

$$—C(CF_3)_2—$$

(23)

$$—Si(CH_3)_2—$$

(24)

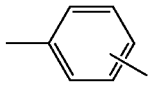

-continued (25)

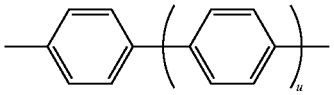

(26)

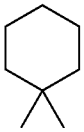

In the formula (I-a), in the substituted or unsubstituted arylene group represented by $Ar^{a5}$ and $Ar^{a6}$, examples of the arylene group include arylene groups formed by the removal of one hydrogen atom at a desired position from the aryl group exemplified in the description of $Ar^{a1}$ to $Ar^{a6}$.

Furthermore, examples of the substituent in the substituted arylene group are the same as those exemplified as the substituent other than "Da" in the substituted aryl group in the description of $Ar^{a1}$ to $Ar^{a4}$.

In the formula (I-a), the divalent linking group represented by Xa is an alkylene group, or a divalent group formed by the combination of the groups selected from alkylene group, —O—, —S—, and an ester, and is a linking group including no aromatic ring and no conjugate bond such as a conjugate double bond.

Specifically, examples of the divalent linking group represented by Xa include an alkylene group having 1 to 10 carbon atoms, as well as a divalent group formed by a combination of an alkylene group having 1 to 10 carbon atoms with a group selected from —O—, —S—, —O—C(=O)—, and —C(=O)—O—.

In addition, in the case where the divalent linking group represented by Xa is an alkylene group, the alkylene group may have a substituent such as alkyl, alkoxy, and halogen, and two of these substituents may be bonded to each other to have the structure such as the divalent linking group represented by the structural formula (26) described as the specific examples of W in the structural formulae (16) to (17).

Reactive Compound Represented by Formula (I-b)

The reactive compound represented by the formula (I-b) will be described.

If the reactive compound represented by the formula (I-b) is applied as the specific reactive charge transport material, the abrasion of the protective layer (outermost surface layer) is prevented, and further, the generation of the uneven density of the image is easily prevented. The reason is not clear, but is thought to be as follows.

First, when the bulky charge transport skeleton and the polymerization site (styryl group) are structurally close to each other, and rigid, it is difficult for polymerization moieties to move, residual strain due to a curing reaction easily remains, and the charge transport skeleton is deformed, and therefore, there occurs a change in the level of highest occupied molecular orbital (HOMO) in charge of carrier transport and as a result, a state where the energy distribution spreads (disorder in energy: large σ) is easily caused.

Meanwhile, through a methylene group or an ether group, it is easy to provide the molecule structure with flexibility and a small σ is easily obtained. Further, the methylene group or the ether group has a small dipole moment, as compared with an ester group, an amide group, or the like, and this effect contributes to a decrease in σ, thereby improving the electrical characteristics. Further, by providing the molecular structure with flexibility, the degree of freedom of the movement of the reactive site is increased and the reaction rate is improved, which is thought to yield a film having a high strength.

From these, a structure where a linking chain having sufficient flexibility is inserted between the charge transport skeleton and the polymerization site is preferable.

Consequently, it is thought that the reactive compound represented by the formula (I-b) has an increased molecular weight of the molecule itself by the curing reaction, it becomes difficult for the weight center to move, and the degree of freedom of the styryl group is high. As a result, it is thought that the protective layer (outermost surface layer) including a polymer or crosslinked form of the reactive compound represented by the formula (I-b) has excellent electrical characteristics and high strength.

From the above, if the reactive compound represented by the formula (I-b) is applied, the abrasion of the protective layer (outermost surface layer) is prevented, and further, the generation of the uneven density of the image is easily prevented.

(I-b)

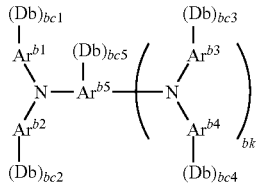

In the formula (I-b), $Ar^{b1}$ to $Ar^{b4}$ each independently represent a substituted or unsubstituted aryl group. $Ar^{b5}$ represents a substituted or unsubstituted aryl group, or a substituted or unsubstituted arylene group. Db represents a group represented by the following formula (IA-b). bc1 to bc5 each independently represent an integer of 0 to 2. bk represents 0 or 1. However, the total number of Db's is 1 or 2.

(IA-b)

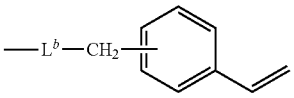

In the formula (IA-b), $L^b$ includes a group represented by $*—(CH_2)_{bn}—O—$ and represents a divalent linking group linked to a group represented by $Ar^{b1}$ to $Ar^{b5}$ at *. bn represents an integer of 3 to 6.

Hereinafter, the details of the formula (I-b) will be described.

In the formula (I-b), the substituted or unsubstituted aryl groups represented by $Ar^{b1}$ to $Ar^{b4}$ have the same meanings as the substituted or unsubstituted aryl groups represented by $Ar^{a1}$ to $Ar^{a4}$ in the formula (I-a).

When bk is 0, $Ar^{b5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When bk is 1, $Ar^{b5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

Next, the details of the formula (IA-b) will be described.

In the formula (IA-b), examples of the divalent linking group represented by $L^b$ include:

$$*—(CH_2)_{bp}—O— \text{ and}$$

$$*—(CH_2)_{bp}—O—(CH_2)_{bq}—O—.$$

Here, in the linking group represented by $L^b$, bp represents an integer of 3 to 6 (preferably 3 to 5). bq represents an integer of 1 to 6 (preferably 1 to 5).

Further, in the linking group represented by $Lb^b$, "*" represents a site linked to a group represented by $Ar^{b1}$ to $Ar^{b5}$.

Reactive Compound Represented by Formula (I-c)

The reactive compound represented by the formula (I-c) will be described.

If the reactive compound represented by the formula (I-c) is applied as the specific reactive charge transport material, it is difficult to generate scratches on the surface even when used repeatedly, and further, deterioration of the image quality is easily prevented. The reason therefor is not clear, but is thought to be as follows.

First, it is thought that film shrinkage accompanying a polymerization reaction or a crosslinking reaction, or aggregation of the charge transport structure, and the structure in the vicinity of a chain polymerizable group occur when an outermost surface layer including a polymer or crosslinked form of the specific reactive charge transport material is formed. Therefore, it is thought that when a mechanic load is applied to an electrophotographic photoreceptor surface due to repeated use, the film itself is abraded or the chemical structure in the molecule is cut, the film shrinkage or the aggregation state changes, the electrical characteristics as the electrophotographic photoreceptor changes, and thus, deterioration of the image quality occurs.

On the other hand, it is thought that since the reactive compound represented by the formula (I-c) has a styrene skeleton as the chain polymerizable group, the compatibility with an aryl group which is a main skeleton of the charge transport material is attained, and the film shrinkage or the aggregation of the charge transport structure due to the polymerization reaction or the crosslinking reaction, and the aggregation of the structure in the vicinity of the chain polymerizable group is prevented. As a result, it is thought that in the electrophotographic photoreceptor including the protective layer (outermost surface layer) including a polymer or crosslinked form of the reactive compound represented by the formula (I-c), deterioration of the image quality due to the repeated use is prevented.

In addition, it is though that for the reactive compound represented by the formula (I-c), a charge transport skeleton and a styrene skeleton are linked via a linking group including a specific group such as —C(=O)—, —N(R)—, and —S—, and thus, the interaction between the specific group and a nitrogen atom in the charge transport skeleton, and between the specific groups, and the like occur, and as a result, it is also thought that the protective layer (outermost surface layer) including a polymer or crosslinked form of the reactive compound represented by the formula (I-c) has a further improved strength.

As described above, it is thought that if the reactive compound represented by the formula (I-c) is applied, it is difficult to generate scratches on the surface even when used repeatedly, and further, the deterioration of the image quality is easily prevented.

In addition, it is thought that a specific group such as —C(=O)—, —N(R)—, and —S— causes deterioration of a charge transport property and deterioration of the image quality under the conditions of high humidity due to its polarity or hydrophilicity, but the reactive compound represented by the formula (I-c) has a styrene skeleton having higher hydrophobicity than (meth)acryl or the like as a chain polymerizable group, and thus, it is difficult for deterioration of charge transport property and deterioration of the image quality, such as development of the residual image (ghost) caused by the history of the previous cycle to occur.

(I-c)

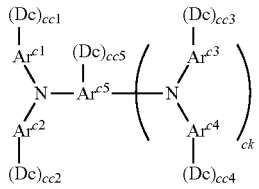

In the formula (I-c), $Ar^{c1}$ to $Ar^{c4}$ each independently represent a substituted or unsubstituted aryl group. $Ar^{c5}$ represents a substituted or unsubstituted aryl group, or a substituted or unsubstituted arylene group. Dc represents a group represented by the following formula (IA-c). cc1 to cc5 each independently represent an integer of 0 to 2. ck represents 0 or 1. However, the total number of Dc's is from 1 to 8.

(IA-c)

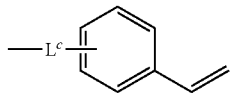

In the formula (IA-c), $L^c$ represents a divalent linking group including one or more groups selected from the group consisting of the groups formed by a combination of —C(=O)—, —N(R)—, —S—, and —C(=O)— with —O—, —N(R)—, or —S—. R represents a hydrogen atom, an alkyl group, an aryl group, or an aralkyl group.

Hereinafter, the details of the formula (I-c) will be described.

In the formula (I-c), the substituted or unsubstituted aryl groups represented by $Ar^{c1}$ to $Ar^{c4}$ have the same meanings as the substituted or unsubstituted aryl groups represented by $Ar^{a1}$ to $Ar^{a4}$ in the formula (I-a).

When ck is 0, $Ar^{c5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When ck is 1, $Ar^{c5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

From the viewpoint of obtaining a protective layer (outermost surface layer) having a higher strength, the total number of Dc's is preferably 2 or more, and more preferably 4 or more. Generally, if the number of the chain polymerizable groups in one molecule is too large, as the polymerization (crosslinking) reaction proceeds, it is difficult for the molecule to move, the chain polymerization reactivity is decreased, and the ratio of the chain polymerizable groups before reaction is increased, and thus, the total number of Dc's is preferably 7 or less, and more preferably 6 or less.

Next, the details of the formula (IA-c) will be described.

In the formula (IA-c), $L^c$ represents a divalent linking group including a group (hereinafter also referred to as a "specific linking group") formed by a combination of —C(=O)—, —N(R)—, —S—, or —C(=O)—, and —O—, —N(R)—, or —S—.

Here, from the viewpoint of a balance of the strength of the protective layer (outermost surface layer) and the polarity (hydrophilicity/hydrophobicity), the specific linking group is, for example, —C(=O)—, —N(R)—, —S—, —C(=O)—O—, —C(=O)—N(R)—, —C(=O)—S—, —O—C(=O)—O—, —O—C(=O)—N(R)—, preferably —N(R)—, —S—, —C(=O)—O—, —C(=O)—N(H)—, or —C(=O)—O—, and more preferably —C(=O)—O—.

Furthermore, examples of the divalent linking group represented by $L^c$ include divalent linking groups formed by the combination of the specific linking group with a saturated hydrocarbon (including linear, branched, or cyclic ones) or residues of aromatic hydrocarbons, and an oxygen atom, and in particular, divalent linking groups formed by the combination of the specific linking group with a residue of a linear saturated hydrocarbon and an oxygen atom.

The total number of the carbon atoms included in the divalent linking group represented by $L^c$ is, for example, from 1 to 20, and preferably from 2 to 10, from the viewpoint of the density of a styrene skeleton in the molecule and the chain polymerization reactivity.

In the formula (IA-c), specific examples of the divalent linking group represented by $L^c$ include:

$*—(CH_2)_{cp}—C(=O)—O—(CH_2)_{cq}—$, $*—(CH_2)_{cp}—O—C(=O)—(CH_2)_{cr}—C(=O)—O—(CH_2)_{cq}—$, $*—(CH_2)_{cp}—C(=O)—N(R)—(CH_2)_{cq}—$, $*—(CH_2)_{cp}—C(=O)—S—(CH_2)_{cq}—$, $*—(CH_2)_{cp}—N(R)—(CH_2)_{cq}—$, and $*—(CH_2)_{cp}—S—(CH_2)_{cq}—$.

Here, in the linking group represented by $L^c$, cp represents 0 or an integer of 1 to 6 (preferably 1 to 5). cq represents an integer of 1 to 6 (preferably 1 to 5). cr represents an integer of 1 to 6 (preferably 1 to 5).

Further, in the linking group represented by $L^c$, "*" represents a site linked to a group represented by $Ar^{c1}$ to $Ar^{c5}$.

Among these, in the formula (IA-c), the divalent linking group represented by $L^c$ is preferably $*—(CH_2)_{cp}—C(=O)—O—CH_2—$. That is, the group represented by the formula (IA-c) is preferably a group represented by the following formula (IA-c1). However, in the formula (IA-c1), cp1 represents an integer of 0 to 4.

(IA-c1)

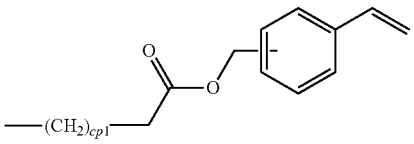

Reactive Compound Represented by Formula (I-d)

The reactive compound represented by the formula (I-d) will be described.

If the reactive compound represented by the formula (I-d) is applied as the specific reactive charge transport material, the abrasion of the protective layer (outermost surface layer) is prevented, and further, the generation of the uneven density of the image is easily prevented. The reason is not clear, but is thought to be the same as for the reactive compound represented by the formula (I-b).

Particularly, it is thought that since the reactive compound represented by the formula (I-d) has a large total number of Dd of 3 to 8, as compared with the formula (I-b), the formed crosslinked form easily forms a more highly crosslinked structure (crosslinked network) and the abrasion of the protective layer (outermost surface layer) is more easily prevented.

(I-d)

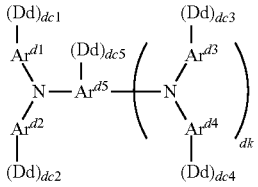

In the formula (I-d), $Ar^{d1}$ to $Ar^{d4}$ each independently represent a substituted or unsubstituted aryl group. $Ar^{d5}$ represents a substituted or unsubstituted aryl group, or a substituted or unsubstituted arylene group. Dd represents a group represented by the following formula (IA-d). dc1 to dc5 each independently represent an integer of 0 to 2. dk represents 0 or 1. However, the total number of Dd's is from 3 to 8.

(IA-d)

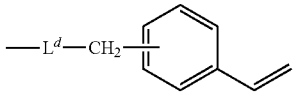

In the formula (IA-d), $L^d$ includes a group represented by $*—(CH_2)_{dn}—O—$, and represents a divalent linking group linked to a group represented by $Ar^{d1}$ to $Ar^{d5}$ at *. dn represents an integer of 1 to 6.

Hereinafter, the details of the formula (I-d) will be described.

In the formula (I-d), the substituted or unsubstituted aryl groups represented by $Ar^{d1}$ to $Ar^{d4}$ have the same meanings as the substituted or unsubstituted aryl groups represented by $Ar^{a1}$ to $Ar^{a4}$ in the formula (I-a).

When dk is 0, $Ar^{d5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When dk is 1, $Ar^{d5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

The total number of Dd is preferably 4 or more, from the viewpoint of obtaining a protective layer (outermost surface layer) having a higher strength.

Next, the details of the formula (IA-d) will be described.

In the formula (IA-d), examples of the divalent linking group represented by $L^d$ include:

$*—(CH_2)_{dp}—O—$ and $*—(CH_2)_{dp}—O—(CH_2)_{dq}—O—$.

Here, in the linking group represented by $L^d$, dp represents an integer of 1 to 6 (preferably 1 to 5). dq represents an integer of 1 to 6 (preferably 1 to 5).

Furthermore, in the linking group represented by $L^d$, "*" represents a site linked to a group represented by $Ar^{d1}$ to $Ar^{d5}$.

Reactive Compound Represented by Formula (II-a)

The reactive compound represented by the formula (II-a) will be described.

When the reactive compound represented by the formula (II) (in particular, the formula (II-a)) is applied as the specific reactive charge transport material, the deterioration of the electrical characteristics is easily prevented even when used repeatedly for a long period of time. The reason is not clear, but is thought to be as follows.

First, the reactive compound represented by the formula (II) (in particular, the formula (II-a)) is a compound having 2 or 3 chain polymerizable reactive groups (styrene groups) via one linking group from the charge transport skeleton.

Consequently, it is thought that, owing to the presence of the linking group, the reactive compound represented by the formula (II) (in particular, the formula (II-a)) hardly causes strain in the charge transport skeleton when polymerized or crosslinked while maintaining high curing degrees and number of crosslinked moieties, and excellent charge transport performance is also easily achieved with a high curing degree.

Furthermore, the charge transport compound having a (meth)acryl group, which has been used in the related art, easily causes strain as described above, the reactive site has high hydrophilicity, and the charge transport site has high hydrophobicity, and as a result, a microscopic phase separation (microphase separation) easily occurs. However, it is thought that the reactive compound represented by the formula (II) (in particular, the formula (II-a)) has a styrene group as a reactive group, and further, it has a structure having a linking group that hardly causes strain in the charge transport skeleton when cured (crosslinked), the reactive site and the charge transport site are both hydrophobic, and the phase separation hardly occurs, and as a result, efficient charge transport performance and increase in strength are obtained. As a result, it is thought that the protective layer (outermost surface layer) including the polymer or crosslinked form of the reactive compound represented by the formula (II) (in particular, the formula (II-a)) has excellent mechanical strength as well as superior charge transport performance (electrical characteristics).

As a result, if the reactive compound represented by the formula (II) (in particular, the formula (II-a)) is applied, it is thought that the deterioration of the electrical characteristics even when used repeatedly for a long period of time is easily prevented.

(II-a)

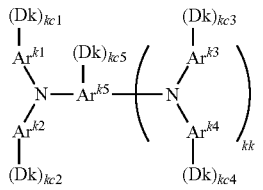

In the formula (II-a), $Ar^{k1}$ to $Ar^{k4}$ each independently represent a substituted or unsubstituted aryl group. $Ar^{k5}$ represents a substituted or unsubstituted aryl group, or a substituted or unsubstituted arylene group. Dk represents a group represented by the following formula (IIA-a). kc1 to kc5 each independently represent an integer of 0 to 2. kk represents 0 or 1. However, the total number of Dk's is from 1 to 8.

(IIA-a)

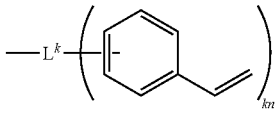

In the formula (IIA-a), $L^k$ represents a (kn+1)-valent linking group including two or more selected from the group consisting of a trivalent or tetravalent group derived from an alkane or an alkene, and an alkylene group, an alkenylene group, —C(=O)—, —N(R)—, —S—, and —O—. R represents a hydrogen atom, an alkyl group, an aryl group, or an aralkyl group. kn represents an integer of 2 to 3.

Hereinafter, the details of the formula (II-a) will be described.

In the formula (II-a), the substituted or unsubstituted aryl groups represented by $Ar^{k1}$ to $Ar^{k4}$ have the same meanings as the substituted or unsubstituted aryl groups represented by $Ar^{a1}$ to $Ar^{a4}$ in the formula (I-a).

When kk is 0, $Ar^{k5}$ represents a substituted or unsubstituted aryl group, and the substituted or unsubstituted aryl group is the same as the substituted or unsubstituted aryl groups represented by $Ar^{a1}$ to $Ar^{a4}$ in the formula (I-a).

When kk is 1, $Ar^{k5}$ represents a substituted or unsubstituted arylene group, and the substituted or unsubstituted arylene group is the same as the substituted or unsubstituted arylene groups represented by $Ar^{a5}$ and $Ar^{a6}$ in the formula (I-a).

From the viewpoint of obtaining a protective layer (outermost surface layer) having a higher strength, the total number of Dk's is preferably 2 or more, and more preferably 4 or more. Generally, if the number of the chain polymerizable groups in one molecule is too large, as the polymerization (crosslinking) reaction proceeds, it is difficult for the molecule to move, the chain polymerization reactivity is decreased, and the ratio of the chain polymerizable groups before reaction is increased, and thus, the total number of Dk's is preferably 7 or less, and more preferably 6 or less.

Next, the details of the formula (IIA-a) will be described.

In the formula (IIA-a), the (kn+1)-valent linking group represented by $L^k$ is the same as, for example, the (n+1)-valent linking group represented by L' in the formula (II).

Hereinafter, the details of the specific reactive charge transport material are shown.

Specifically, specific examples of the charge transport skeleton F (for example, a site corresponding to the skeleton excluding Da in the formula (I-a) and Dk in the formula (II-a)) of the formulae (I) and (II), and specific examples of the functional group (for example, the site corresponding to Da in the formula (I-a) and Dk in the formula (II-a)) linked to the charge transport skeleton F, as well as specific examples of the reactive compounds represented by the formulae (I) and (II) are shown below, but are not limited thereto.

Furthermore, the "*" moiety of the specific examples of the charge transport skeleton F of the formulae (I) and (II) means that the "*" moiety of the functional group linked to the charge transport skeleton F is linked thereto.

That is, for example, for the exemplary compound (I-b)-1, a specific example of the charge transport skeleton F: (M1)-1 and a specific example of the functional group: (R2)-1 are shown, but the specific structure thereof is shown as the following structure.

(I-b)-1
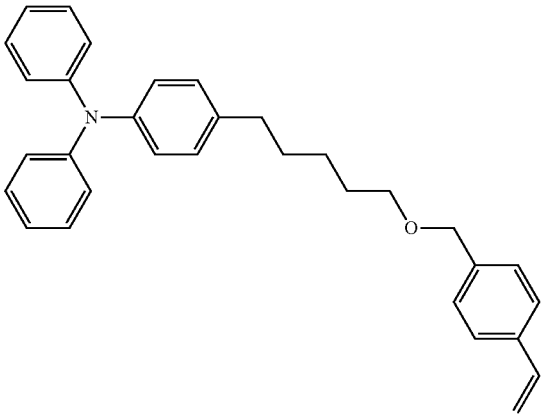
First, specific examples of the charge transport skeleton F are shown below.
(M1)-1
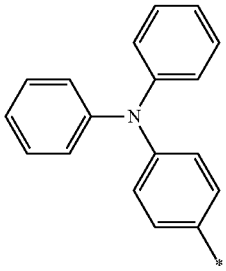
(M1)-2
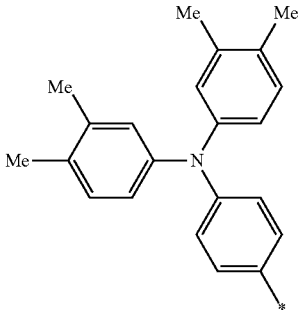
(M1)-3
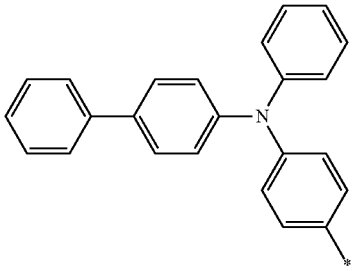
-continued
(M1)-4
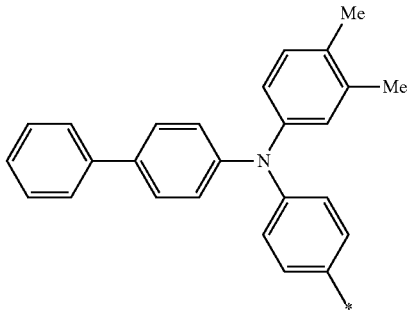
(M1)-5
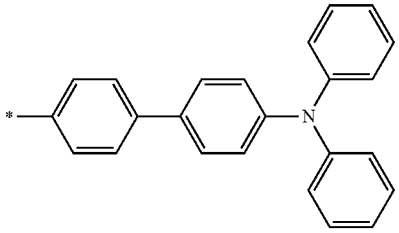
(M1)-6
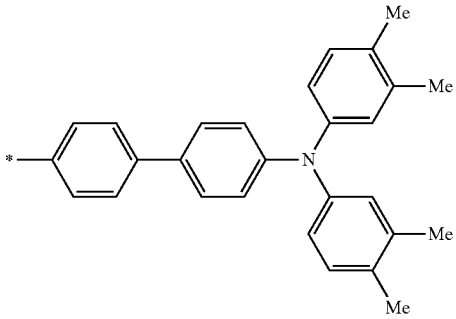
(M1)-7
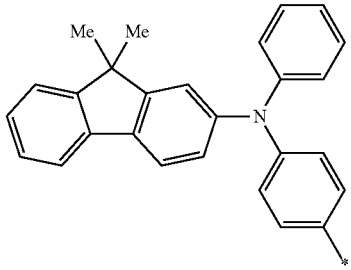
(M1)-8
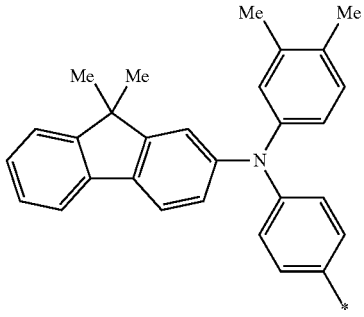

-continued
(M1)-9
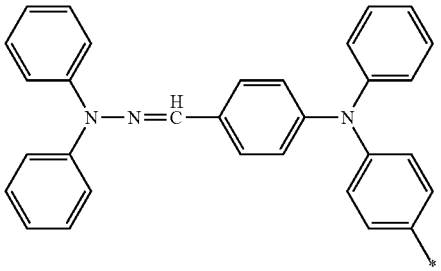
(M1)-10
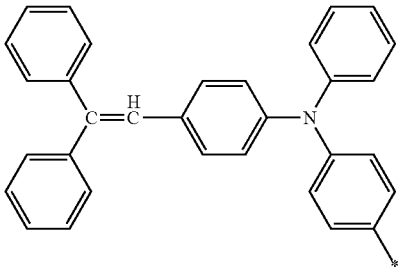
(M-)-11
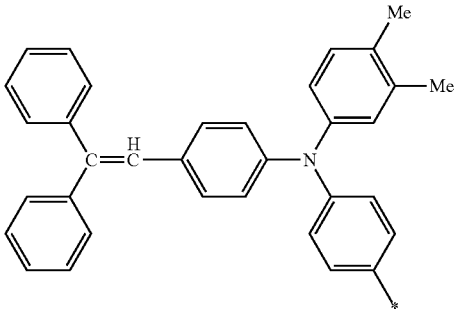
(M1)-12
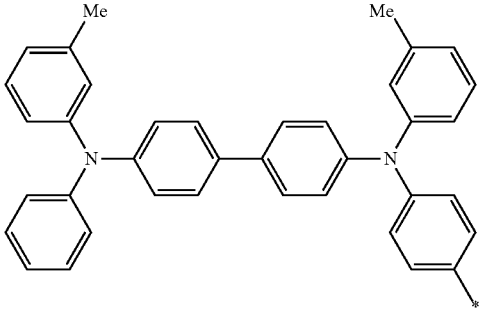
(M1)-13
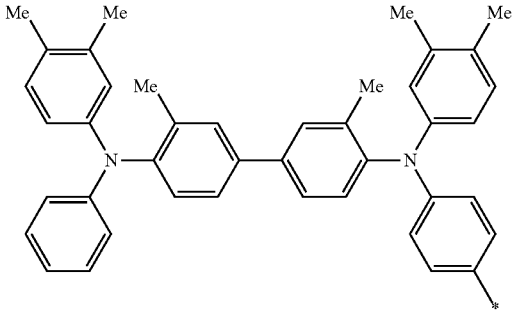
-continued
(M1)-14
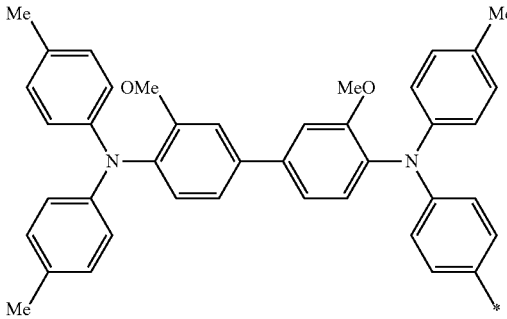
(M1)-15
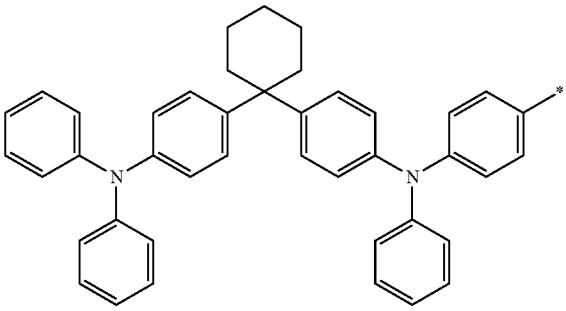
(M1)-16
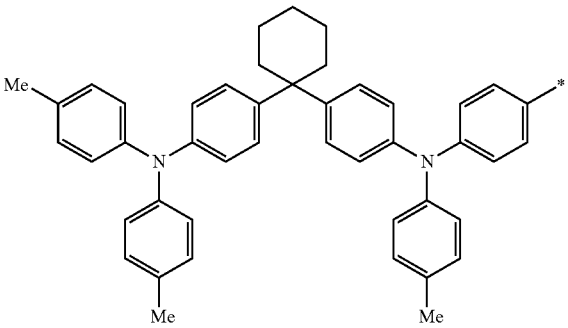
(M1)-17
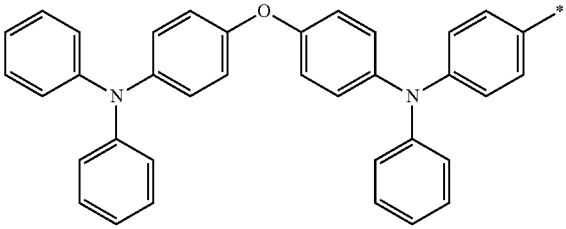
(M1)-18
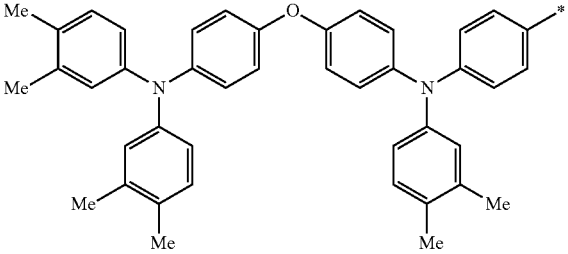

-continued
(M1)-19
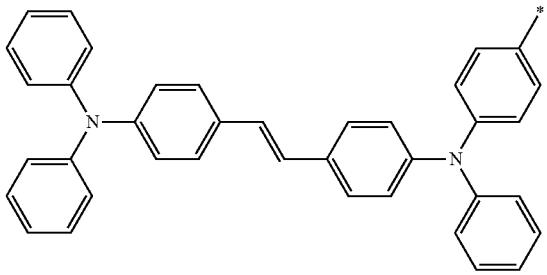
(M1)-20
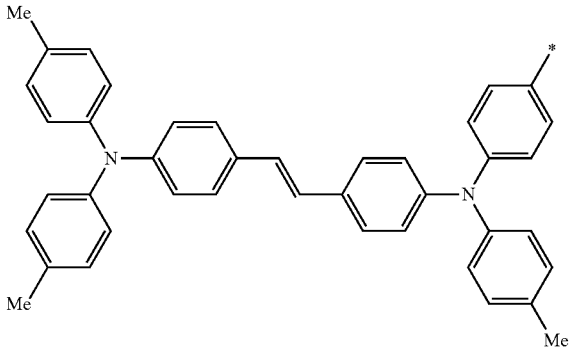
(M1)-21
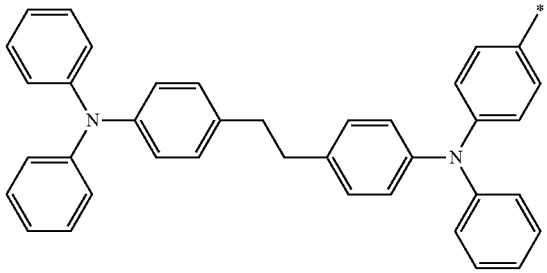
(M1)-22
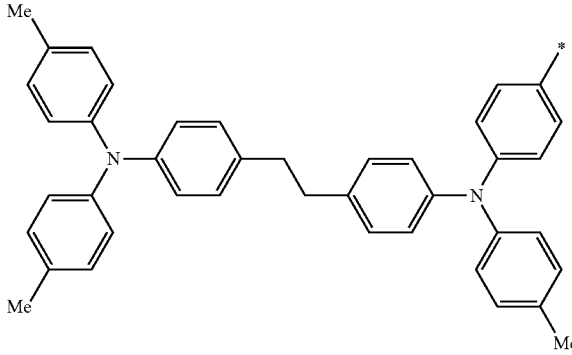
-continued
(M2)-1
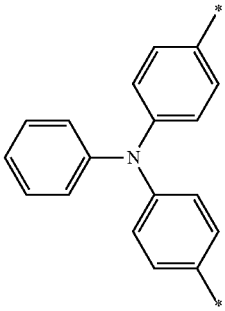
(M2)-2
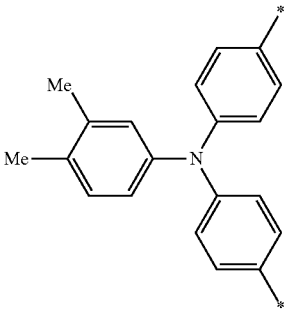
(M2)-3
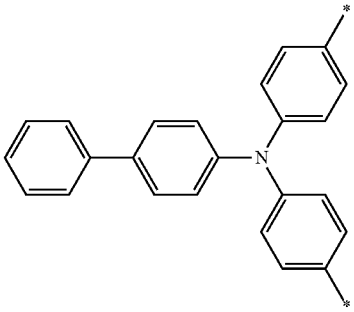
(M2)-4
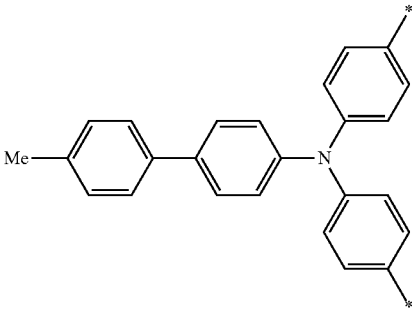
(M2)-5
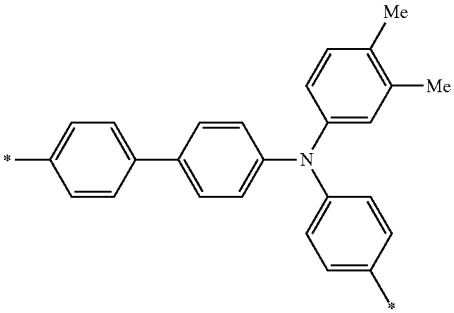

-continued
(M2)-6
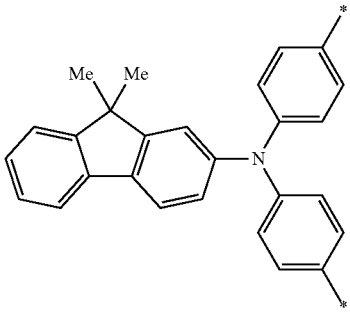
(M2)-7
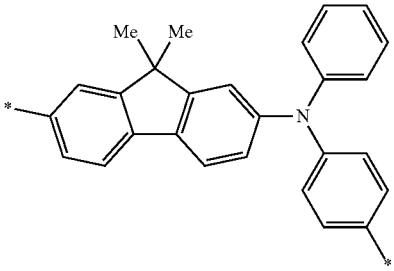
(M2)-8
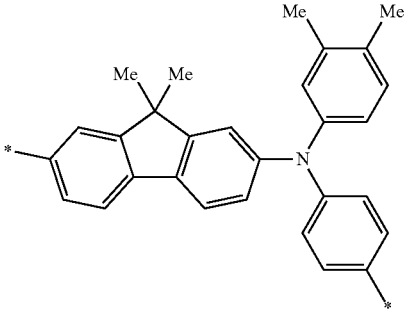
(M2)-9
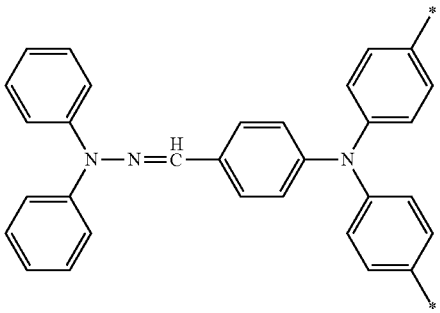
(M2)-10
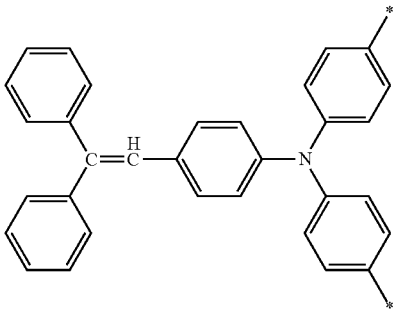
-continued
(M2)-11
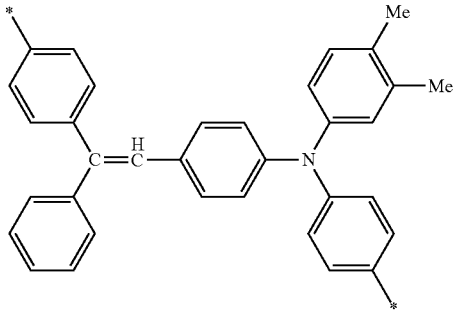
(M2)-12
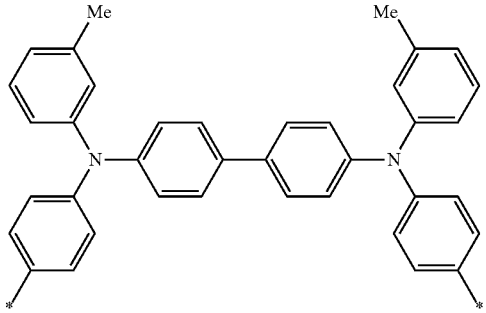
(M2)-13
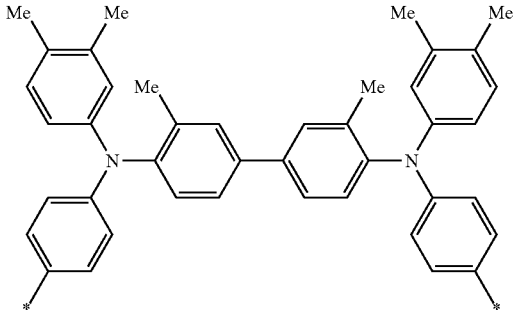
(M2)-14
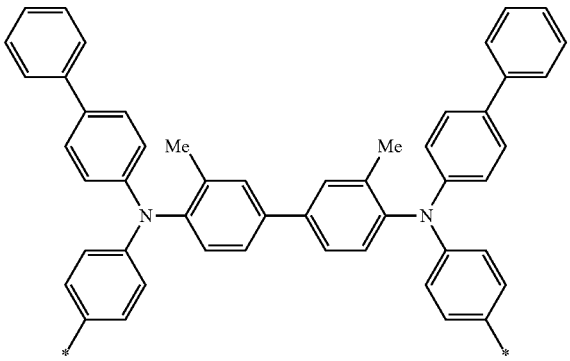

-continued
(M2)-15
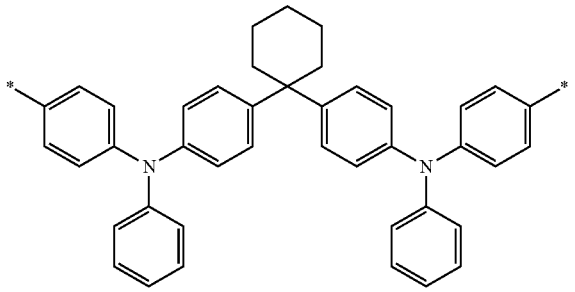
(M2)-16
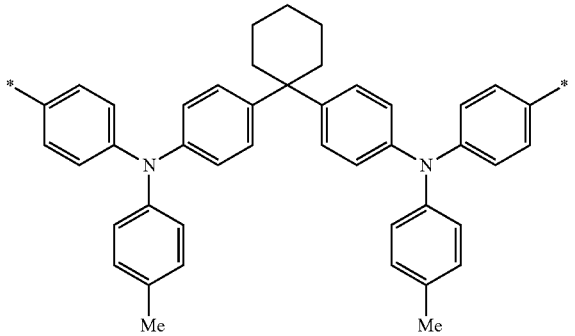
(M2)-17
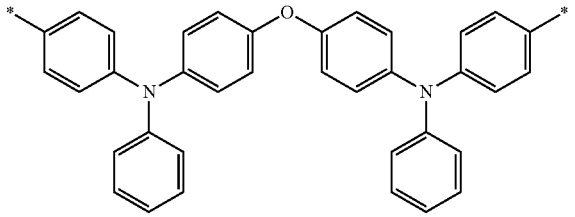
(M2)-18
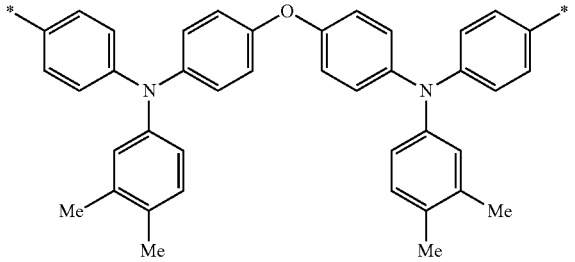
(M2)-19
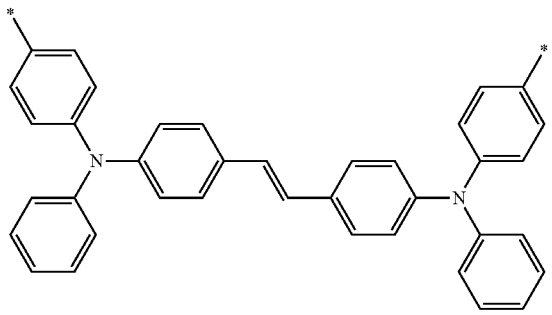
-continued
(M2)-20
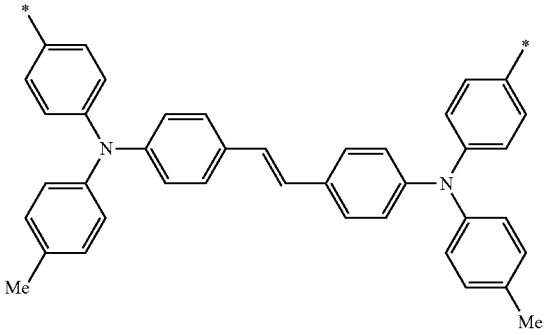
(M2)-21
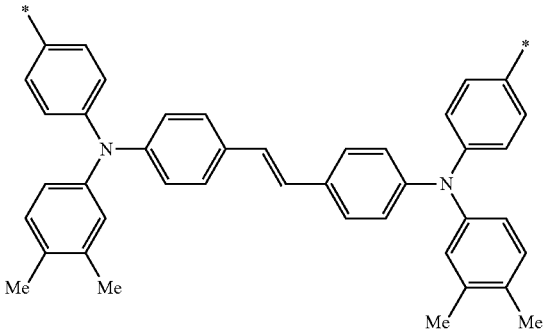
(M2)-22
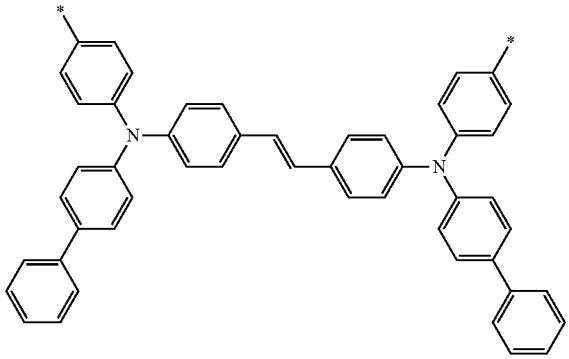
(M2)-23
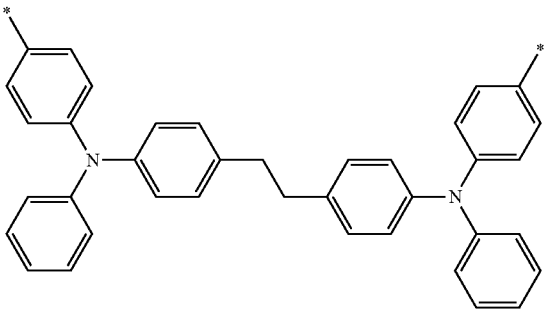

-continued
(M2)-24
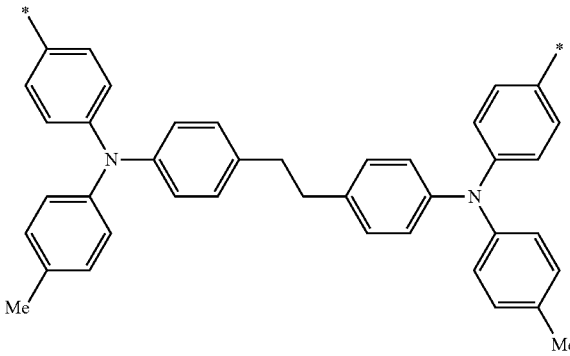
(M2)-25
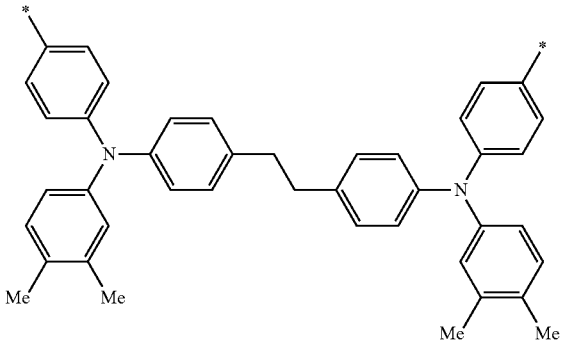
(M2)-26
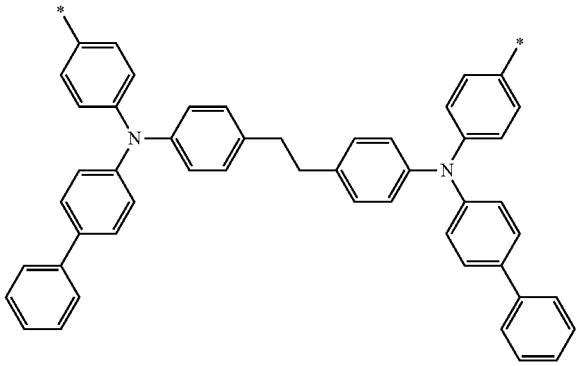
(M2)-27
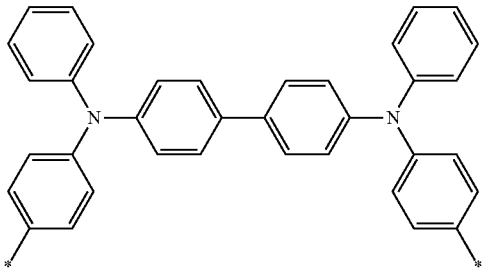
-continued
(M2)-28
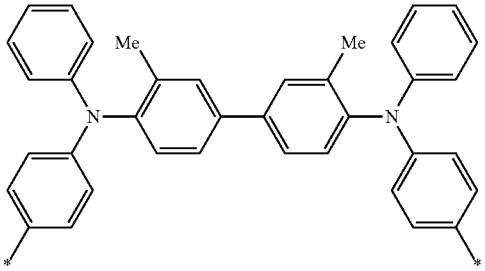
(M3)-1
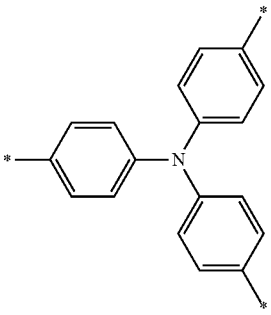
(M3)-2
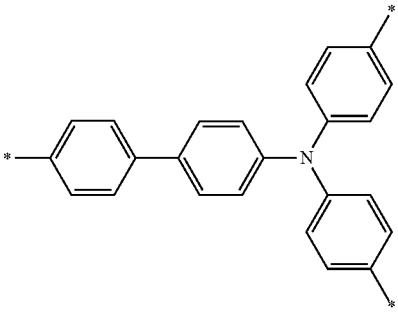
(M3)-3
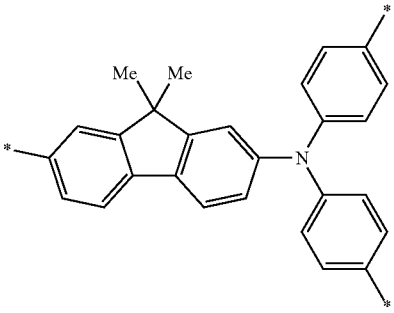
(M3)-4
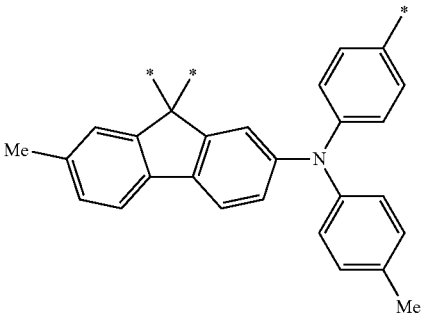

-continued
(M3)-5
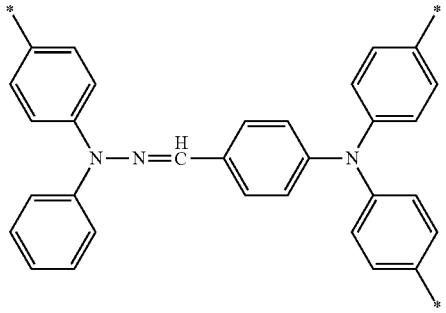
(M3)-6
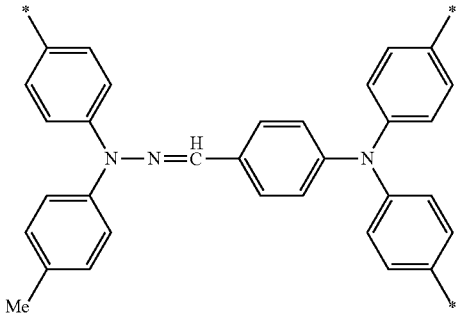
(M3)-7
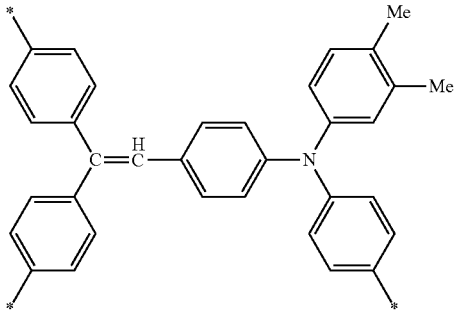
(M3)-8
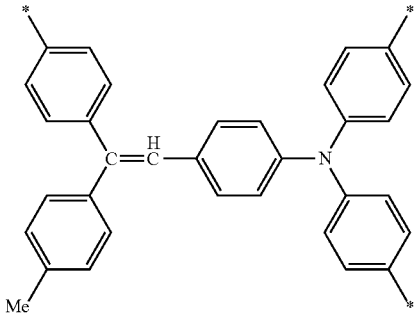
-continued
(M3)-9
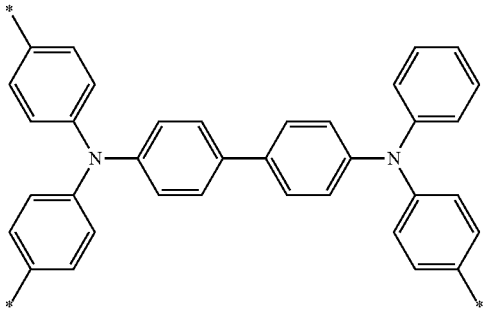
(M3)-10
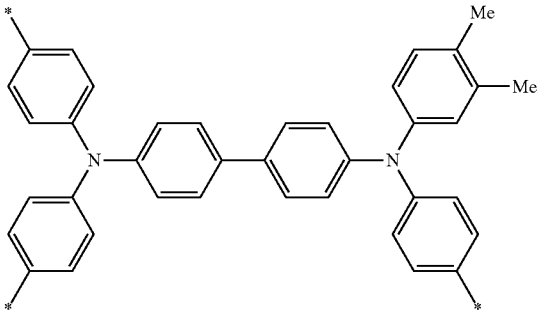
(M3)-11
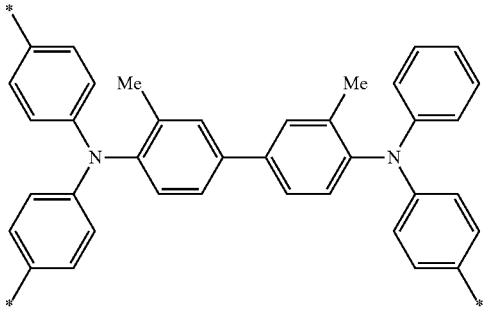
(M3)-12
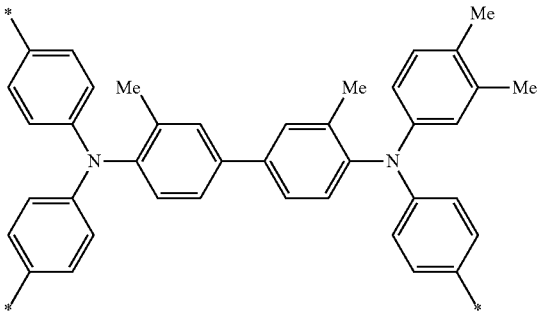

-continued
(M3)-13
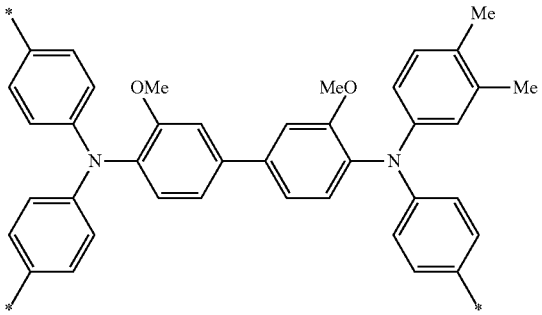
(M3)-14
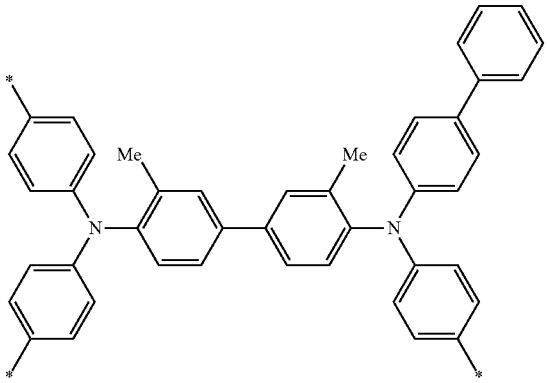
(M3)-15
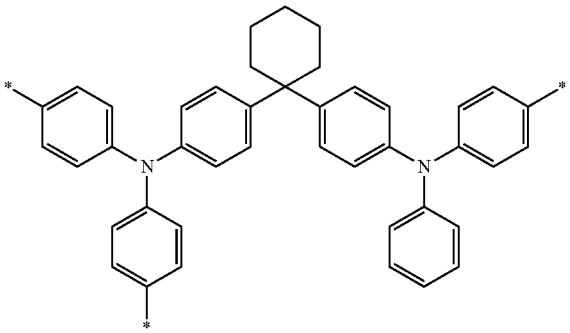
(M3)-16
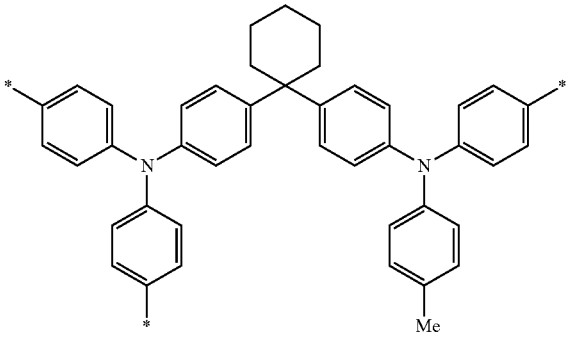
-continued
(M3)-17
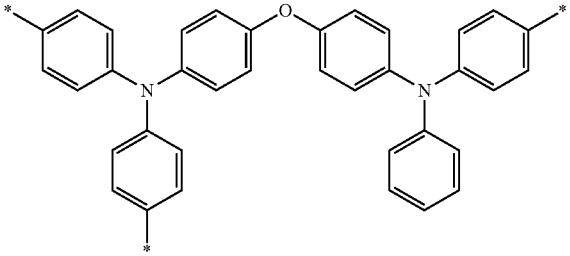
(M3)-18
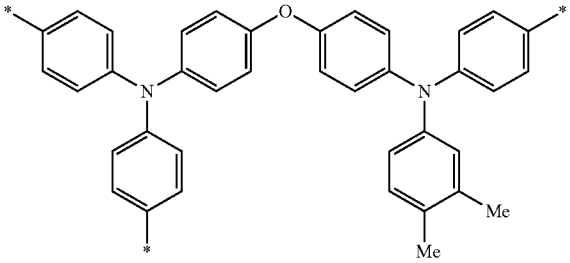
(M3)-19
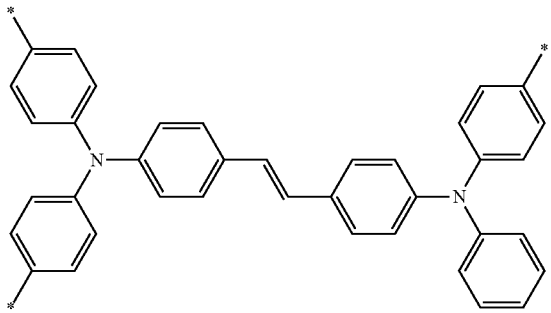
(M3)-20
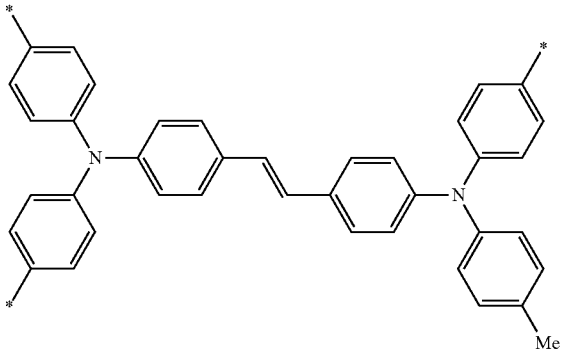

-continued
(M3)-21
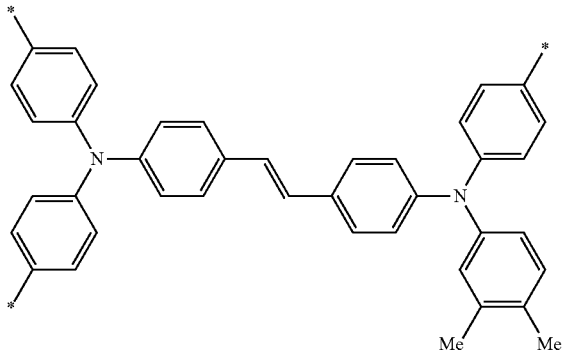
(M3)-22
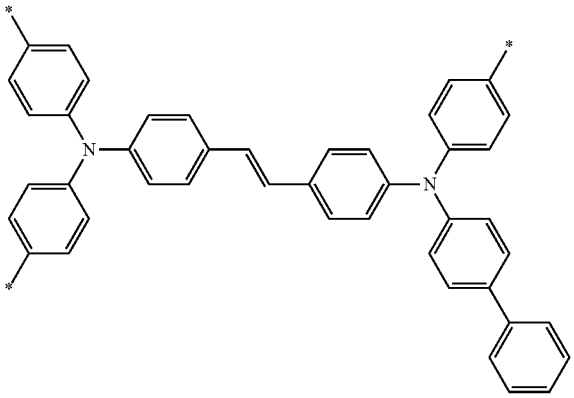
(M3)-23
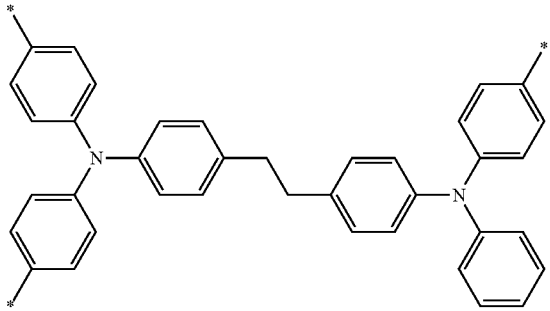
(M3)-24
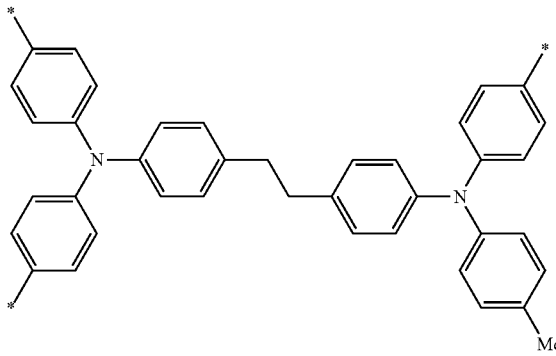
-continued
(M3)-25
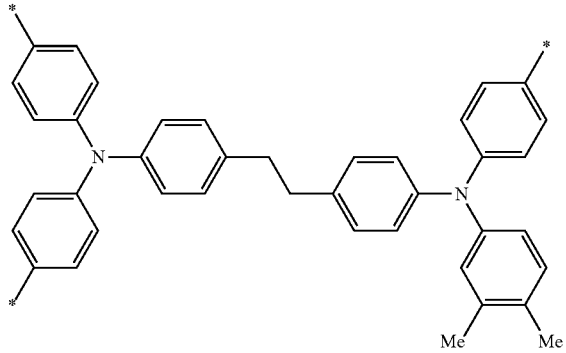
(M3)-26
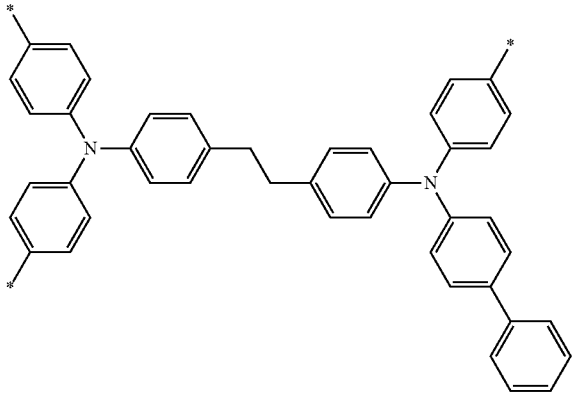
(M4)-1
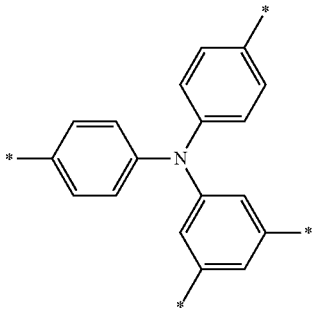
(M4)-2
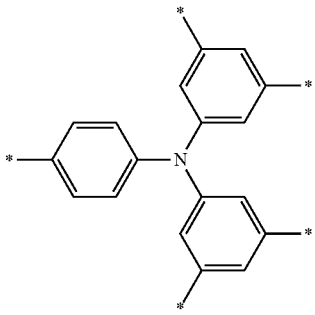

-continued
(M4)-3
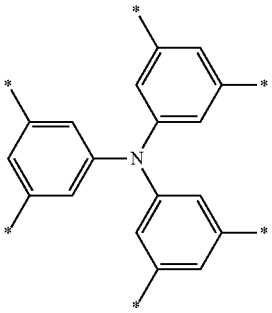
(M4)-4
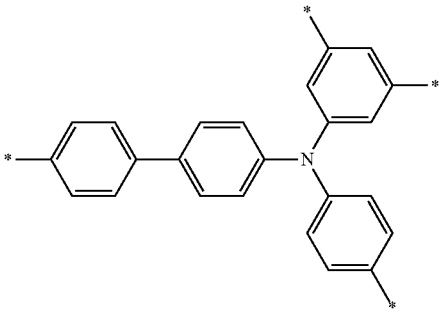
(M4)-5
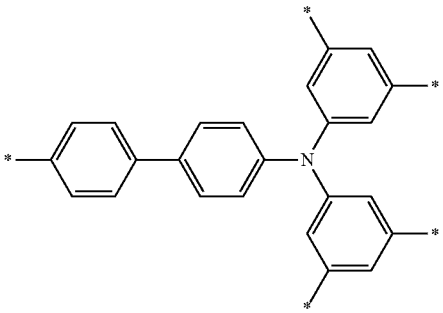
(M4)-6
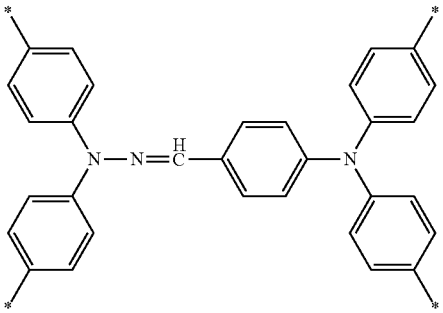
(M4)-7
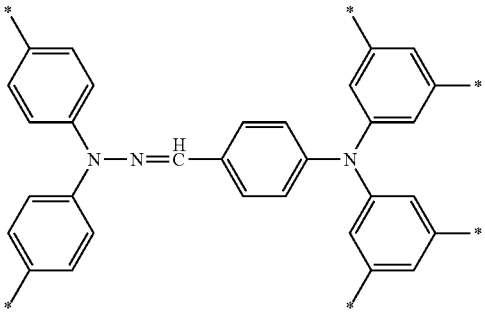
-continued
(M4)-8
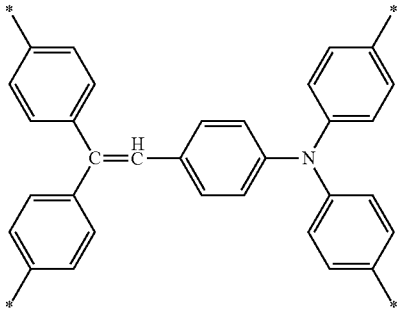
(M4)-9
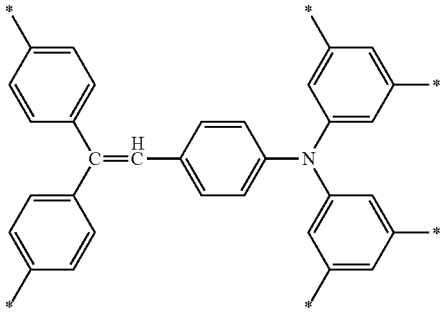
(M4)-10
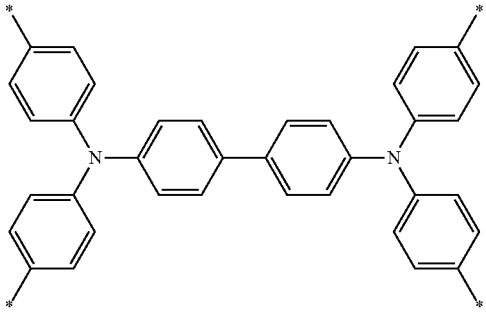
(M4)-11
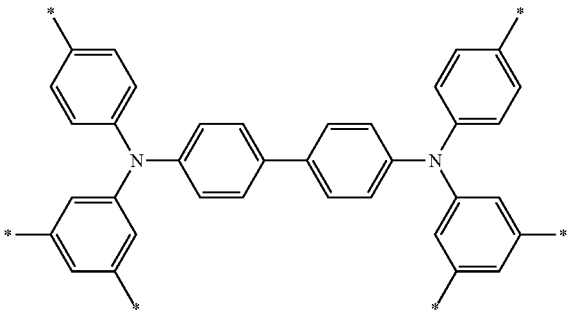

-continued
(M4)-12
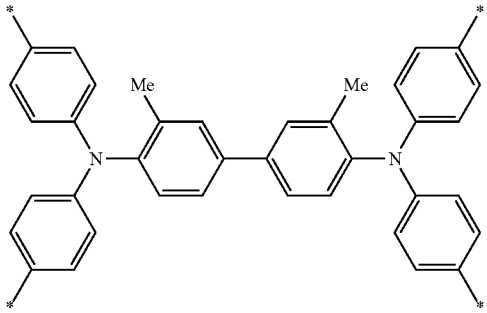
(M4)-13
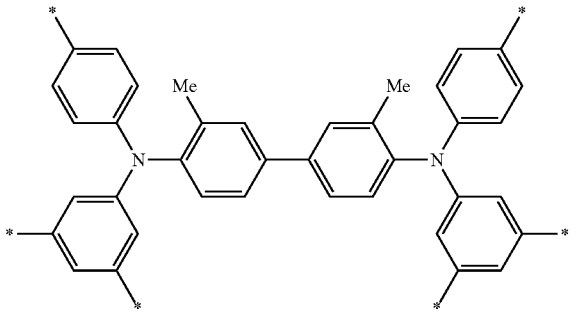
(M4)-14
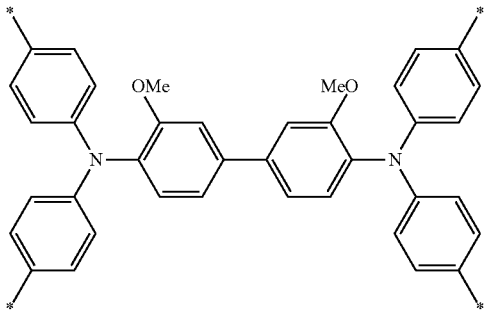
(M4)-15
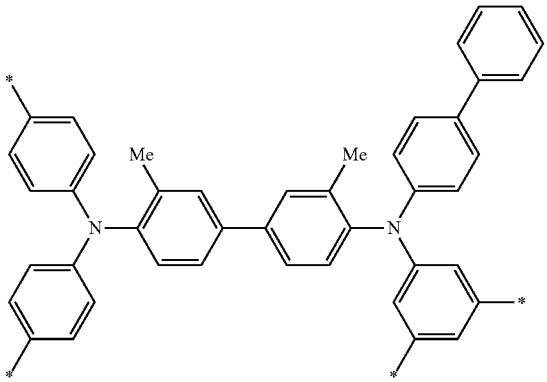
-continued
(M4)-16
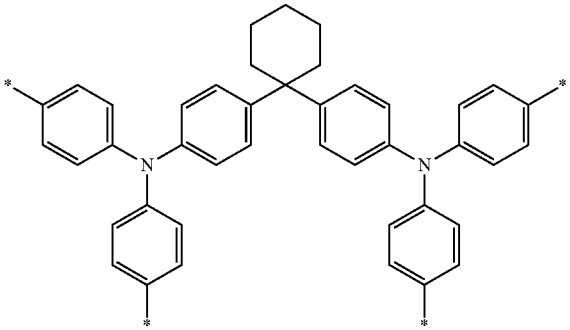
(M4)-17
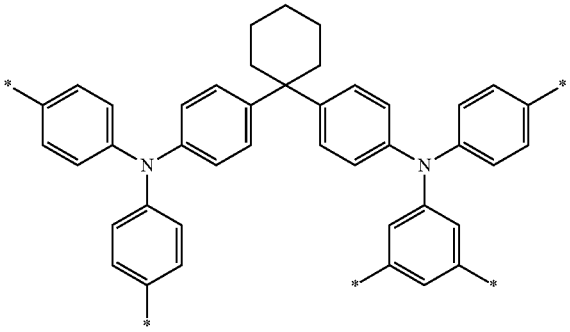
(M4)-18
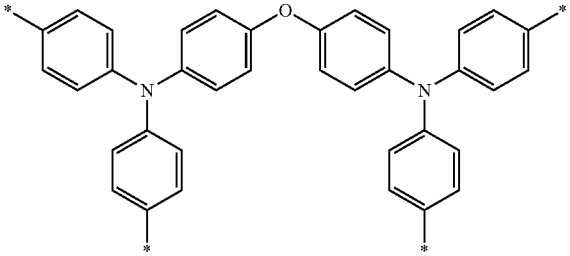
(M4)-19
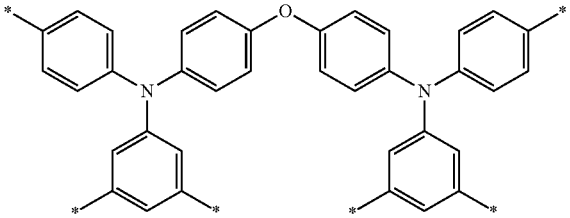
(M4)-20
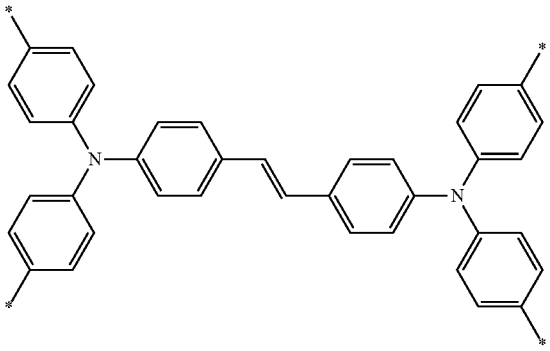

-continued
(M4)-21
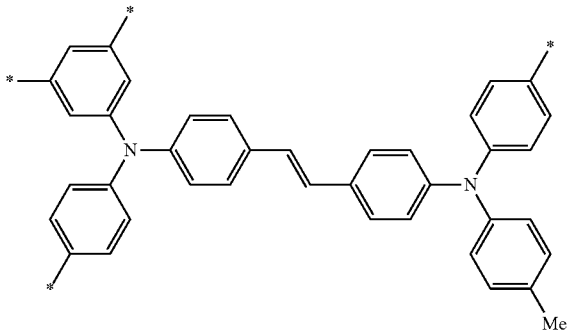
(M4)-22
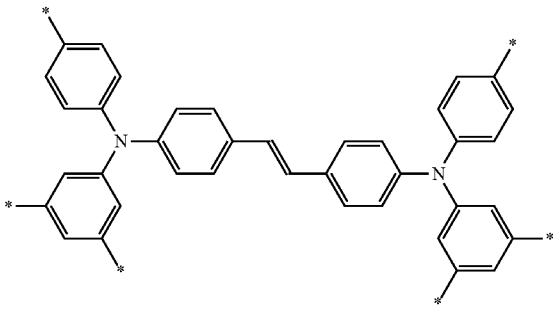
(M4)-23
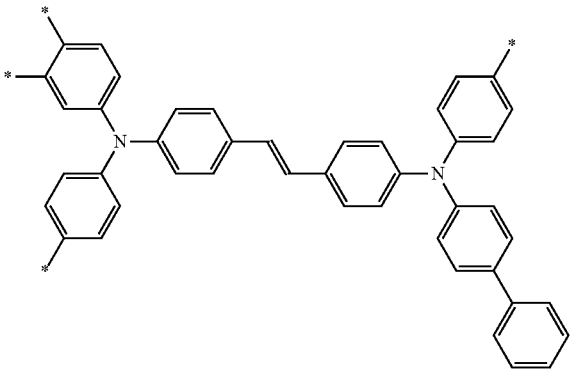
(M4)-24
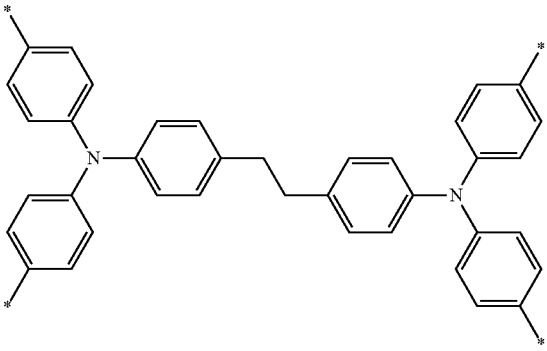
-continued
(M4)-25
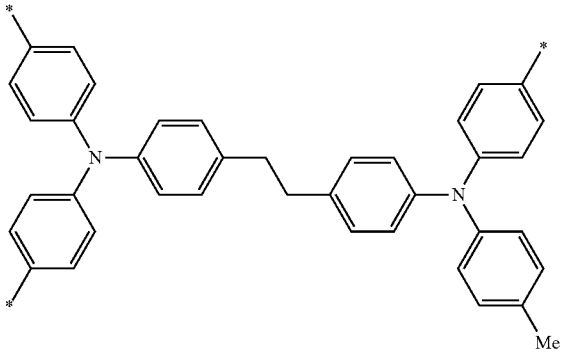
(M4)-26
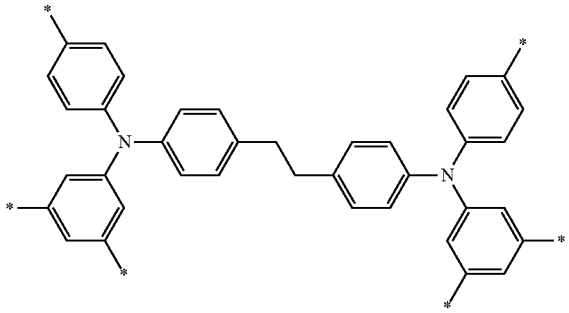
(M4)-27
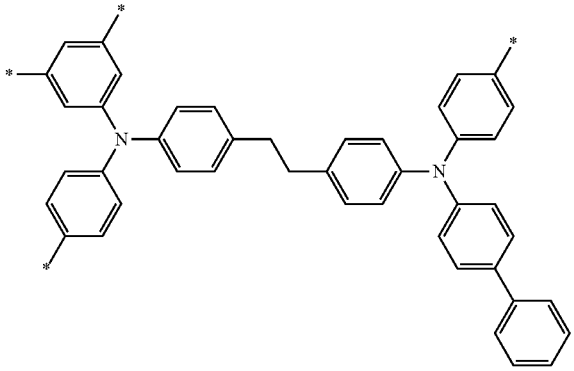
(M4)-28
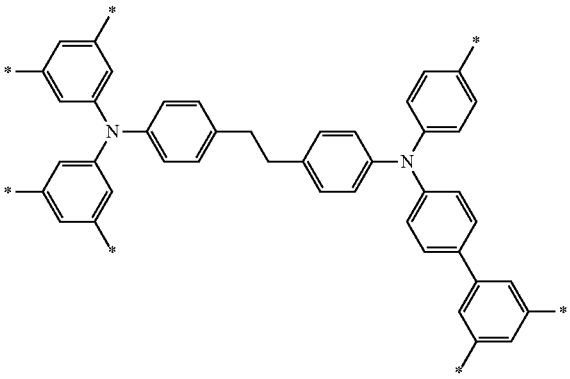
Next, specific examples of the functional group linked to the charge transport skeleton F are shown below.

(R1)-1
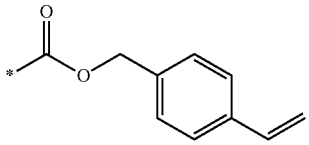
(R1)-2
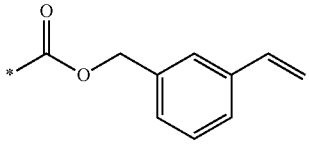
(R1)-3
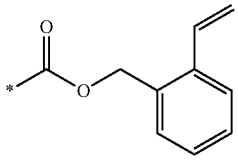
(R1)-4
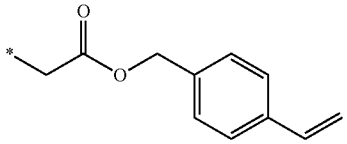
(R1)-5
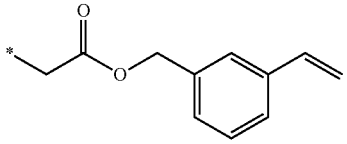
(R1)-6
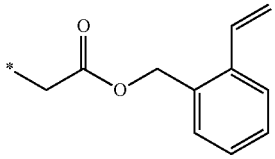
(R1)-7
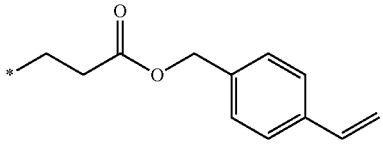
(R1)-8
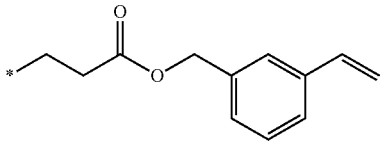
(R1)-9
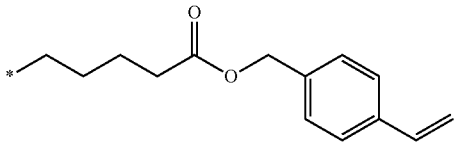
(R1)-10
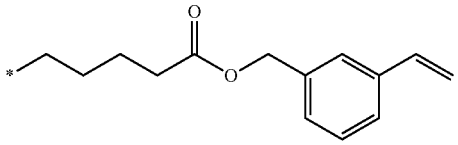
-continued
(R1)-11
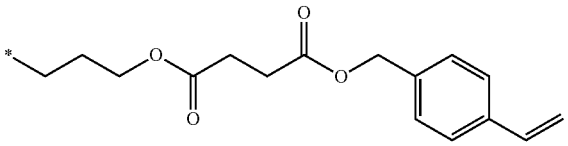
(R1)-12
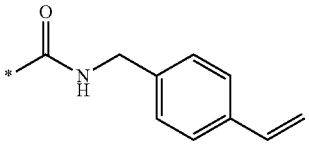
(R1)-13
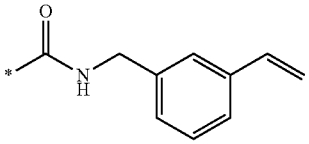
(R1)-14
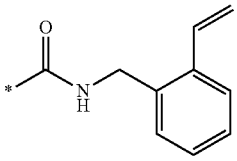
(R1)-15
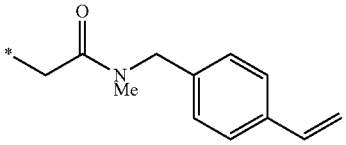
(R1)-16
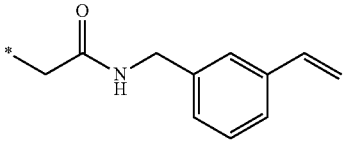
(R1)-17
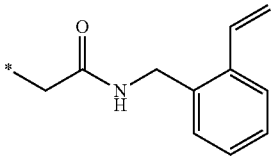
(R1)-18
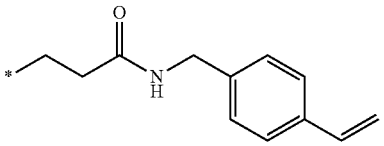
(R1)-19
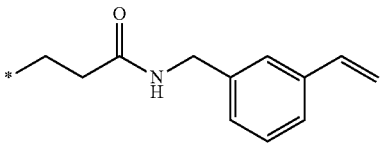
(R1)-20
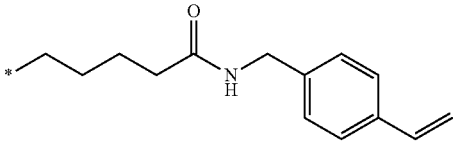

-continued
(R1)-21
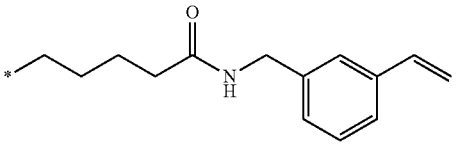
(R1)-22
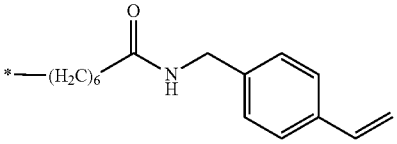
(R1)-23
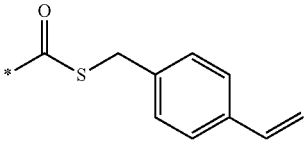
(R1)-24
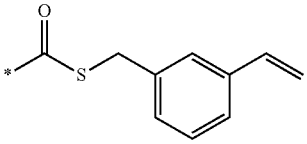
(R1)-25
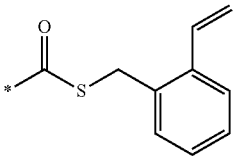
(R1)-26
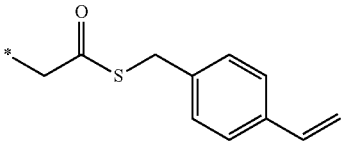
(R1)-27
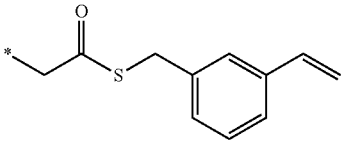
(R1)-28
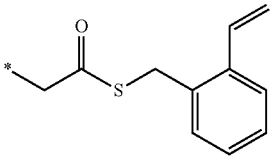
(R1)-29
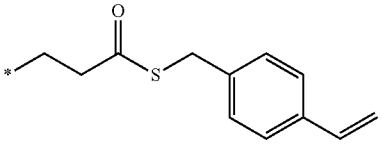
(R1)-30
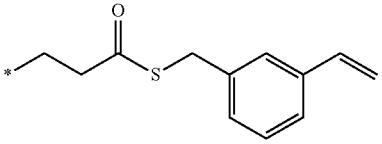
-continued
(R1)-31
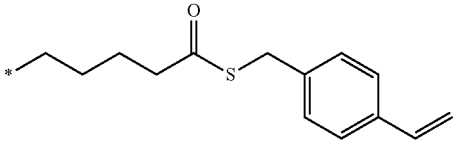
(R1)-32
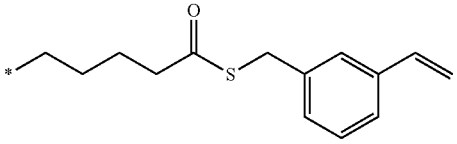
(R1)-33
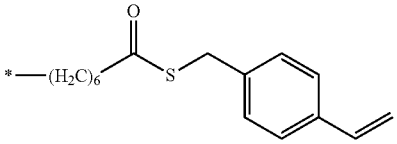
(R1)-34
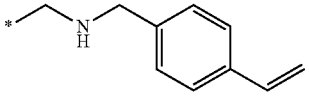
(R1)-35
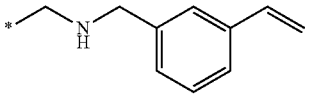
(R1)-36
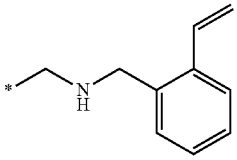
(R1)-37
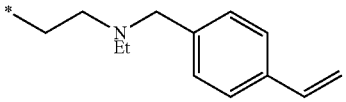
(R1)-38
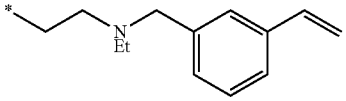
(R1)-39
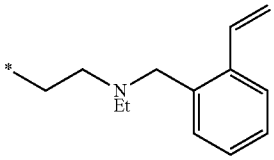
(R1)-40
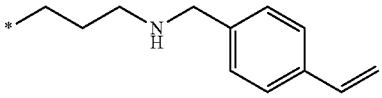
(R1)-41
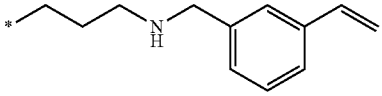
(R1)-42
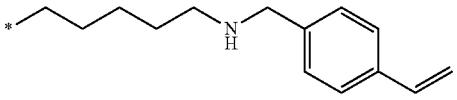

-continued
(R1)-43
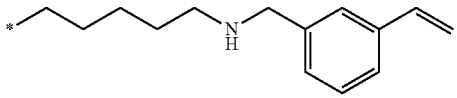
(R1)-44
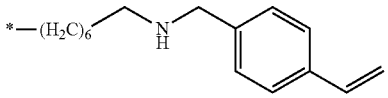
(R1)-45
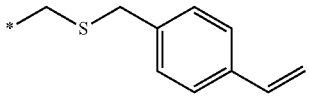
(R1)-46
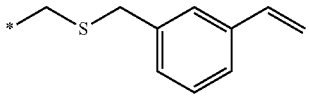
(R1)-47
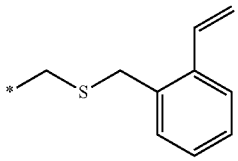
(R1)-48
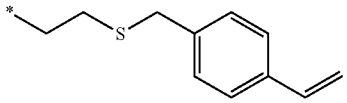
(R1)-49
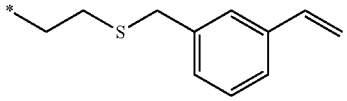
(R1)-50
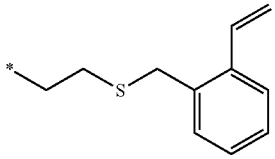
(R1)-51
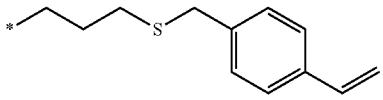
(R1)-52
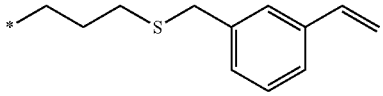
(R1)-53
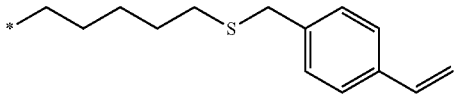
(R1)-54
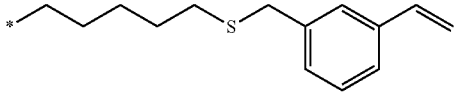
(R1)-55
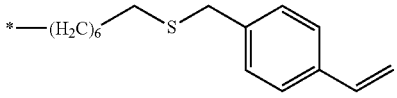
-continued
(R2)-1
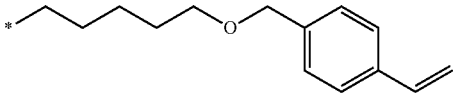
(R2)-2
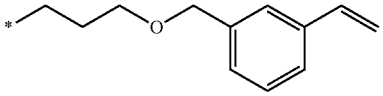
(R2)-3
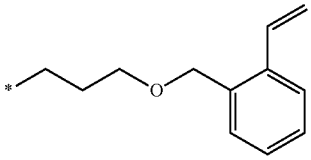
(R2)-4
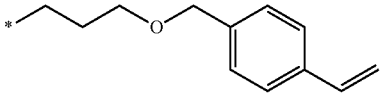
(R2)-5
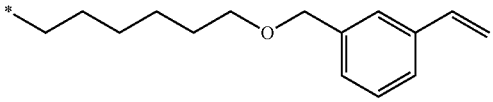
(R2)-6
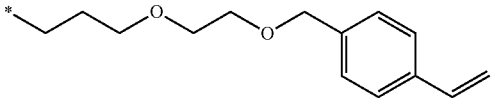
(R2)-7
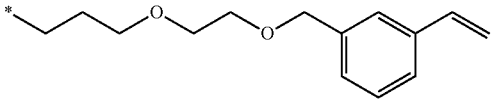
(R2)-8
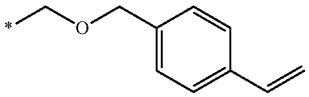
(R2)-9
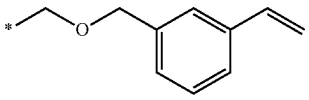
(R2)-10
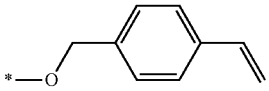
(R2)-11
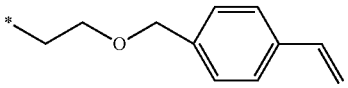
(R3)-1
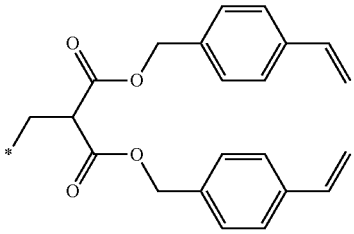

-continued
(R3)-2
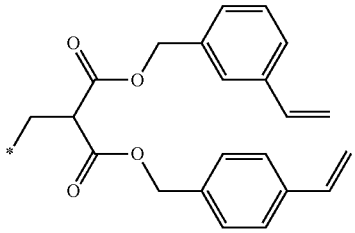
(R3)-3
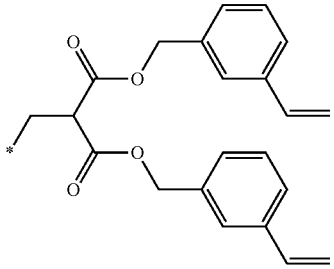
(R3)-4
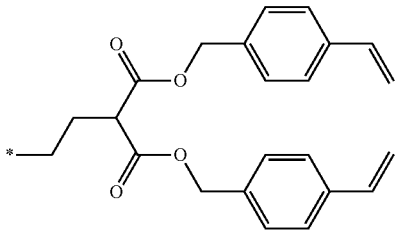
(R3)-5
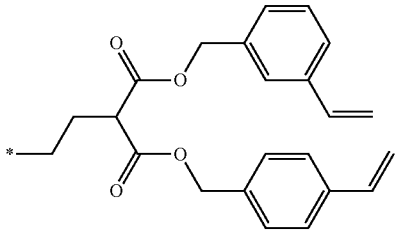
(R3)-6
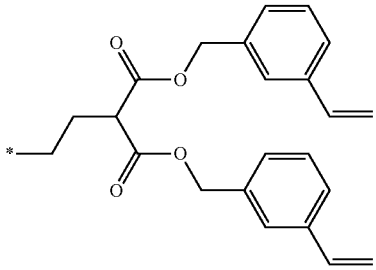
(R3)-7
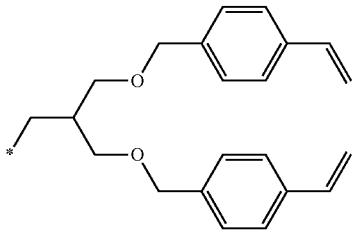
-continued
(R3)-8
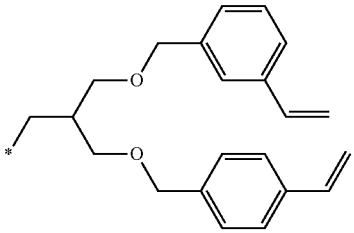
(R3)-9
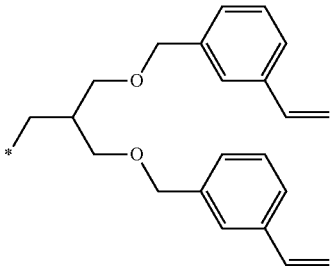
(R3)-10
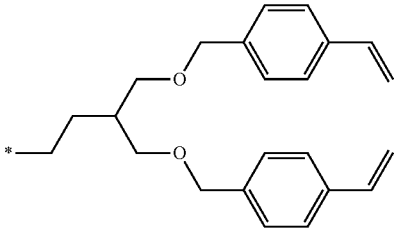
(R3)-11
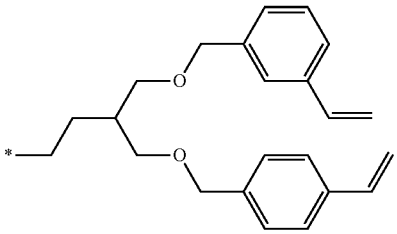
(R3)-12
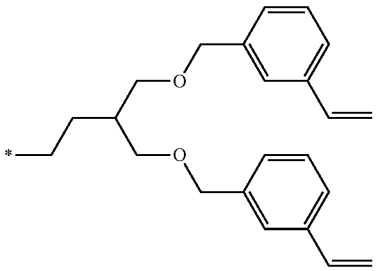
(R3)-13
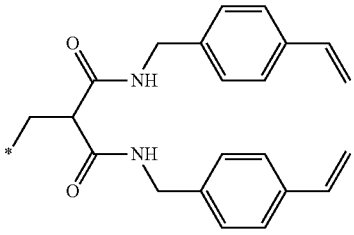

-continued
(R3)-14
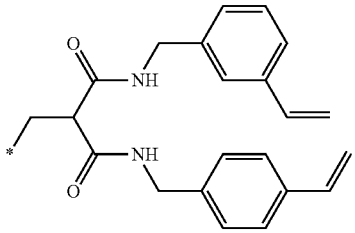
(R3)-15
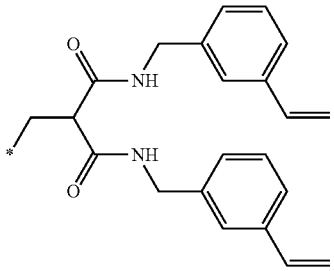
(R3)-16
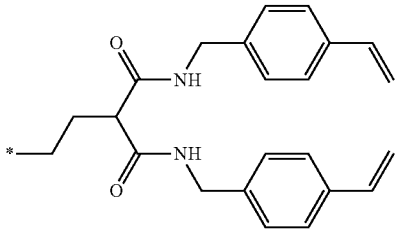
(R3)-17
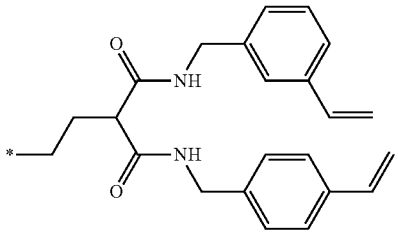
(R3)-18
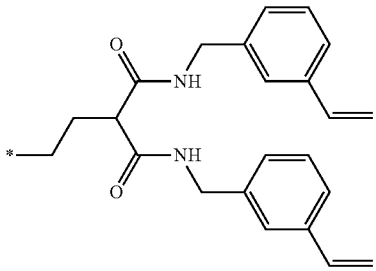
(R3)-19
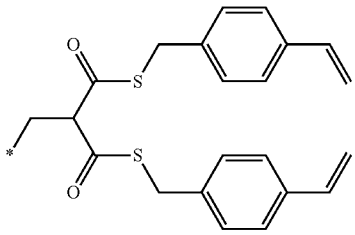
-continued
(R3)-20
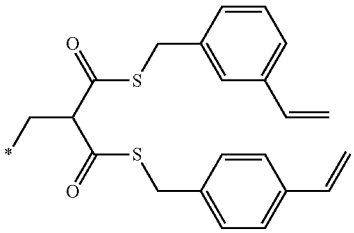
(R3)-21
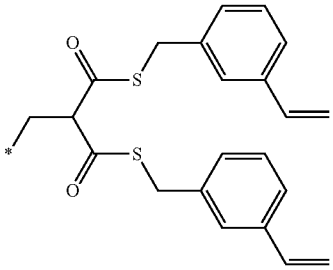
(R3)-22
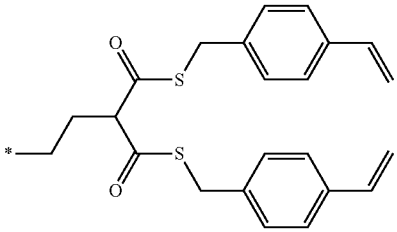
(R3)-23
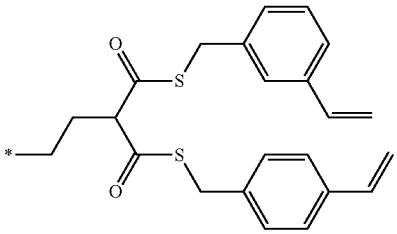
(R3)-24
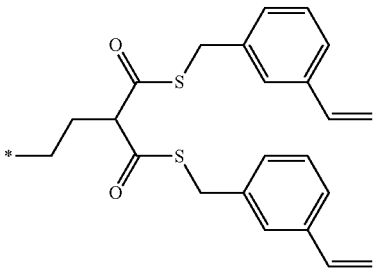
(R3)-25
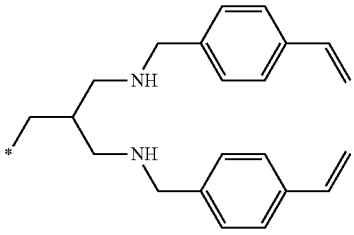

-continued
(R3)-26
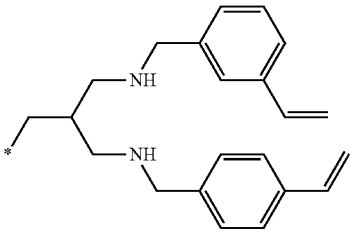
(R3)-27
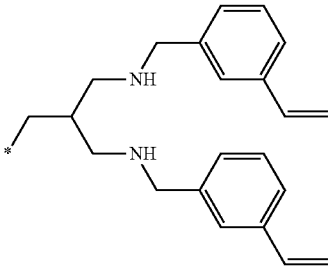
(R3)-28
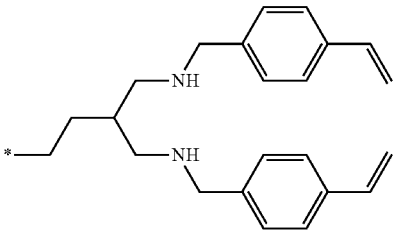
(R3)-29
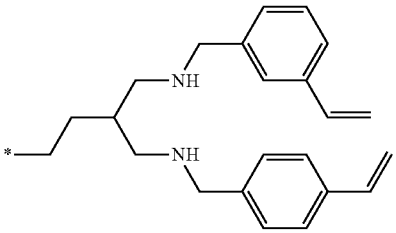
(R3)-30
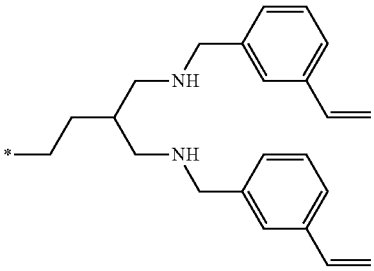
(R3)-31
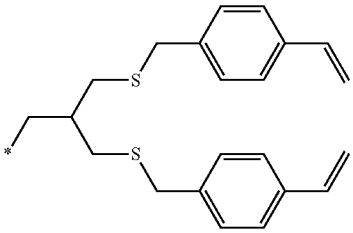
-continued
(R3)-32
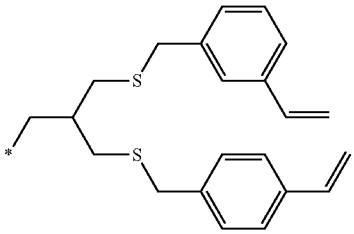
(R3)-33
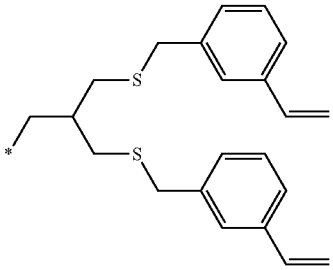
(R3)-34
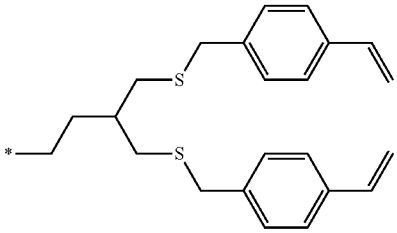
(R3)-35
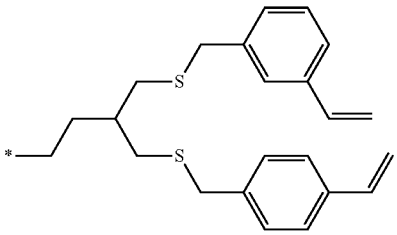
(R3)-36
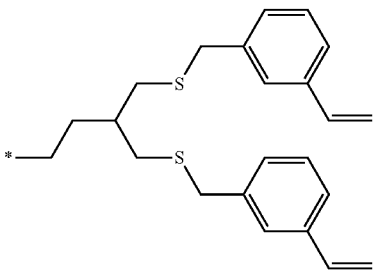
(R3)-37
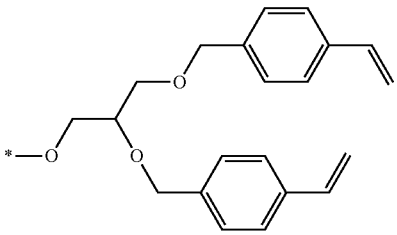

-continued
(R3)-38
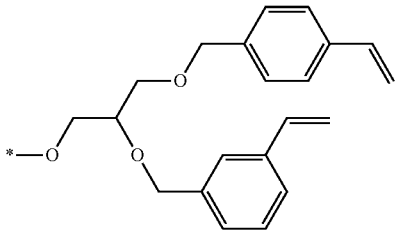
(R3)-39
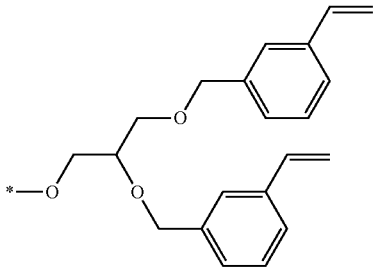
(R3)-40
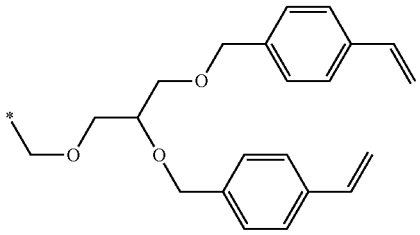
(R3)-41
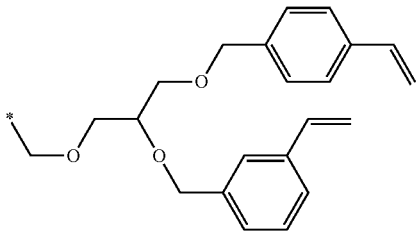
(R3)-42
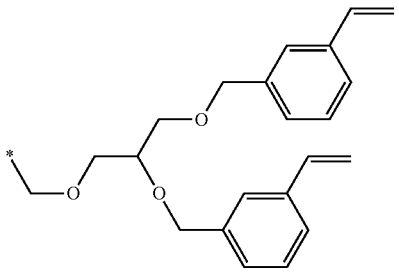
(R3)-43
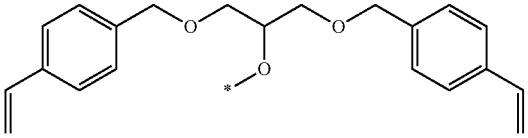
(R3)-44
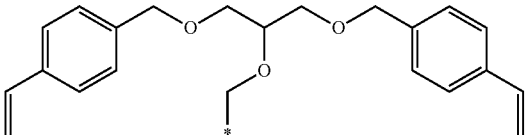
-continued
(R3)-45
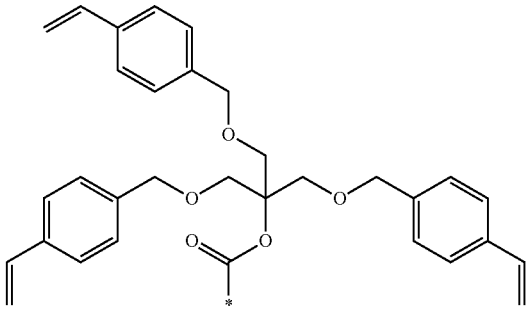
(R3)-46
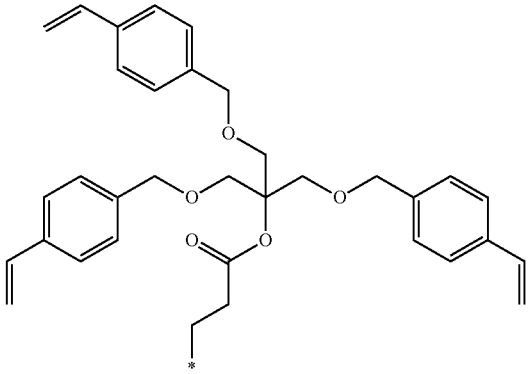
(R3)-47
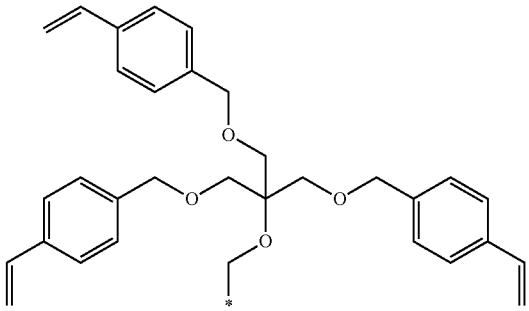
(R3)-48
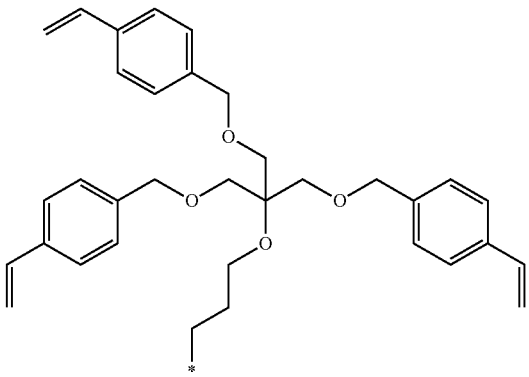

-continued (R4)-1

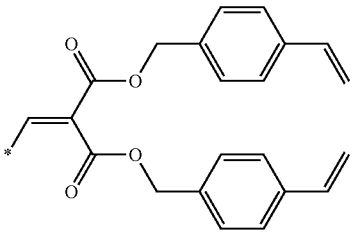

(R4)-2

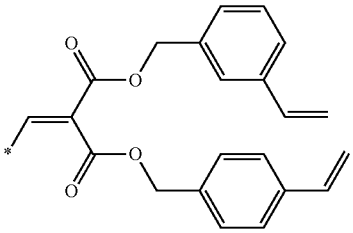

(R4)-3

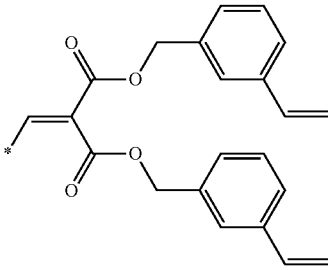

(R4)-4

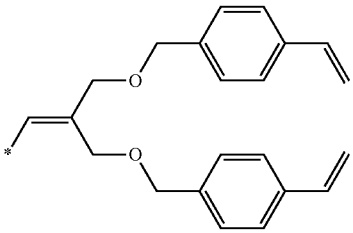

(R4)-5

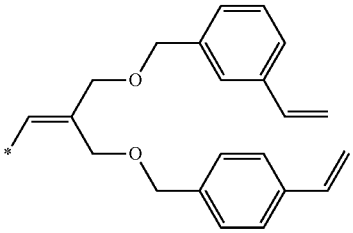

(R4)-6

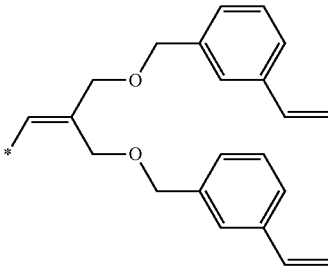

Next, specific examples of the compound represented by the formula (I), specifically the formula (I-a) are shown below.

Specific Examples of Formula (I) [Formula (I-a)]

| Exemplary compound | Charge transport skeleton F | Functional group |
|---|---|---|
| (I-a)-1 | (M1)-15 | (R2)-8 |
| (I-a)-2 | (M1)-15 | (R2)-9 |
| (I-a)-3 | (M1)-15 | (R2)-10 |
| (I-a)-4 | (M1)-16 | (R2)-8 |
| (I-a)-5 | (M1)-17 | (R2)-8 |
| (I-a)-6 | (M1)-17 | (R2)-9 |
| (I-a)-7 | (M1)-17 | (R2)-10 |
| (I-a)-8 | (M1)-18 | (R2)-8 |
| (I-a)-9 | (M1)-18 | (R2)-9 |
| (I-a)-10 | (M1)-18 | (R2)-10 |
| (I-a)-11 | (M1)-19 | (R2)-8 |
| (I-a)-12 | (M1)-21 | (R2)-8 |
| (I-a)-13 | (M1)-22 | (R2)-8 |
| (I-a)-14 | (M2)-15 | (R2)-8 |
| (I-a)-15 | (M2)-15 | (R2)-9 |
| (I-a)-16 | (M2)-15 | (R2)-10 |
| (I-a)-17 | (M2)-16 | (R2)-8 |
| (I-a)-18 | (M2)-17 | (R2)-8 |
| (I-a)-19 | (M2)-23 | (R2)-8 |
| (I-a)-20 | (M2)-23 | (R2)-9 |
| (I-a)-21 | (M2)-23 | (R2)-10 |
| (I-a)-22 | (M2)-24 | (R2)-8 |
| (I-a)-23 | (M2)-24 | (R2)-9 |
| (I-a)-24 | (M2)-24 | (R2)-10 |
| (I-a)-25 | (M2)-25 | (R2)-8 |
| (I-a)-26 | (M2)-25 | (R2)-9 |
| (I-a)-27 | (M2)-25 | (R2)-10 |
| (I-a)-28 | (M2)-26 | (R2)-8 |
| (I-a)-29 | (M2)-26 | (R2)-9 |
| (I-a)-30 | (M2)-26 | (R2)-10 |
| (I-a)-31 | (M2)-21 | (R2)-11 |

Next, specific examples of the compound represented by the formula (I), specifically the formula (I-b), are shown below.

Specific Examples of Formula (I) [Formula (I-b)]

| Exemplary compound | Charge transport skeleton F | Functional group |
|---|---|---|
| (I-b)-1 | (M1)-1 | (R2)-1 |
| (I-b)-2 | (M1)-1 | (R2)-2 |
| (I-b)-3 | (M1)-1 | (R2)-4 |
| (I-b)-4 | (M1)-2 | (R2)-5 |
| (I-b)-5 | (M1)-2 | (R2)-7 |
| (I-b)-6 | (M1)-4 | (R2)-3 |
| (I-b)-7 | (M1)-4 | (R2)-5 |
| (I-b)-8 | (M1)-5 | (R2)-6 |
| (I-b)-9 | (M1)-8 | (R2)-4 |
| (I-b)-10 | (M1)-16 | (R2)-5 |
| (I-b)-11 | (M1)-20 | (R2)-1 |
| (I-b)-12 | (M1)-22 | (R2)-1 |
| (I-b)-13 | (M2)-2 | (R2)-1 |
| (I-b)-14 | (M2)-2 | (R2)-3 |
| (I-b)-15 | (M2)-2 | (R2)-4 |
| (I-b)-16 | (M2)-6 | (R2)-4 |
| (I-b)-17 | (M2)-6 | (R2)-5 |
| (I-b)-18 | (M2)-6 | (R2)-6 |
| (I-b)-19 | (M2)-10 | (R2)-4 |
| (I-b)-20 | (M2)-10 | (R2)-5 |
| (I-b)-21 | (M2)-13 | (R2)-1 |
| (I-b)-22 | (M2)-13 | (R2)-3 |
| (I-b)-23 | (M2)-13 | (R2)-4 |
| (I-b)-24 | (M2)-13 | (R2)-5 |

-continued

| Exemplary compound | Charge transport skeleton F | Functional group |
|---|---|---|
| (I-b)-25 | (M2)-13 | (R2)-6 |
| (I-b)-26 | (M2)-16 | (R2)-4 |
| (I-b)-27 | (M2)-21 | (R2)-5 |
| (I-b)-28 | (M2)-25 | (R2)-4 |
| (I-b)-29 | (M2)-25 | (R2)-5 |
| (I-b)-30 | (M2)-25 | (R2)-7 |
| (I-b)-31 | (M2)-13 | (R2)-4 |

Next, specific examples of the compound represented by the formula (I), specifically the formula (I-c), are shown below.

Specific Examples of Formula (I) [Formula (I-c)]

| Exemplary compound | Charge transport skeleton F | Functional group |
|---|---|---|
| (I-c)-1 | (M1)-1 | (R1)-1 |
| (I-c)-2 | (M1)-1 | (R1)-2 |
| (I-c)-3 | (M1)-1 | (R1)-4 |
| (I-c)-4 | (M1)-2 | (R1)-5 |
| (I-c)-5 | (M1)-2 | (R1)-7 |
| (I-c)-6 | (M1)-4 | (R1)-3 |
| (I-c)-7 | (M1)-4 | (R1)-7 |
| (I-c)-8 | (M1)-7 | (R1)-6 |
| (I-c)-9 | (M1)-11 | (R1)-4 |
| (I-c)-10 | (M1)-15 | (R1)-5 |
| (I-c)-11 | (M1)-22 | (R1)-5 |
| (I-c)-12 | (M1)-22 | (R1)-1 |
| (I-c)-13 | (M2)-2 | (R1)-1 |
| (I-c)-14 | (M2)-2 | (R1)-3 |
| (I-c)-15 | (M2)-2 | (R1)-7 |
| (I-c)-16 | (M2)-3 | (R1)-4 |
| (I-c)-17 | (M2)-3 | (R1)-7 |
| (I-c)-18 | (M2)-5 | (R1)-6 |
| (I-c)-19 | (M2)-10 | (R1)-4 |
| (I-c)-20 | (M2)-10 | (R1)-5 |
| (I-c)-21 | (M2)-13 | (R1)-1 |
| (I-c)-22 | (M2)-13 | (R1)-3 |
| (I-c)-23 | (M2)-13 | (R1)-7 |
| (I-c)-24 | (M2)-16 | (R1)-5 |
| (I-c)-25 | (M2)-23 | (R1)-7 |
| (I-c)-26 | (M2)-23 | (R1)-4 |
| (I-c)-27 | (M2)-25 | (R1)-7 |
| (I-c)-28 | (M2)-25 | (R1)-4 |
| (I-c)-29 | (M2)-26 | (R1)-5 |
| (I-c)-30 | (M2)-26 | (R1)-7 |
| (I-c)-31 | (M3)-1 | (R1)-2 |
| (I-c)-32 | (M3)-1 | (R1)-7 |
| (I-c)-33 | (M3)-5 | (R1)-2 |
| (I-c)-34 | (M3)-7 | (R1)-4 |
| (I-c)-35 | (M3)-7 | (R1)-2 |
| (I-c)-36 | (M3)-19 | (R1)-4 |
| (I-c)-37 | (M3)-26 | (R1)-1 |
| (I-c)-38 | (M3)-26 | (R1)-3 |
| (I-c)-39 | (M4)-3 | (R1)-3 |
| (I-c)-40 | (M4)-3 | (R1)-4 |
| (I-c)-41 | (M4)-8 | (R1)-5 |
| (I-c)-42 | (M4)-8 | (R1)-6 |
| (I-c)-43 | (M4)-12 | (R1)-7 |
| (I-c)-44 | (M4)-12 | (R1)-4 |
| (I-c)-45 | (M4)-12 | (R1)-2 |
| (I-c)-46 | (M4)-12 | (R1)-11 |
| (I-c)-47 | (M4)-16 | (R1)-3 |
| (I-c)-48 | (M4)-16 | (R1)-4 |
| (I-c)-49 | (M4)-20 | (R1)-1 |
| (I-c)-50 | (M4)-20 | (R1)-4 |
| (I-c)-51 | (M4)-20 | (R1)-7 |
| (I-c)-52 | (M4)-24 | (R1)-4 |
| (I-c)-53 | (M4)-24 | (R1)-7 |
| (I-c)-54 | (M4)-24 | (R1)-3 |
| (I-c)-55 | (M4)-24 | (R1)-5 |

-continued

| Exemplary compound | Charge transport skeleton F | Functional group |
|---|---|---|
| (I-c)-56 | (M4)-25 | (R1)-1 |
| (I-c)-57 | (M4)-26 | (R1)-3 |
| (I-c)-58 | (M4)-28 | (R1)-4 |
| (I-c)-59 | (M4)-28 | (R1)-5 |
| (I-c)-60 | (M4)-28 | (R1)-6 |
| (I-c)-61 | (M1)-1 | (R1)-15 |
| (I-c)-62 | (M1)-1 | (R1)-27 |
| (I-c)-63 | (M1)-1 | (R1)-37 |
| (I-c)-64 | (M1)-2 | (R1)-52 |
| (I-c)-65 | (M1)-2 | (R1)-18 |
| (I-c)-66 | (M1)-4 | (R1)-31 |
| (I-c)-67 | (M1)-4 | (R1)-44 |
| (I-c)-68 | (M1)-7 | (R1)-45 |
| (I-c)-69 | (M1)-11 | (R1)-45 |
| (I-c)-70 | (M1)-15 | (R1)-45 |
| (I-c)-71 | (M1)-21 | (R1)-15 |
| (I-c)-72 | (M1)-22 | (R1)-15 |
| (I-c)-73 | (M2)-2 | (R1)-15 |
| (I-c)-74 | (M2)-2 | (R1)-27 |
| (I-c)-75 | (M2)-2 | (R1)-37 |
| (I-c)-76 | (M2)-3 | (R1)-52 |
| (I-c)-77 | (M2)-3 | (R1)-18 |
| (I-c)-78 | (M2)-5 | (R1)-31 |
| (I-c)-79 | (M2)-10 | (R1)-44 |
| (I-c)-80 | (M2)-10 | (R1)-45 |
| (I-c)-81 | (M2)-13 | (R1)-45 |
| (I-c)-82 | (M2)-13 | (R1)-46 |
| (I-c)-83 | (M2)-13 | (R1)-15 |
| (I-c)-84 | (M2)-16 | (R1)-15 |
| (I-c)-85 | (M2)-23 | (R1)-27 |
| (I-c)-86 | (M2)-23 | (R1)-37 |
| (I-c)-87 | (M2)-25 | (R1)-52 |
| (I-c)-88 | (M2)-25 | (R1)-18 |
| (I-c)-89 | (M2)-26 | (R1)-31 |
| (I-c)-90 | (M2)-26 | (R1)-44 |
| (I-c)-91 | (M3)-1 | (R1)-15 |
| (I-c)-92 | (M3)-1 | (R1)-27 |
| (I-c)-93 | (M3)-5 | (R1)-37 |
| (I-c)-94 | (M3)-7 | (R1)-52 |
| (I-c)-95 | (M3)-7 | (R1)-18 |
| (I-c)-96 | (M3)-19 | (R1)-31 |
| (I-c)-97 | (M3)-26 | (R1)-44 |
| (I-c)-98 | (M3)-26 | (R1)-45 |
| (I-c)-99 | (M4)-3 | (R1)-45 |
| (I-c)-100 | (M4)-3 | (R1)-46 |
| (I-c)-101 | (M4)-8 | (R1)-15 |
| (I-c)-102 | (M4)-8 | (R1)-16 |
| (I-c)-103 | (M4)-12 | (R1)-15 |
| (I-c)-104 | (M4)-12 | (R1)-27 |
| (I-c)-105 | (M4)-12 | (R1)-37 |
| (I-c)-106 | (M4)-12 | (R1)-52 |
| (I-c)-107 | (M4)-16 | (R1)-18 |
| (I-c)-108 | (M4)-16 | (R1)-31 |
| (I-c)-109 | (M4)-20 | (R1)-44 |
| (I-c)-110 | (M4)-20 | (R1)-45 |
| (I-c)-111 | (M4)-20 | (R1)-46 |
| (I-c)-112 | (M4)-24 | (R1)-45 |
| (I-c)-113 | (M4)-24 | (R1)-15 |
| (I-c)-114 | (M4)-24 | (R1)-16 |
| (I-c)-115 | (M4)-24 | (R1)-27 |
| (I-c)-116 | (M4)-25 | (R1)-37 |
| (I-c)-117 | (M4)-26 | (R1)-52 |
| (I-c)-118 | (M4)-28 | (R1)-18 |
| (I-c)-119 | (M4)-28 | (R1)-31 |
| (I-c)-120 | (M4)-28 | (R1)-44 |
| (I-c)-121 | (M2)-26 | (R1)-4 |

Next, specific examples of the compound represented by the formula (I), specifically the formula (I-d), are shown below.

Specific Examples of Formula (I) [Formula (I-d)]

| Exemplary compound | Charge transport skeleton F | Functional group |
|---|---|---|
| (I-d)-1 | (M3)-1 | (R2)-2 |
| (I-d)-2 | (M3)-1 | (R2)-7 |
| (I-d)-3 | (M3)-2 | (R2)-2 |
| (I-d)-4 | (M3)-2 | (R2)-4 |
| (I-d)-5 | (M3)-3 | (R2)-2 |
| (I-d)-6 | (M3)-3 | (R2)-4 |
| (I-d)-7 | (M3)-12 | (R2)-1 |
| (I-d)-8 | (M3)-21 | (R2)-3 |
| (I-d)-9 | (M3)-25 | (R2)-3 |
| (I-d)-10 | (M3)-25 | (R2)-4 |
| (I-d)-11 | (M3)-25 | (R2)-5 |
| (I-d)-12 | (M3)-25 | (R2)-6 |
| (I-d)-13 | (M4)-1 | (R2)-7 |
| (I-d)-14 | (M4)-3 | (R2)-4 |
| (I-d)-15 | (M4)-3 | (R2)-2 |
| (I-d)-16 | (M4)-8 | (R2)-1 |
| (I-d)-17 | (M4)-8 | (R2)-3 |
| (I-d)-18 | (M4)-8 | (R2)-4 |
| (I-d)-19 | (M4)-10 | (R2)-1 |
| (I-d)-20 | (M4)-10 | (R2)-4 |
| (I-d)-21 | (M4)-10 | (R2)-7 |
| (I-d)-22 | (M4)-12 | (R2)-4 |
| (I-d)-23 | (M4)-12 | (R2)-1 |
| (I-d)-24 | (M4)-12 | (R2)-3 |
| (I-d)-25 | (M4)-22 | (R2)-4 |
| (I-d)-26 | (M4)-24 | (R2)-1 |
| (I-d)-27 | (M4)-24 | (R2)-3 |
| (I-d)-28 | (M4)-24 | (R2)-4 |
| (I-d)-29 | (M4)-24 | (R2)-5 |
| (I-d)-30 | (M4)-28 | (R2)-6 |
| (I-d)-31 | (M3)-1 | (R2)-8 |
| (I-d)-32 | (M3)-1 | (R2)-9 |
| (I-d)-33 | (M3)-2 | (R2)-8 |
| (I-d)-34 | (M3)-2 | (R2)-9 |
| (I-d)-35 | (M3)-3 | (R2)-8 |
| (I-d)-36 | (M3)-3 | (R2)-9 |
| (I-d)-37 | (M3)-12 | (R2)-8 |
| (I-d)-38 | (M3)-12 | (R2)-9 |
| (I-d)-39 | (M4)-12 | (R2)-8 |
| (I-d)-40 | (M4)-12 | (R2)-9 |
| (I-d)-41 | (M4)-12 | (R2)-10 |
| (I-d)-42 | (M4)-24 | (R2)-8 |
| (I-d)-43 | (M4)-24 | (R2)-9 |
| (I-d)-44 | (M4)-24 | (R2)-10 |
| (I-d)-45 | (M4)-28 | (R2)-8 |
| (I-d)-46 | (M4)-28 | (R2)-9 |
| (I-d)-47 | (M4)-28 | (R2)-10 |

Next, specific examples of the compound represented by the formula (II), specifically the formula (II-a), are shown below.

Specific Examples of Formula (II) [Formula (II-a)]

| Exemplary compound | Charge transport skeleton F | Functional group |
|---|---|---|
| (II)-1 | (M1)-1 | (R3)-1 |
| (II)-2 | (M1)-1 | (R3)-2 |
| (II)-3 | (M1)-1 | (R3)-7 |
| (II)-4 | (M1)-2 | (R3)-1 |
| (II)-5 | (M1)-2 | (R3)-2 |
| (II)-6 | (M1)-2 | (R3)-3 |
| (II)-7 | (M1)-2 | (R3)-5 |
| (II)-8 | (M1)-2 | (R3)-7 |

-continued

| Exemplary compound | Charge transport skeleton F | Functional group |
|---|---|---|
| (II)-9 | (M1)-2 | (R3)-8 |
| (II)-10 | (M1)-2 | (R3)-10 |
| (II)-11 | (M1)-2 | (R3)-11 |
| (II)-12 | (M1)-4 | (R3)-1 |
| (II)-13 | (M1)-4 | (R3)-2 |
| (II)-14 | (M1)-4 | (R3)-3 |
| (II)-15 | (M1)-4 | (R3)-5 |
| (II)-16 | (M1)-4 | (R3)-7 |
| (II)-17 | (M1)-4 | (R3)-8 |
| (II)-18 | (M1)-8 | (R3)-1 |
| (II)-19 | (M1)-8 | (R3)-2 |
| (II)-20 | (M1)-8 | (R3)-3 |
| (II)-21 | (M1)-8 | (R3)-5 |
| (II)-22 | (M1)-8 | (R3)-7 |
| (II)-23 | (M1)-8 | (R3)-8 |
| (II)-24 | (M1)-11 | (R3)-1 |
| (II)-25 | (M1)-11 | (R3)-3 |
| (II)-26 | (M1)-11 | (R3)-7 |
| (II)-27 | (M1)-11 | (R3)-9 |
| (II)-28 | (M1)-16 | (R3)-4 |
| (II)-29 | (M1)-22 | (R3)-6 |
| (II)-30 | (M1)-22 | (R3)-9 |
| (II)-31 | (M2)-2 | (R3)-1 |
| (II)-32 | (M2)-2 | (R3)-3 |
| (II)-33 | (M2)-2 | (R3)-7 |
| (II)-34 | (M2)-2 | (B3)-9 |
| (II)-35 | (M2)-3 | (R3)-1 |
| (II)-36 | (M2)-3 | (R3)-2 |
| (II)-37 | (M2)-3 | (R3)-3 |
| (II)-38 | (M2)-3 | (R3)-7 |
| (II)-39 | (M2)-3 | (R3)-8 |
| (II)-40 | (M2)-5 | (R3)-8 |
| (II)-41 | (M2)-5 | (R3)-10 |
| (II)-42 | (M2)-10 | (R3)-1 |
| (II)-43 | (M2)-10 | (R3)-3 |
| (II)-44 | (M2)-10 | (R3)-7 |
| (II)-45 | (M2)-10 | (R3)-9 |
| (II)-46 | (M2)-13 | (R3)-1 |
| (II)-47 | (M2)-13 | (R3)-2 |
| (II)-48 | (M2)-13 | (R3)-3 |
| (II)-49 | (M2)-13 | (R3)-5 |
| (II)-50 | (M2)-13 | (R3)-7 |
| (II)-51 | (M2)-13 | (R3)-8 |
| (II)-52 | (M2)-16 | (R3)-1 |
| (II)-53 | (M2)-16 | (R3)-7 |
| (II)-54 | (M2)-21 | (R3)-1 |
| (II)-55 | (M2)-21 | (R3)-7 |
| (II)-56 | (M2)-25 | (R3)-1 |
| (II)-57 | (M2)-25 | (R3)-3 |
| (II)-58 | (M2)-25 | (R3)-7 |
| (II)-59 | (M2)-25 | (R3)-8 |
| (II)-60 | (M2)-25 | (R3)-9 |
| (II)-61 | (M3)-1 | (R3)-1 |
| (II)-62 | (M3)-1 | (R3)-2 |
| (II)-63 | (M3)-1 | (R3)-7 |
| (II)-64 | (M3)-1 | (R3)-8 |
| (II)-65 | (M3)-3 | (R3)-1 |
| (II)-66 | (M3)-3 | (R3)-7 |
| (II)-67 | (M3)-7 | (R3)-1 |
| (II)-68 | (M3)-7 | (R3)-2 |
| (II)-69 | (M3)-7 | (R3)-7 |
| (II)-70 | (M3)-7 | (R3)-8 |
| (II)-71 | (M3)-18 | (R3)-5 |
| (II)-72 | (M3)-18 | (R3)-12 |
| (II)-73 | (M3)-25 | (R3)-7 |
| (II)-74 | (M3)-25 | (R3)-8 |
| (II)-75 | (M3)-25 | (R3)-5 |
| (II)-76 | (M3)-25 | (R3)-12 |
| (II)-77 | (M4)-2 | (R3)-1 |
| (II)-78 | (M4)-2 | (R3)-7 |
| (II)-79 | (M4)-4 | (R3)-7 |
| (II)-80 | (M4)-4 | (R3)-8 |
| (II)-81 | (M4)-4 | (R3)-5 |
| (II)-82 | (M4)-4 | (R3)-12 |
| (II)-83 | (M4)-7 | (R3)-1 |
| (II)-84 | (M4)-7 | (R3)-2 |

-continued

| Exemplary compound | Charge transport skeleton F | Functional group |
|---|---|---|
| (II)-85 | (M4)-7 | (R3)-7 |
| (II)-86 | (M4)-7 | (R3)-8 |
| (II)-87 | (M4)-9 | (R3)-7 |
| (II)-88 | (M4)-9 | (R3)-8 |
| (II)-89 | (M4)-9 | (R3)-5 |
| (II)-90 | (M4)-9 | (R3)-12 |
| (II)-91 | (M1)-1 | (R3)-13 |
| (II)-92 | (M1)-1 | (R3)-15 |
| (II)-93 | (M1)-1 | (R3)-47 |
| (II)-94 | (M1)-2 | (R3)-13 |
| (II)-95 | (M1)-2 | (R3)-15 |
| (II)-96 | (M1)-2 | (R3)-19 |
| (II)-97 | (M1)-2 | (R3)-21 |
| (II)-98 | (M1)-2 | (R3)-28 |
| (II)-99 | (M1)-2 | (R3)-31 |
| (II)-100 | (M1)-2 | (R3)-33 |
| (II)-101 | (M1)-2 | (R3)-37 |
| (II)-102 | (M1)-2 | (R3)-38 |
| (II)-103 | (M1)-2 | (R3)-43 |
| (II)-104 | (M1)-4 | (R3)-13 |
| (II)-105 | (M1)-4 | (R3)-15 |
| (II)-106 | (M1)-4 | (R3)-43 |
| (II)-107 | (M1)-4 | (R3)-48 |
| (II)-108 | (M1)-8 | (R3)-13 |
| (II)-109 | (M1)-8 | (R3)-15 |
| (II)-110 | (M1)-8 | (R3)-19 |
| (II)-111 | (M1)-8 | (R3)-28 |
| (II)-112 | (M1)-8 | (R3)-31 |
| (II)-113 | (M1)-8 | (R2)-33 |
| (II)-114 | (M1)-11 | (R3)-31 |
| (II)-115 | (M1)-11 | (R3)-33 |
| (II)-116 | (M1)-11 | (R3)-34 |
| (II)-117 | (M1)-11 | (R3)-36 |
| (II)-118 | (M1)-16 | (R3)-13 |
| (II)-119 | (M1)-22 | (R3)-15 |
| (II)-120 | (M1)-22 | (R8)-47 |
| (II)-121 | (M2)-2 | (R3)-13 |
| (II)-122 | (M2)-2 | (R3)-15 |
| (II)-123 | (M2)-2 | (R3)-14 |
| (II)-124 | (M2)-2 | (R3)-17 |
| (II)-125 | (M2)-3 | (R3)-15 |
| (II)-126 | (M2)-3 | (R3)-19 |
| (II)-127 | (M2)-3 | (R3)-21 |
| (II)-128 | (M2)-3 | (R3)-28 |
| (II)-129 | (M2)-3 | (R3)-31 |
| (II)-130 | (M2)-5 | (R3)-33 |
| (II)-131 | (M2)-5 | (R3)-37 |
| (II)-132 | (M2)-10 | (R3)-38 |
| (II)-133 | (M2)-10 | (R3)-43 |
| (II)-134 | (M2)-10 | (R3)-13 |
| (II)-135 | (M2)-10 | (R3)-15 |
| (II)-136 | (M2)-13 | (R3)-16 |
| (II)-137 | (M2)-13 | (R3)-48 |
| (II)-138 | (M2)-13 | (R3)-13 |
| (II)-139 | (M2)-13 | (R3)-26 |
| (II)-140 | (M2)-13 | (R3)-19 |
| (II)-141 | (M2)-13 | (R3)-28 |
| (II)-142 | (M2)-16 | (R3)-31 |
| (II)-143 | (M2)-16 | (R3)-33 |
| (II)-144 | (M2)-21 | (R3)-33 |
| (II)-145 | (M2)-21 | (R3)-34 |
| (II)-146 | (M2)-25 | (R3)-35 |
| (II)-147 | (M2)-25 | (R3)-36 |

-continued

| Exemplary compound | Charge transport skeleton F | Functional group |
|---|---|---|
| (II)-148 | (M2)-25 | (R3)-37 |
| (II)-149 | (M2)-25 | (R3)-15 |
| (II)-150 | (M2)-25 | (R3)-47 |
| (II)-151 | (M3)-1 | (R3)-13 |
| (II)-152 | (M3)-1 | (R3)-15 |
| (II)-153 | (M3)-1 | (R3)-14 |
| (II)-154 | (M3)-1 | (R3)-17 |
| (II)-155 | (M3)-3 | (R3)-15 |
| (II)-156 | (M3)-3 | (R3)-19 |
| (II)-157 | (M3)-7 | (R3)-21 |
| (II)-158 | (M3)-7 | (R3)-28 |
| (II)-159 | (M3)-7 | (R3)-31 |
| (II)-160 | (M3)-7 | (R3)-33 |
| (II)-161 | (M3)-18 | (R3)-37 |
| (II)-162 | (M3)-18 | (R3)-38 |
| (II)-163 | (M3)-25 | (R3)-43 |
| (II)-164 | (M3)-25 | (R3)-13 |
| (II)-165 | (M3)-25 | (R3)-15 |
| (II)-166 | (M3)-25 | (R3)-16 |
| (II)-167 | (M4)-2 | (R3)-48 |
| (II)-168 | (M4)-2 | (R3)-13 |
| (II)-169 | (M4)-4 | (R3)-26 |
| (II)-170 | (M4)-4 | (R3)-19 |
| (II)-171 | (M4)-4 | (R3)-28 |
| (II)-172 | (M4)-4 | (R3)-31 |
| (II)-173 | (M4)-7 | (R3)-32 |
| (II)-174 | (M4)-7 | (R3)-33 |
| (II)-175 | (M4)-7 | (R3)-34 |
| (II)-176 | (M4)-7 | (R3)-35 |
| (II)-177 | (M4)-9 | (R3)-36 |
| (II)-178 | (M4)-9 | (R3)-37 |
| (II)-179 | (M4)-9 | (R3)-15 |
| (II)-180 | (M4)-9 | (R3)-47 |
| (II)-181 | (M1)-8 | (R4)-1 |
| (II)-182 | (M1)-8 | (R4)-2 |
| (II)-183 | (M2)-10 | (B4)-3 |
| (II)-184 | (M2)-10 | (R4)-4 |
| (II)-185 | (M3)-7 | (R4)-5 |
| (II)-186 | (M4)-9 | (R4)-6 |
| (II)-187 | (M2)-10 | (R4)-1 |

The specific reactive charge transport material (in particular, the reactive compound represented by the formula (I)) is synthesized in the following manner, for example.

That is, the specific reactive charge transport material is synthesized by, for example, etherification of a carboxylic acid as a precursor, or an alcohol with chloromethylstyrene or the like corresponding thereto.

An example of the synthesis route for the exemplary compound (I-d)-22 of the specific reactive charge transport material is shown below.

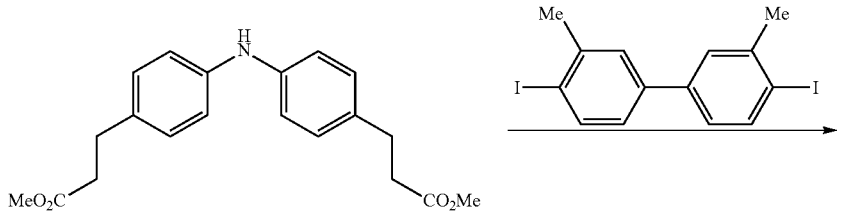

-continued

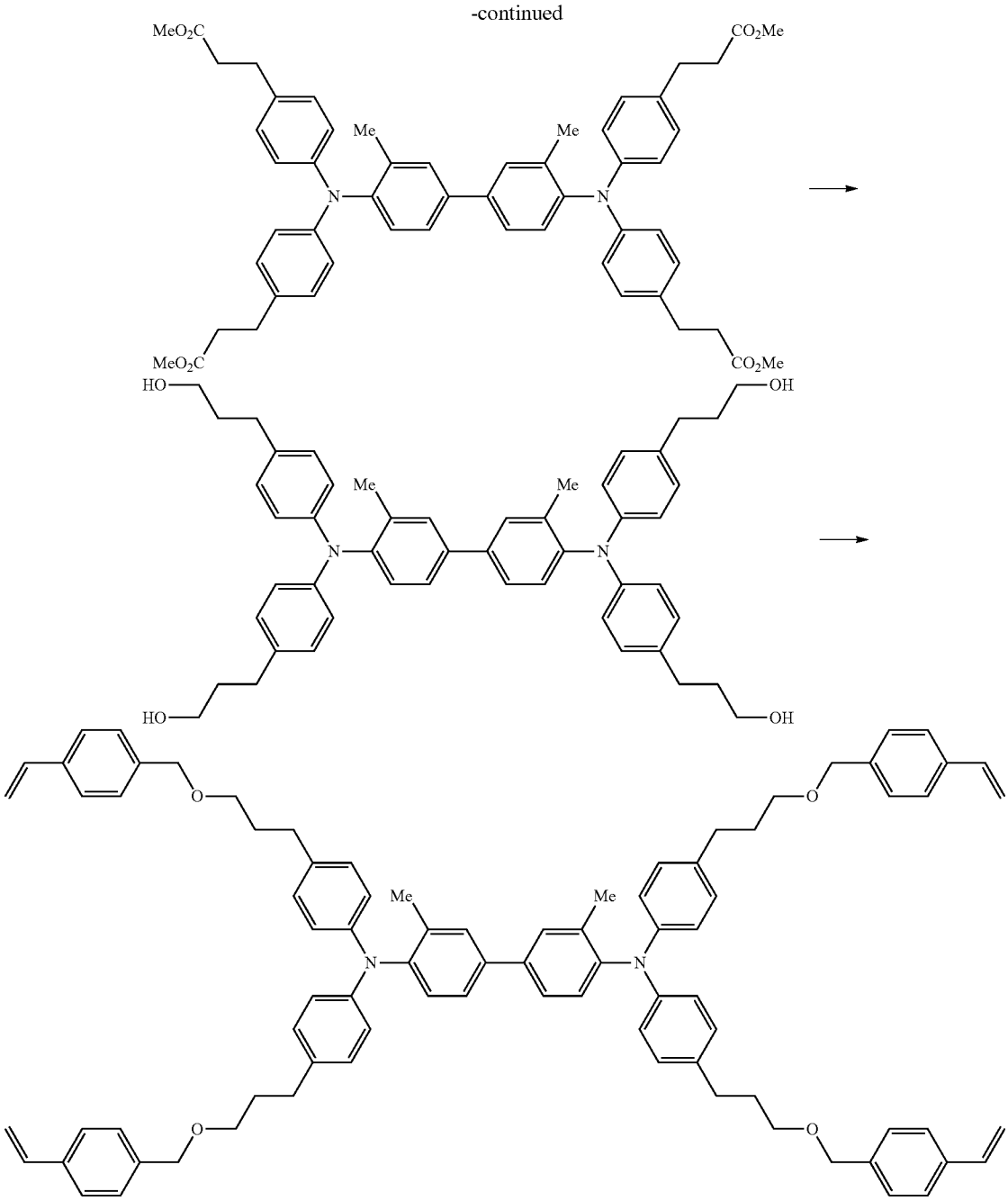

A carboxylic acid of the arylamine compound is obtained by subjecting an ester group of the arylamine compound to hydrolysis using, for example, a basic catalyst (NaOH, $K_2CO_3$, and the like) and an acidic catalyst (for example, phosphoric acid, sulfuric acid, and the like) as described in Experimental Chemistry Lecture, $4^{th}$ Ed., Vol. 20, p. 51, or the like.

Here, examples of the solvent include various types of the solvents, and an alcohol solvent such as methanol, ethanol, and ethylene glycol, or a mixture thereof with water may preferably be used.

Incidentally, in the case where the solubility of the arylamine compound is low, methylene chloride, chloroform, toluene, dimethylsulfoxide, ether, tetrahydrofuran, or the like may be added.

The amount of the solvent is not particularly limited, but it may be, for example, from 1 part by weight to 100 parts by weight, and preferably from 2 parts by weight to 50 parts by weight, with respect to 1 part by weight of the ester group-containing arylamine compound.

The reaction temperature is set to be, for example, in a range of room temperature (for example, 25° C.) to the boiling point of the solvent, and in terms of the reaction rate, preferably 50° C. or higher.

The amount of the catalyst is not particularly limited, and may be, for example, from 0.001 part by weight to 1 part by weight, and preferably from 0.01 part by weight to 0.5 part by weight, with respect to 1 part by weight of the ester group-containing arylamine compound.

After the hydrolysis reaction, in the case where the hydrolysis is carried out with a basic catalyst, the produced salt is neutralized with an acid (for example, hydrochloric acid) to be free. Further, after sufficiently washing with water, the product is dried and used, or may be, if necessary, purified by recrystallization with a suitable solvent such as methanol, ethanol, toluene, ethyl acetate, and acetone, and then dried and used.

The alcohol form of the arylamine compound is synthesized by reducing an ester group of the arylamine compound to a corresponding alcohol using aluminum lithium hydride, sodium borohydride, or the like as described in, for example, Experimental Chemistry Lecture, $4^{th}$ Ed., Vol. 20, P. 10, or the like.

For example, in the case of introducing a reactive group with an ester bond, ordinary esterification in which a carboxylic acid of the arylamine compound and hydroxymethylstyrene are dehydrated and condensed using an acid catalyst, or a method in which a carboxylic acid of the arylamine compound and halogenated methylstyrene are condensed using a base such as pyridine, piperidine, triethylamine, dimethylaminopyridine, trimethylamine, DBU, sodium hydride, sodium hydroxide, and potassium hydroxide may be used, but the method using halogenated methylstyrene is suitable since it prevents by-products.

The halogenated methylstyrene may be added in an amount of 1 equivalent or more, preferably 1.2 equivalents or more, and more preferably 1.5 equivalents or more, with respect to the acid of the carboxylic acid of the arylamine compound, and the base may be used in an amount of from 0.8 equivalent to 2.0 equivalents, and preferably from 1.0 equivalent to 1.5 equivalents, with respect to the halogenated methylstyrene.

As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of from 1 part by weight to 100 parts by weight, and preferably from 2 parts by weight to 50 parts by weight, with respect to 1 part by weight of the carboxylic acid of the arylamine compound.

The reaction temperature is not particularly limited. After completion of the reaction, the reaction liquid is poured into water, extracted with a solvent such as toluene, hexane, and ethyl acetate, washed with water, and if necessary, may be purified using an adsorbent such as activated carbon, silica gel, porous alumina, and activated white clay.

Furthermore, in the case of introduction with an ether bond, a method in which an alcohol of an arylamine compound and a halogenated methylstyrene are condensed using a base such as pyridine, piperidine, triethylamine, dimethylaminopyridine, trimethylamine, DBU, sodium hydride, sodium hydroxide, and potassium hydroxide may be preferably used.

The halogenated methylstyrene may be added in an amount of 1 equivalent or more, preferably 1.2 equivalents or more, and more preferably 1.5 equivalents or more, with respect to the alcohol of the alcohol of the arylamine compound, and the base may be preferably used in an amount of from 0.8 equivalent to 2.0 equivalents, and preferably from 1.0 equivalent to 1.5 equivalents, with respect to the halogenated methylstyrene.

As the solvent, an aprotic polar solvent such as N-methylpyrrolidone, dimethylsulfoxide, and N,N-dimethylformamide; a ketone solvent such as acetone and methyl ethyl ketone; an ether solvent such as diethyl ether and tetrahydrofuran; an aromatic solvent such as toluene, chlorobenzene, and 1-chloronaphthalene; and the like are effective, and the solvent may be used in an amount in the range of from 1 part by weight to 100 parts by weight, and preferably from 2 parts by weight to 50 parts by weight, with respect to 1 part by weight of the alcohol of the arylamine compound.

The reaction temperature is not particularly limited. After completion of the reaction, the reaction liquid is poured into water, extracted with a solvent such as toluene, hexane, and ethyl acetate, washed with water, and if desired, may be purified using an adsorbent such as activated carbon, silica gel, porous alumina, and activated white clay.

The specific reactive charge transport material (in particular, the reactive compound represented by the formula (II)) is synthesized using, for example, the general method for synthesizing a charge transport material as shown below (formylation, esterification, etherification, or hydrogenation).

Formylation: a reaction which is suitable for introducing a formyl group into an aromatic compound, a heterocyclic compound, and an alkene, each having an electron donating group. DMF and phosphorous oxytrichloride are generally used and the reaction is commonly carried out at a reaction temperature, approximately, from room temperature (for example, 25° C.) to 100° C.

Esterification: A condensation reaction of an organic acid with a hydroxyl group-containing compound such as an alcohol and a phenol. A method in which a dehydrating agent coexists or water is excluded from the system to move the equilibrium toward the ester side is preferably used.

Etherification: A Williamson synthesis method in which an alkoxide and an organic halogen compound are condensed is general.

Hydrogenation: A method in which hydrogen is reacted with an unsaturated bond using various catalysts.

The content of the reactive charge transport material (the content in the composition) may be, for example, from 60% by weight to 95% by weight, and preferably from 65% by weight to 93% by weight, with respect to the weight of the protective layer 5 (outermost surface layer).

Resin Particles

The film constituting the protective layer (outermost surface layer) may contain resin particles.

Examples of the resin particles include particles of polycarbonate resins such as a bisphenol A-type resin and a bisphenol Z-type resin, particles of insulating resins such as an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer resin, a polyvinyl acetate resin, a polyvinylformal resin, a polysulfone resin, a styrene-acryl copolymer, styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin, and a chlorine rubber, and particles of organic photoconductive polymers such as polyvinyl carbazole, polyvinyl anthracene, and polyvinyl pyrene.

These resin particles may be hollow particles.

These resins may be used alone or as a mixture of two or more kinds thereof as the resin particles.

The film constituting the protective layer (outermost surface layer) may contain fluorine-containing resin particles as the resin particles.

The fluorine-containing resin particles may be a homopolymer of fluoroolefins or a copolymer of two or more kinds of fluoroolefins and the examples thereof include particles of a copolymer of one or two or more fluoroolefins with non-fluorinated monomers.

Examples of the fluoroolefin include perhaloolefins such as tetrafluoroethylene (TFE), perfluorovinyl ether, hexafluoropropylene (HFP), and chlorotrifluoroethylene (CTFE), and non-perfluoroolefins such as vinylidene fluoride (VdF), trifluoroethylene, and vinyl fluoride, and VdF, TFE, CTFE, HFP, and the like are preferable.

On the other hand, examples of the non-fluorinated monomer include hydrocarbon olefins such as ethylene, propylene, and butene, alkyl vinyl ethers such as cyclohexyl vinyl ether (CHVE), ethyl vinyl ether (EVE), butyl vinyl ether, and methyl vinyl ether, alkenyl vinyl ethers such as polyoxyethylene allyl ether (POEAE), and ethyl allyl ether, reactive α,β-unsaturated group-containing organosilicon compounds such as vinyltrimethoxysilane (VSi), vinyltriethoxysilane, and vinyltris(methoxyethoxy)silane, acrylic esters such as methyl acrylate and ethyl acrylate, methacrylic esters such as methyl methacrylate and ethyl methacrylate, and vinyl esters such as vinyl acetate, vinyl benzoate, and "VEOBA" (trade name, vinyl ester manufactured by Shell Chemical Co., Ltd.), and alkyl vinyl ether, allyl vinyl ether, vinyl ester, and reactive α,β-unsaturated group-containing organosilicon compounds are preferable.

Among these, those having a high degree of fluorination are preferable, and polytetrafluoroethylene (PTFE), a tetrafluoroethylene-hexafluoropropylene copolymer (FEP), a tetrafluoroethylene-perfluoro(alkyl vinyl ether) copolymer (PFA), an ethylene-tetrafluoroethylene copolymer (ETFE), an ethylene-chlorotrifluoroethylene copolymer (ECTFE), and the like are preferable. Among these, PTFE, FEP, and PFA are particularly preferable.

As the fluorine-containing resin particles, for example, particles (fluorine resin aqueous dispersion) prepared by a method such as emulsion polymerization of fluorinated monomers may be used as they are or may be used after washing the particles sufficiently with water, and drying them.

The average particle size of the fluorine-containing resin particles is preferably from 0.01 μm to 100 μm, and particularly preferably from 0.03 μm to 5 μm.

Furthermore, the average particle size of the fluorine-containing resin particles refers to a value measured using a laser diffraction-type particle size distribution measurement device LA-700 (manufactured by Horiba, Ltd.).

As the fluorine-containing resin particles, ones that are commercially available may be used, and examples of the PTFE particles include FLUON L173JE (manufactured by Asahi Glass Co., Ltd.), DYNEON THV-221 AZ and DYNEON 9205 (both manufactured by Sumitomo 3M Limited), and LUBRON L2 and LUBRON L5 (both manufactured by Daikin Industries, Ltd.).

The fluorine-containing resin particles may be those irradiated with laser light having the oscillation wavelength of an ultraviolet ray band. The laser light radiated to the fluorine-containing resin particles is not particularly limited, and examples thereof include excimer laser. As the excimer laser light, ultraviolet laser light having a wavelength of 400 nm or less, and particularly from 193 nm to 308 nm is suitable. In particular, KrF excimer laser light (wavelength: 248 nm), ArF excimer laser light (wavelength: 193 nm), and the like are preferable. Irradiation of excimer laser light is usually carried out at room temperature (25° C.) in air, but may be carried out under an oxygen atmosphere.

Moreover, the irradiation condition for excimer laser light depends on the type of a fluorine resin and the required degree of surface modification, but general irradiation conditions are as follows.

Fluence: 50 mJ/cm$^2$/pulse or more

Incident energy: 0.1 J/cm$^2$ or more

Number of shots: 100 or less

Particularly suitable irradiation conditions that are commonly used for KrF excimer laser light and ArF excimer laser light are as follows.

KrF

Fluence: from 100 mJ/cm$^2$/pulse to 500 mJ/cm$^2$/pulse

Incident energy: from 0.2 J/cm$^2$ to 2.0 J/cm$^2$

Number of shots: from 1 to 20

ArF

Fluence: from 50 mJ/cm$^2$/pulse to 150 mJ/cm$^2$/pulse

Incident energy: from 0.1 J/cm$^2$ to 1.0 J/cm$^2$

Number of shots: from 1 to 20

The content of the fluorine-containing resin particles is preferably from 1% by weight to 20% by weight, and more preferably from 1% by weight to 12% by weight, with respect to the total solid content of the protective layer (outermost surface layer).

—Fluorine-Containing Dispersant—

The film constituting the protective layer (outermost surface layer) may contain a fluorine-containing dispersant together with fluorine-containing resin particles.

The fluorine-containing dispersant is used to disperse the fluorine-containing resin particles in a protective layer (outermost surface layer), and thus, it preferably has a surfactant action, that is, it is preferably a substance having a hydrophilic group and a hydrophobic group in the molecule.

Examples of the fluorine-containing dispersant include a resin formed by the polymerization of the following reactive monomers (hereinafter referred to as a "specific resin"). Specific examples thereof include a random or block copolymer of an acrylate having a perfluoroalkyl group with a monomer having no fluorine, a random or block copolymer of a methacrylate homopolymer and the acrylate having a perfluoroalkyl group with the monomer having no fluorine, and a random or block copolymer of a methacrylate with the monomer having no fluorine. Further, examples of the acrylate having a perfluoroalkyl group include 2,2,2-trifluoroethyl methacrylate and 2,2,3,3,3-pentafluoropropyl methacrylate.

Furthermore, examples of the monomer having no fluorine include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl-o-phenylphenol acrylate, and o-phenylphenol glycidyl ether acrylate. Further, other examples thereof include the block or branch polymers disclosed in the specifications of U.S. Pat. No. 5,637,142, Japanese Patent No. 4251662B, and the like. Further, in addition, fluorinated surfactants may also be included. Specific examples of the fluorinated surfactant include SURFLON S-611 and SURFLON S-385 (both manufactured by AGC Seimi Chemical Co., Ltd.), FTERGENT 730FL and FTERGENT 750FL (both manufactured by NEOS Co., Ltd.), PF-636 and PF-6520 (both manufactured by Kitamura Chemicals Co., Ltd.), MEGAFACE EXP, TF-1507, MEGA- FACE EXP, and TF-1535 (all manufactured by DIC Corporation), and FC-4430 and FC-4432 (both manufactured by 3M Corp.).

Furthermore, the weight average molecular weight of the specific resin is preferably from 100 to 50000.

The content of the fluorine-containing dispersant is preferably from 0.1% by weight to 1% by weight, and more preferably from 0.2% by weight to 0.5% by weight, with respect to the total solid content of the protective layer (outermost surface layer).

As a method for attaching the fluorine-containing dispersant to the surface of the fluorine-containing resin particles, the fluorine-containing dispersant may be directly attached on the surface of the fluorine-containing resin particles, or first, the monomers are adsorbed on the surface of the fluorine-containing resin particles, and then polymerized to form the specific resin on the surface of the fluorine-containing resin particles.

The fluorine-containing dispersant may be used in combination with other surfactants. However, the amount thereof is preferably as little as possible, and the amount of the other surfactants is preferably from 0 parts by weight to 0.1 part by weight, more preferably from 0 parts by weight to 0.05 part by weight, and still more preferably from 0 parts by weight to 0.03 part by weight, with respect to 1 part by weight of the fluorine-containing resin particles.

As the other surfactant, non-ionic surfactants are preferable, and examples thereof include polyoxyethylene alkyl ethers, polyoxyethylene alkylphenyl ethers, polyoxyethylene alkyl esters, sorbitan alkyl esters, polyoxyethylene sorbitan alkyl esters, glycerin esters, fluorinated surfactants, and derivatives thereof.

Specific examples of the polyoxyethylenes include EMULGEN 707 (manufactured by Kao Corporation), NAROACTY CL-70 and NAROACTY CL-85 (both manufactured by Sanyo Chemical Industries, Ltd.), and LEOCOL TD-120 (manufactured by Lion Corporation).

Compound Having Unsaturated Bond

The film constituting the protective layer (outermost surface layer) may use a compound having an unsaturated bond in combination.

The compound having an unsaturated bond may be any one of a monomer, an oligomer, and a polymer, and may be a compound which has no charge transport skeleton.

Examples of the compound having an unsaturated bond, which has no charge transport skeleton, include the following compounds.

Examples of the monofunctional monomers include isobutyl acrylate, t-butyl acrylate, isooctyl acrylate, lauryl acrylate, stearyl acrylate, isobornyl acrylate, cyclohexyl acrylate, 2-methoxyethyl acrylate, methoxytriethylene glycol acrylate, 2-ethoxyethyl acrylate, tetrahydrofurfuryl acrylate, benzyl acrylate, ethylcarbitol acrylate, phenoxyethyl acrylate, 2-hydroxyacrylate, 2-hydroxypropyl acrylate, 4-hydroxybutyl acrylate, methoxypolyethylene glycol acrylate, methoxypolyethylene glycol methacrylate, phenoxypolyethylene glycol acrylate, phenoxypolyethylene glycol methacrylate, hydroxyethyl o-phenylphenolacrylate, o-phenylphenol glycidyl etheracrylate, and styrene.

Examples of the difunctional monomers include diethylene glycol di(meth)acrylate, polyethylene glycol di(meth) acrylate, polypropylene glycol di(meth)acrylate, neopentyl glycol di(meth)acrylate, 1,6-hexanediol di(meth)acrylate, divinylbenzene, and diallyl phthalate.

Examples of the trifunctional monomers include trimethylol propane tri(meth)acrylate, pentaerythritol tri(meth)acrylate, aliphatic tri(meth)acrylate, and trivinylcyclohexane.

Examples of the tetrafunctional monomers include pentaerythritol tetra(meth)acrylate, ditrimethylol propane tetra (meth)acrylate, and aliphatic tetra(meth)acrylate.

Examples of the pentafunctional or higher functional monomers include (meth)acrylates having a polyester skeleton, a urethane skeleton, and a phosphagen skeleton, in addition to dipentaerythritol penta(meth)acrylate, dipentaerythritol hexa(meth)acrylate.

In addition, examples of the reactive polymer include those disclosed in JP-A-5-216249, JP-A-5-323630, JP-A-11-52603, JP-A-2000-264961, JP-A-2005-2291, and the like.

In the case where a compound which has an unsaturated bond, and has no charge transport component is used, it is used alone or as a mixture of two or more kinds thereof.

The content of the compound having an unsaturated bond, which has no charge transport component, is preferably 60% by weight or less, more preferably 55% by weight or less, and still more preferably 50% by weight or less, with respect to the total solid content of the composition used to form the protective layer (outermost surface layer).

Non-Reactive Charge Transport Material

For the film constituting the protective layer (outermost surface layer), a non-reactive charge transport material may be used in combination. The non-reactive charge transport material has no reactive group not in charge of charge transportation, and accordingly, in the case where the non-reactive charge transport material is used in the protective layer (outermost surface layer), the concentration of the charge transport component increases, which is thus effective for further improvement of electrical characteristics. In addition, the non-reactive charge transport material may be added to reduce the crosslinking density, so as to adjust the strength.

As the non-reactive charge transport material, a known charge transport material may be used, and specifically, a triarylamine-based compound, a benzidine-based compound, an arylalkane-based compound, an aryl-substituted ethylene-based compound, a stilbene-based compound, an anthracene-based compound, a hydrazone-based compound, or the like is used.

Among these, from the viewpoint of charge mobility, compatibility, or the like, those having a triphenylamine skeleton are preferable.

The amount of the non-reactive charge transport material used is preferably from 0% by weight to 30% by weight, more preferably from 1% by weight to 25% by weight, and still more preferably from 5% by weight to 25% by weight, with respect to the total solid content in a coating liquid for forming a layer.

Other Additives

The film constituting the protective layer (outermost surface layer) may be used in a mixture with other coupling agents, particularly, fluorine-containing coupling agents for the purpose of further adjusting film formability, flexibility, lubricating property, and adhesiveness. As these compounds, various silane coupling agents and commercially available silicone hard coat agents are used. In addition, a radical polymerizable group-containing silicon compound or a fluorine-containing compound may be used.

Examples of the silane coupling agent include vinyltrichlorosilane, vinyltrimethoxysilane, vinyltriethoxysilane, 3-glycidoxypropylmethyldiethoxysilane, 3-glycidoxypropyltriethoxysilane, 3-glycidoxypropyltrimethoxysilane, 3-aminopropyltriethoxysilane, 3-aminopropyltrimethoxysilane, 3-aminopropylmethyldimethoxysilane, N-2(aminoethyl)-3-aminopropyltriethoxysilane, tetramethoxysilane, methyltrimethoxysilane, and dimethyldimethoxysilane.

Examples of the commercially available hard coat agent include KP-85, X-40-9740, and X-8239 (all manufactured by Shin-Etsu Chemical Co., Ltd.), and AY42-440, AY42-441, and AY49-208 (all manufactured by Dow Corning Toray Co., Ltd.).

In addition, in order to impart water repellency, a fluorine-containing compound such as (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane may be added.

The silane coupling agent may be used in an arbitrary amount, but the amount of the fluorine-containing compound is preferably 0.25 time or less by weight, with respect to the compound containing no fluorine from the viewpoint of the film formability of the crosslinked film. In addition, a reactive fluorine compound disclosed in JP-A-2001-166510 or the like may be mixed.

Examples of the radically polymerizable group-containing silicon compound and fluorine-containing compound include the compounds described in JP-A-2007-11005.

A deterioration inhibitor is preferably added to the film constituting the protective layer (outermost surface layer). Preferable examples of the deterioration inhibitor include hindered phenol-based deterioration inhibitors and hindered amine-based deterioration inhibitors, and known antioxidants such as organic sulfur antioxidants, phosphite antioxidants, dithiocarbamate antioxidants, thiourea antioxidants, benzimidazole antioxidants, and the like may be used.

The amount of the deterioration inhibitor to be added is preferably 20% by weight or less, and more preferably 10% by weight or less.

Examples of the hindered phenol antioxidant include IRGANOX 1076, IRGANOX 1010, IRGANOX 1098, IRGANOX 245, IRGANOX 1330, IRGANOX 3114, and IRGANOX 1076 (all manufactured by Ciba Japan), and 3,5-di-t-butyl-4-hydroxybiphenyl.

Examples of the hindered amine antioxidants include SANOL LS2626, SANOL LS765, SANOL LS770, and SANOL LS744 (all manufactured by Sankyo Lifetech Co., Ltd.), TINUVIN 144 and TINUVIN 622LD (both manufactured by Ciba Japan), and MARK LA57, MARK LA67, MARK LA62, MARK LA68, and MARK LA63 (all manufactured by Adeka Corporation); examples of the thioether antioxidants include SUMILIZER TPS and SUMILIZER TP-D (both manufactured by Sumitomo Chemical Co., Ltd.); and examples of the phosphite antioxidants include MARK 2112, MARK PEP-8, MARK PEP-24G, MARK PEP-36, MARK 329K, and MARK HP-10 (all manufactured by Adeka Corporation).

Conductive particles, organic particles, or inorganic particles may be added to the film constituting the protective layer (outermost surface layer).

Examples of the particles include silicon-containing particles. The silicon-containing particles refer to particles which include silicon as a constitutional element, and specific examples thereof include colloidal silica and silicone particles. The colloidal silica used as the silicon-containing particles is selected from those obtained by dispersing silica having an average particle size of preferably from 1 nm to 100 nm, and more preferably from 10 nm to 30 nm, in an acidic or alkaline aqueous dispersion or in an organic solvent such as an alcohol, a ketone, and an ester. As the particles, commercially available ones may be used.

The solid content of the colloidal silica in the protective layer is not particularly limited, but it is used in an amount in the range of 0.1% by weight to 50% by weight, and preferably from 0.1% by weight to 30% by weight, with respect to the total solid content of the protective layer.

The silicone particles used as the silicon-containing particles are selected from silicone resin particles, silicone rubber particles, and silica particles whose surfaces have been treated with silicone, and commercially available silicone particles may be used.

These silicone particles are spherical, and the average particle size is preferably from 1 nm to 500 nm, and more preferably from 10 nm to 100 nm.

The content of the silicone particles in the surface layer is preferably from 0.1% by weight to 30% by weight, and more preferably from 0.5% by weight to 10% by weight, with respect to the total amount of the total solid content of the protective layer.

In addition, examples of other particles include semiconductive metal oxides such as $ZnO—Al_2O_3$, $SnO_2—Sb_2O_3$, $In_2O_3—SnO_2$, $ZnO_2—TiO_2$, $ZnO—TiO_2$, $MgO—Al_2O_3$, $FeO—TiO_2$, $TiO_2$, $SnO_2$, $In_2O_3$, ZnO, and MgO. Further, various known dispersant materials may be used to disperse the particles.

Oils such as a silicone oil may be added to the film constituting the protective layer (outermost surface layer).

Examples of the silicone oil include silicone oils such as dimethylpolysiloxane, diphenylpolysiloxane, and phenylmethylsiloxane; reactive silicone oils such as amino-modified polysiloxane, epoxy-modified polysiloxane, carboxylic-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; and vinyl group-containing cyclosiloxanes such as pentavinylpentamethylcyclopentasiloxane.

In order to improve the wettability of the coated film, a silicone-containing oligomer, a fluorine-containing acryl polymer, a silicone-containing polymer, or the like may be added to the film constituting the protective layer (outermost surface layer).

A metal, a metal oxide, carbon black, or the like may be added to the film constituting the protective layer (outermost surface layer). Examples of the metal include aluminum, zinc, copper, chromium, nickel, silver and stainless steel, and resin particles having any of these metals deposited on the surface thereof. Examples of the metal oxide include zinc oxide, titanium oxide, tin oxide, antimony oxide, indium oxide, bismuth oxide, indium oxide on which tin has been doped, tin oxide having antimony or tantalum doped thereon, and zirconium oxide having antimony doped thereon.

These may be used alone or in combination of two or more kinds thereof. When two or more kinds are used in combination, they may be simply mixed, or formed into a solid solution or a fused product. The average particle size of the conductive particles is 0.3 μm or less, and particularly preferably 0.1 μm or less.

Composition

The composition used to form a protective layer is preferably prepared as a coating liquid for forming a protective layer, including the respective components dissolved or dispersed in the solvent.

Here, as the solvent of the coating liquid for forming a protective layer, from the viewpoint of the solubility of the charge transport material, the dispersibility of the fluorine-containing resin particles, and the prevention of uneven distribution of the fluorine-containing resin particles on the surface layer side of the outermost surface layer, a ketone solvent or an ester solvent having a difference (absolute value) in the SP value (solubility parameter as calculated by a Feders method) from the binder resin of the charge transport layer (specific polycarbonate copolymer) of from 2.0 to 4.0 (preferably from 2.5 to 3.5) may be preferably used.

Specific examples of the solvent of the coating liquid for forming a protective layer include singular or mixed solvents of, for example, ketones such as methylethyl ketone, methylisobutyl ketone, diisopropyl ketone, diisobutyl ketone, ethyl-n-butyl ketone, di-n-propyl ketone, methyl-n-amyl ketone, methyl-n-butyl ketone, diethyl ketone, and methyl-n-propyl ketone; esters such as isopropyl acetate, isobutyl acetate, ethyl acetate, n-propyl acetate, n-butyl acetate, ethyl isovalerate, isoamyl acetate, isopropyl butyrate, isoamyl propionate, butyl butyrate, amyl acetate, butyl propionate, ethyl propionate, methyl acetate, methyl propionate, and allyl acetate. Further, 0% by weight to 50% by weight of an ether-based solvent (for example, diethyl ether, dioxane, diisopropyl ether, cyclopentyl methyl ether, and tetrahydrofuran), and an alkylene glycol-based solvent (for example, 1-methoxy-2-propanol, 1-ethoxy-2-propanol, ethylene glycol monoisopropyl ether, and propylene glycol monomethyl ether acetate) may be mixed and used.

Examples of the method of dispersing the fluorine-containing resin particles in the coating liquid for forming a protective layer include dispersing methods using a media dispersing machine such as a ball mill, a vibrating ball mill, an attriter, a sand mill, and a horizontal sandmill; and a media-less dispersing machine such as a stirrer, an ultrasonic dispersing machine, a roll mill, and a high-pressure homogenizer. Further, examples of the dispersing method using a high-pressure homogenizer include dispersing methods using a collision system that disperses a dispersion in a high-pressure state through liquid-liquid collision or liquid-wall collision, or a penetration system that disperses a dispersion by making the dispersion pass through a fine flow channel in a high-pressure state.

Furthermore, the method for preparing the coating liquid for forming a protective layer is not particularly limited, and the coating liquid for forming a protective layer may be prepared by mixing a charge transport material, fluorine-containing resin particles, a fluorine-containing dispersant, and if desired, other components such as a solvent, and using the above-described dispersing machine, or may be prepared by separately preparing two liquids of a mixed liquid A including fluorine-containing resin particles, a fluorine-containing dispersant, and a solvent, and a mixed liquid B including at least a charge transport material and a solvent, and then mixing the mixed liquids A and B. By mixing the fluorine-containing resin particles and a fluorine-containing dispersant in a solvent, the fluorine-containing dispersant is easily attached to the surface of the fluorine-containing resin particles.

Furthermore, when the above-described components are reacted with each other to obtain a coating liquid for forming a protective layer, the respective components may be simply mixed and dissolved, but alternatively, the components may be preferably warmed under the conditions of a temperature of from room temperature (20° C.) to 100° C., and more preferably from 30° C. to 80° C., and a time of preferably from 10 minutes to 100 hours, and more preferably from 1 hour to 50 hours. Further, in doing so, it is also preferable to radiate ultrasonic waves.

—Formation of Protective Layer—

The coating liquid for forming a protective layer is applied to the surface to be coated (charge transport layer) through a general method such as a blade coating method, a wire bar coating method, a spray coating method, a dipping coating method, a bead coating method, an air knife coating method, a curtain coating method, or an inkjet coating method.

Thereafter, radical polymerization is carried out by applying light, electron beams, or heat to the obtained coating film to cure the coating film.

Heat, light, radiation, and the like are used in the curing method. When the coating film is cured by heat and light, a polymerization initiator is not necessarily required, but a photocuring catalyst or a thermal polymerization initiator may be used. As the photocuring catalyst and the thermal polymerization initiator, known photocuring catalysts and thermal polymerization initiators are used. Electron beams are preferable as the radiation.

Electron Beam Curing

When using electron beams, the acceleration voltage is preferably 300 KV or less, and optimally 150 KV or less. In addition, the radiation dose is in the range of preferably from 1 Mrad to 100 Mrad, and more preferably from 3 Mrad to 50 Mrad. When the acceleration voltage is set to 300 KV or less, the damage of the electron beam irradiation on the photoreceptor characteristics is prevented. When the radiation dose is set to 1 Mrad or greater, the crosslinking is sufficiently carried out, whereas when the radiation dose is set to 100 Mrad or less, the deterioration of the photoreceptor is prevented.

The irradiation is carried out under an inert gas atmosphere of nitrogen, argon, or the like at an oxygen concentration of 1000 ppm, and preferably 500 ppm or less, and heating may be carried out at from 50° C. to 150° C. during or after irradiation.

Photocuring

As a light source, a high-pressure mercury lamp, a low-pressure mercury lamp, a metal halide lamp, or the like is used, and a filter such as a band pass filter may be used to select a preferable wavelength. The irradiation time and the light intensity are freely selected, but, for example, the illumination (365 nm) is preferably from 300 $mW/cm^2$ to 1000 $mW/cm^2$, and for example, in the case of irradiation with UV light at 600 $mW/cm^2$, irradiation may be carried out for from 5 seconds to 360 seconds.

The irradiation is carried out under an inert gas atmosphere of nitrogen, argon, or the like at an oxygen concentration of preferably 1000 ppm or less, and more preferably 500 ppm or less, and heating may be carried out at from 50° C. to 150° C. during or after irradiation.

Examples of the photocuring catalyst of intramolecular cleavage type include benzyl ketal photocuring catalysts, alkylphenone photocuring catalysts, aminoalkylphenone photocuring catalysts, phosphine oxide photocuring catalysts, titanocene photocuring catalysts, and oxime photocuring catalysts.

More specifically, examples of the benzyl ketal photocuring catalysts include 2,2-dimethoxy-1,2-diphenylethan-1-one.

Examples of the alkylphenone photocuring catalysts include 1-hydroxy-cyclohexyl-phenyl-ketone, 2-hydroxy-2-methyl-1-phenyl-propan-1-one, 1-[4-(2-hydroxyethoxy)- phenyl]-2-hydroxy-2-methyl-1-propan-1-one, 2-hydroxy-1-{4-[4-(2-hydroxy-2-methyl-propionyl)-benzyl]phenyl)-2-methyl-propan-1-one, acetophenone, and 2-phenyl-2-(p-toluenesulfonyloxy)acetophenone.

Examples of the aminoalkylphenone photocuring catalysts include p-dimethylaminoacetophenone, p-dimethylaminopropiophenone, 2-methyl-1-(4-methylthiophenyl)-2-morpholinopropan-1-one, and 2-benzyl-2-dimethylamino-1-(4-morpholinophenyl)-butanone-1,2-(dimethylamino)-2-[(4-methylphenyl)methyl]-1-[4-(4-morpholinyl)phenyl]-1-butanone.

Examples of the phosphine oxide photocuring catalysts include 2,4,6-trimethylbenzoyl-diphenyl-phosphine oxide and bis(2,4,6-trimethylbenzoyl)-phenyl phosphine oxide.

Examples of the titanocene photocuring catalysts include bis(η5-2,4-cyclopentadien-1-yl)-bis(2,6-difluoro-3-(1H-pyrrol-1-yl)-phenyl)titanium.

Examples of the oxime photocuring catalysts include 1,2-octanedione, 1-[4-(phenylthio)-,2-(O-benzoyloxime)], ethanone, 1-[9-ethyl-6-(2-methylbenzoyl)-9H-carbazol-3-yl]-,1-(O-acetyloxime).

Examples of the hydrogen abstraction photocuring catalyst include benzophenone-based photocuring catalysts, thioxanthone-based photocuring catalysts, benzyl-based photocuring catalysts, and Michler's ketone-based photocuring catalysts.

More specifically, examples of the benzophenone-based photocuring catalysts include 2-benzoyl benzoic acid, 2-chlorobenzophenone, 4,4'-dichlorobenzophenone, 4-benzoyl-4'-methyldiphenylsulfide, and p,p'-bisdiethylaminobenzophenone.

Examples of the thioxanthone-based photocuring catalysts include 2,4-diethylthioxanthen-9-one, 2-chlorothioxanthone, and 2-isopropylthioxanthone.

Examples of the benzyl-based photocuring catalysts include benzyl, (±)-camphorquinone, and p-anisyl.

These photocuring catalysts are used alone or in combination of two or more kinds thereof.

Thermal Curing

Examples of the thermal polymerization initiator include thermal radical generating agents or derivatives thereof, and specific examples thereof include azo initiators such as V-30, V-40, V-59, V601, V65, V-70, VF-096, VE-073, Vam-110, and Vam-111 (all manufactured by Wako Pure Chemical Industries, Ltd.), and OTazo-15, OTazo-30, AIBN, AMBN, ADVN, and ACVA (all manufactured by Otsuka Chemical Co., Ltd.); and PERTETRA A, PERHEXA HC, PERHEXA C, PERHEXA V, PERHEXA 22, PERHEXA MC, PERBUTYL H, PERCUMYL H, PERCUMYL P, PERMENTA H, PEROCTA H, PERBUTYL C, PERBUTYL D, PERHEXYL D, PEROYL IB, PEROYL 355, PEROYL L, PEROYL SA, NYPER BW, NYPER BMT-K40/M, PEROYL IPP, PEROYL NPP, PEROYL TCP, PEROYL OPP, PEROYL SBP, PERCUMYL ND, PEROCTA ND, PERHEXYL ND, PERBUTYL ND, PERBUTYL NHP, PERHEXYL PV, PERBUTYL PV, PERHEXA 250, PEROCTA O, PERHEXYL O, PERBUTYL O, PERBUTYL L, PERBUTYL 355, PERHEXYL I, PERBUTYL I, PERBUTYL E, PERHEXA 25Z, PERBUTYL A, PERHEXYL Z, PERBUTYL ZT, and PERBUTYL Z (manufactured by NOF Corporation), KAYAKETAL AMC55, TRIGONOX 36-C75, LAUROX, PERCADOX L-W75, PERCADOX CH-50L, TRIGONOX TMBH, KAYACUMENE H, KAYABUTYL H-70, PERCADOX BC-FF, KAYAHEXA AD, PERCADOX 14, KAYABUTYL C, KAYABUTYL D, KAYAHEXA YD-E85, PERCADOX 12-XL25, PERCADOX 12-EB20, TRIGONOX 22-N70, TRIGONOX 22-70E, TRIGONOX D-T50, TRIGONOX 423-C70, KAYAESTER CND-C70, KAYAESTER CND-W50, TRIGONOX 23-C70, TRIGONOX 23-W50N, TRIGONOX 257-C70, KAYAESTER P-70, KAYAESTER TMPO-70, TRIGONOX 121, KAYAESTER O, KAYAESTER HTP-65W, KAYAESTER AN, TRIGONOX 42, TRIGONOX F-C50, KAYABUTYL B, KAYACARBON EH-C70, KAYACARBON EH-W60, KAYACARBON I-20, KAYACARBON BIC-75, TRIGONOX 117, and KAYALENE 6-70 (all manufactured by Kayaku Akzo Co., Ltd.), and LUPEROX 610, LUPEROX 188, LUPEROX 844, LUPEROX 259, LUPEROX 10, LUPEROX 701, LUPEROX 11, LUPEROX 26, LUPEROX 80, LUPEROX 7, LUPEROX 270, LUPEROX P, LUPEROX 546, LUPEROX 554, LUPEROX 575, LUPEROX TANPO, LUPEROX 555, LUPEROX 570, LUPEROX TAP, LUPEROX TBIC, LUPEROX TBEC, LUPEROX JW, LUPEROX TAIC, LUPEROX TAEC, LUPEROX DC, LUPEROX 101, LUPEROX F, LUPEROX DI, LUPEROX 130, LUPEROX 220, LUPEROX 230, LUPEROX 233, and LUPEROX 531 (all manufactured by Arkema Yoshitomi, Ltd.).

Among them, when an azo-based polymerization initiator having a molecular weight of 250 or more is used, the reaction proceeds without unevenness at a low temperature, and thus a high-strength film in which unevenness is prevented is formed. The molecular weight of the azo-based polymerization initiator is preferably 250 or more, and more preferably 300 or more.

The heating is performed under an inert gas atmosphere of nitrogen, argon, or the like at an oxygen concentration of preferably 1000 ppm or less, and more preferably 500 ppm or less and a temperature of preferably from 50° C. to 170° C., and more preferably from 70° C. to 150° C. for preferably from 10 minutes to 120 minutes, and more preferably from 15 minutes to 100 minutes.

The total content of the photocuring catalyst or the thermal polymerization initiator is preferably from 0.1% by weight to 10% by weight, more preferably from 0.1% by weight to 8% by weight, and particularly preferably from 0.1% by weight to 5% by weight with respect to the total solid content in the solution for layer formation.

In the present exemplary embodiment, a thermal curing method in which radicals are relatively slowly generated is employed due to the reason that when the reaction excessively rapidly proceeds, structural relaxation of the coating film is difficult to occur due to the crosslinking, and thus unevenness and wrinkles easily occur in the film.

Particularly, when the specific chain polymerizable group-containing charge transport material and thermal curing are combined with each other, structural relaxation of the coating film is promoted, whereby a protective layer (outermost surface layer) having excellent surface properties is easily obtained.

The film thickness of the protective layer is set in the range of, for example, preferably from 3 μm to 40 μm, and more preferably from 5 μm to 35 μm.

The configurations of the respective layers in the function separation type photosensitive layer are described above with reference to the electrophotographic photoreceptor shown in FIG. 1, but these configurations may also be employed in the respective layers in the function separation type electrophotographic photoreceptor shown in FIG. 2. In addition, in the case of the single layer type photosensitive layer of the electrophotographic photoreceptor shown in FIG. 3, the following exemplary embodiment is preferable.

That is, the single layer type photosensitive layer (charge generation/charge transport layer) may be preferably configured to include a charge generating material and a charge transport material, and if desired, a binder resin and other known additives. Further, these materials are the same as the materials described for the charge generating material and the charge transport layer.

Furthermore, the content of the charge generating material in the single layer type photosensitive layer is from 10% by weight to 85% by weight, and preferably from 20% by weight to 50% by weight, with respect to the entire solid content. Further, the content of the charge transport material in the single layer type photosensitive layer may be from 5% by weight to 50% by weight with respect to the entire solid content.

The method for forming a single layer type photosensitive layer is the same as the method for forming a charge generation layer or a charge transport layer.

The film thickness of the single layer type photosensitive layer may be, for example, from 5 μm to 50 μm, and preferably from 10 μm to 40 μm.

Further, in the electrophotographic photoreceptor according to the present exemplary embodiment, a configuration in which the outermost surface layer is a protective layer is described, but a configuration in which there is no protective layer may also be used.

In the case where there is no protective layer, in the electrophotographic photoreceptor shown in FIG. 1, the charge transport layer positioned on the outermost surface in the layer configuration becomes the outermost surface layer. Further, the charge transport layer which is the outermost surface layer is composed of a cured film of the specific composition.

Furthermore, in the case where there is no protective layer, in the electrophotographic photoreceptor shown in FIG. 3, the single layer type photosensitive layer positioned on the outermost surface in the layer configuration becomes the outermost surface layer. Further, the single layer type photosensitive layer which is the outermost surface layer is composed of a cured film of the specific composition. However, a charge generating material is blended into the composition.

[Image Forming Apparatus (and Process Cartridge)]

The image forming apparatus according to the present exemplary embodiment is provided with an electrophotographic photoreceptor, a charging unit that charges the surface of the electrophotographic photoreceptor, an electrostatic latent image forming unit that forms an electrostatic latent image on the surface of a charged electrophotographic photoreceptor, a developing unit that develops the electrostatic latent image formed on the surface of the electrophotographic photoreceptor by a developer containing a toner to form a toner image, and a transfer unit that transfers the toner image on the surface of a recording medium. Further, as the electrophotographic photoreceptor, the electrophotographic photoreceptor according to the present exemplary embodiment is applied.

The image forming apparatus according to the present exemplary embodiment may be provided with a supply unit that supplies zinc stearate to the surface of electrophotographic photoreceptor preferably. Thus, it is possible to coating the surface of the outermost surface layer of the electrophotographic photoreceptor in the image forming apparatus with zinc stearate to adjust the coverage thereof to the range of the zinc stearate coverage.

Examples of the supply unit include a developing unit that stores a developer having toner particles and an external additive containing zinc stearate, and a coating unit that is provided between the transfer unit and the cleaning unit, apart from the developing unit, and coats the surface of the electrophotographic photoreceptor with zinc stearate. Any one or both of these units may be provided. Further, in the case of employing a developing unit that stores a developer having toner particles and an external additive containing zinc stearate, the developing unit also acts as the supply unit.

For the image forming apparatus according to the present exemplary embodiment, a known image forming apparatus, such as an apparatus provided with a fixing unit that fixes the transferred toner image to the surface of a recording medium; a direct transfer type apparatus that directly transfers the toner image formed on the surface of the electrophotographic photoreceptor to a recording medium; an intermediate transfer type apparatus that primarily transfers the toner image formed on the surface of the electrophotographic photoreceptor to the surface of an intermediate transfer member, and secondarily transfers the toner image formed on the surface of the intermediate transfer member to the surface of the recording medium; an apparatus provided with a cleaning unit that cleans the surface of the electrophotographic photoreceptor after the transfer of the toner image and before the charging; an apparatus provided with an erasing unit that irradiates the surface of an image holding member after the transfer of the toner image and before the charging with erasing light for erasure; and an apparatus provided with an electrophotographic photoreceptor heating member by elevating the temperature of the electrophotographic photoreceptor to lower the relative temperature, is applied.

In the case of the intermediate transfer type apparatus, as the transfer unit, for example, a transfer unit, which is configured to have an intermediate transfer member to the surface of which the toner image transferred, a primary image transfer unit that primarily transfers the formed toner image to the surface of the image holding member to the surface of the intermediate transfer member, and a secondary image transfer unit that secondarily transfers the toner image transferred to the surface of the intermediate transfer member to the surface of a recording medium, is applied.

The image forming apparatus according to the present exemplary embodiment may be an image forming apparatus, which is either a dry developing type image forming apparatus or a wet developing type (liquid developer-using developing type) image forming apparatus.

Further, in the image forming apparatus according to the present exemplary embodiment, for example, a part provided with the electrophotographic photoreceptor may be a cartridge structure (process cartridge) detachable from the image forming apparatus. As the process cartridge, for example, a process cartridge provided with the electrophotographic photoreceptor according to the present exemplary embodiment is suitably used. Further, in the process cartridge, in addition to the electrophotographic photoreceptor, for example, at least one selected from the group consisting of a charging unit, an electrostatic latent image forming unit, a developing unit, and a transfer unit may be provided.

An example of the image forming apparatus according to the present exemplary embodiment is shown below, but the invention is not limited thereto. Further, the main parts shown in the figures will be described, with the description of the others being omitted.

Figure 4:
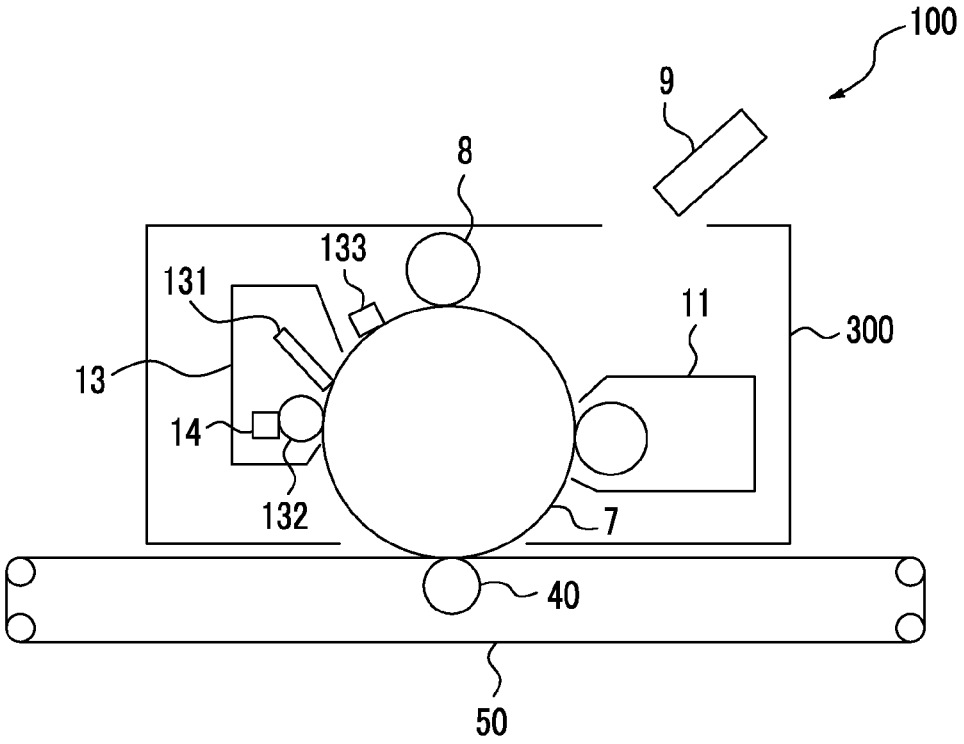
FIG. 4 is a schematic partial cross-sectional view showing an example of an image forming apparatus according to the present exemplary embodiment.

FIG. 4 is a schematic diagram showing an example of the image forming apparatus according to the present exemplary embodiment.

As shown in FIG. 4, the image forming apparatus 100 according to the present exemplary embodiment is provided with a process cartridge 300 provided with an electrophotographic photoreceptor 7, an exposure device 9 (an example of an electrostatic latent image forming unit), a transfer device 40 (a primary image transfer device), and an intermediate transfer member 50. Further, in the image forming apparatus 100, the exposure device 9 is disposed at a position which makes it possible to expose the electrophotographic photoreceptor 7 through an opening portion of the process cartridge 300, the transfer device 40 is disposed at a position facing the electrophotographic photoreceptor 7 via the intermediate transfer member 50 interposed therebetween, and the intermediate transfer member 50 is disposed so as to be partially brought into contact with the electrophotographic photoreceptor 7. Although not shown in the figures, the image forming apparatus also has a secondary image transfer device which transfers the toner image transferred to the intermediate transfer member 50 to a recording medium (for example, paper). Further, the intermediate transfer member 50, the transfer device 40 (primary image transfer device), and the secondary image transfer device (not shown in the figures) correspond to an example of the transfer unit.

The process cartridge 300 in FIG. 4 integrally supports the electrophotographic photoreceptor 7, a charging device 8 (an example of a charging unit), a developing device 11 (an example of a developing unit), and a cleaning device 13 (an example of a cleaning unit) in a housing. The cleaning device 13 has a cleaning blade (an example of a cleaning member) 131, and the cleaning blade 131 is disposed so as to be brought into contact with the surface of the electrophotographic photoreceptor 7. Further, the cleaning member may be a conductive or insulating fibrous member, that is not an exemplary embodiment of the cleaning blade 131, and this may be used alone or in combination with the cleaning blade 131.

Further, in FIG. 4, an example where the image forming apparatus is provided with a fibrous member 132 (roll shape) for coating a lubricating material 14, which is zinc stearate, onto the surface of the electrophotographic photoreceptor 7 as a supply unit that supplies zinc stearate to the surface of the electrophotographic photoreceptor 7 is shown, but this is disposed as required. In addition, an example where a fibrous member 133 (planar brush shape) for assisting cleaning is provided is shown, but this may be disposed as required.

Hereinafter, the respective components of the image forming apparatus according to the present exemplary embodiment will be described.

Charging Device

As the charging device 8, a contact charging device that uses, for example, a conductive or semiconductive charging roller, a charging brush, a charging film, a charging rubber blade, a charging tube, or the like is used. Further, a known charging device such as a non-contact roller charger, a Scorotron charger or Corotron charger that makes use of corona discharge may also be used.

Exposure Device

Examples of the exposure device 9 include an optical device for performing predetermined image-wise exposure with light such as semiconductor laser beam, LED light, and liquid crystal shutter light on the surface of the electrophotographic photoreceptor 7 is exemplified. A wavelength of a light source is set to be within a spectral sensitivity range of an electrophotographic photoreceptor. As a wavelength of a semiconductor laser, near-infrared having an oscillation wavelength in the proximity of 780 nm is mainly used. However, without restricting to the wavelength, a laser having an oscillation wavelength of 600 nm range or a laser having an oscillation wavelength in from 400 nm to 450 nm as a blue laser may be used. Further, when it is intended to form a color image, the surface-emitting laser light source capable of outputting multi-beams is also effective.

Developing Device

Examples of the developing device 11 include a general developing device in which, for example, development is carried out in contact or without contact with a developer. The developing device 11 is selected in accordance with the object without specific limitation as long as the foregoing functions are possessed. For example, a known developing device having a function of attaching the single-component or two-component developer to the electrophotographic photoreceptor 7 by use of a brush or a roller is exemplified. Among these, a developing device which employs a developing roller retaining a developer on the surface thereof is preferably used.

The developer used in the developing device 11 may be a single-component developer composed of a toner alone or a two-component developer including a toner and a carrier. Further, the developer may be magnetic or non-magnetic. As these developers, known developers are applied.

Here, the developer stored in the developing device is preferably a developer including toner particles, and external additives containing zinc stearate particles.

Next, the configuration of the toner particles will be described.

The toner particles include, for example, a binder resin. The toner particles may include a colorant and a release agent, and other additives, if necessary.

Binder Resin

Examples of the binder resin include vinyl-based resins including homopolymers of monomers such as styrenes (for example, styrene, parachlorostyrene, and α-methyl styrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (vinyl methyl ketone, vinyl ethyl ketone, and vinyl isopropenyl ketone), and olefins (for example, ethylene, propylene, and butadiene), or a copolymer formed of a combination of two or more kinds thereof.

Examples of the binder resin include non-vinyl-based resins such as an epoxy resin, a polyester resin, a polyurethane resin, a polyamide resin, a cellulose resin, a polyether resin, and a modified rosin, a mixture thereof with the vinyl-based resin, and a graft polymer obtained by polymerization of the vinyl-based monomers in the co-existence of both the resins.

These binder resins may be used alone or in combination of two or more kinds thereof.

The content of the binder resin is, for example, preferably from 40% by weight to 95% by weight, more preferably from 50% by weight to 90% by weight, and still more preferably from 60% by weight to 85% by weight, with respect to the total toner particles.

Colorant

Examples of the colorant include various pigments such as carbon black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengale, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes such as acridine-based dyes, xanthene-based dyes, azo-based dyes, benzoquinone-based dyes, azine-based dyes, anthraquinone-based dyes, thioindigo-based dyes, dioxadine-based dyes, thiazine-based dyes, azomethine-based dyes, indigo-based dyes, phthalocyanine-based dyes, Aniline Black-based dyes, polymethine-based dyes, triphenylmethane-based dyes, diphenylmethane-based dyes, and thiazole-based dyes.

The colorants may be used alone or in combination of two or more kinds thereof.

As the colorant, a colorant which has been surface-treated, if necessary, may be used, or it may be used in combination with a dispersant. Further, a combination of plural colorants may be used.

The content of the colorant is, for example, preferably from 1% by weight to 30% by weight, and more preferably from 3% by weight to 15% by weight, with respect to the total toner particles.

Release Agent

Examples of the release agent include natural waxes such as a hydrocarbon-based wax; a carnauba wax, a rice wax, and a candelilla wax; synthetic or mineral/petroleum-based waxes such as a montan wax; and ester-based waxes such as a fatty acid ester and montanic ester. The release agent is not limited thereto.

The melting temperature of the release agent is preferably from 50° C. to 110° C., and more preferably from 60° C. to 100° C.

Further, the melting temperature is determined by the "melting peak temperature" described in a method for determining a melting temperature in "Testing methods for transition temperatures of plastics" of JIS K-1987 from a DSC curve obtained by means of differential scanning calorimetry (DSC).

The content of the release agent is, for example, preferably from 1% by weight to 20% by weight, and more preferably from 5% by weight to 15% by weight, with respect to the total toner particles.

Other Additives

Examples of the other additives include known additives such as a magnetic material, a charge-controlling agent, and an inorganic powder. These additives are contained in the toner particles as an internal additive.

Characteristics of Toner Particles

The toner particles may be toner particles having a single layer structure, or toner particles having a core/shell structure, which is constituted by a core (core particles) and a coating layer (shell layer) that is coated on the core.

Here, the toner particles having a core/shell structure are preferably constituted by, for example, a core including a binder resin, and if necessary, other additives such as a colorant and a release agent, and a coating layer including a binder resin.

The volume average particle size of the toner particles (D50) is, for example, preferably from 2 μm to 10 μm, and more preferably from 4 μm to 8 μm.

Further, various average particle sizes and various particle size distribution index of the toner particles are measured using a Coulter Multisizer II (manufactured by Beckman Coulter, Inc.), and ISOTON-II (manufactured by Beckman Coulter, Inc.) as an electrolytic solution.

In the measurement, 0.5 mg to 50 mg of a measurement sample is put into 2 mL of a 5% aqueous solution of a surfactant (which is preferably sodium alkylbenzenesulfonate), as a dispersant, and the mixture is then added to 100 mL to 150 mL of the electrolytic solution.

The electrolytic solution having the sample suspended therein is subjected to a dispersion treatment for 1 minute with an ultrasonic dispersing device, and the particle size distribution of the particles having a particle size in the range of from 2 μm to 60 μm is measured with the Coulter Multisizer II using an aperture having an aperture size of 100 μm. Further, the number of particles to be sampled is 50000.

A cumulative distribution is drawn from the smaller diameter side, with regard to the volume and the number thereof, according to a particle size range (channel) divided based on the particle size distribution measured, the particle size at a cumulative percentage of 16% is defined as the volume particle size D16v and the number particle size D16p, and the particle size at a cumulative percentage of 50% is defined as the volume average particle size D50v and the cumulative number average particle size D50p, and the particle size at a cumulative percentage of 84% is defined as the volume particle size D84v and the number particle size D84p.

Using them, the volume average particle size distribution index (GSDv) is calculated as $(D84v/D16v)^{1/2}$ and the number average particle size distribution index (GSDp) is calculated as $(D84p/D16p)^{1/2}$.

The shape factor SF1 of the toner particles is preferably from 110 to 150, and more preferably from 120 to 140.

Herein, the shape factor SF1 is determined by the following equation:

$$\text{Equation: } SF1=(ML^2/A)\times(\pi/4)\times 100$$

In the equation, ML represents the absolute maximum length of the toner and A represents the projected area of the toner.

Specifically, the shape factor SF1 is typically calculated by analyzing an image captured by a microscope or a scanning electron microscope (SEM) by means of an image analyzer to give a numerical value, for example, as described below. That is, the SF1 value may be obtained by inputting an optical microscopic image of particles scattered on the surface of a slide glass via a video camera into a LUZEX image analyzer, determining the maximum length and the projected area of 100 particles, calculating the values by the equation, and then averaging the values.

External Additive

The external additive contains zinc stearate. The external additive may contain other external additives, in addition to the zinc stearate particles.

The zinc stearate particles may be either particles containing zinc stearate alone or particles containing components other than zinc stearate. Examples of such the other component include higher fatty acid alcohols (for example, fatty acid alcohols having 10 to 20 carbon atoms). However, the zinc stearate particles contain 10% by weight or more of zinc stearate.

The number average particle size of the zinc stearate particles is, for example, preferably from 0.1 μm to 10 μm, more preferably from 0.3 μm to 6 μm, and still more preferably from 4 μm to 6 μm, from the viewpoint of exerting the functions as a lubricant.

The number average particle size of the zinc stearate particles is a value measured by a method shown below. First, 100 primary particles of zinc stearate particles after zinc stearate particles are externally added (dispersed) to toner particles are observed by an Scanning Electron Microscope (SEM) device. By the image analysis of the primary particles in the observed SEM image, the maximum diameter and the minimum diameter per particle are measured and from the intermediate value thereof, a sphere-equivalent diameter is measured. The 50% diameter (D50p) in the number-based cumulative frequency of the obtained sphere-equivalent diameter is taken as an average particle size (that is, the number average particle size) of the number average particle size of the zinc stearate particles.

The external addition amount of the zinc stearate particles is, for example, preferably from 0.01% by weight to 0.50% by weight, more preferably from 0.01% by weight to 0.20% by weight, and still more preferably from 0.015% by weight to 0.18% by weight, with respect to the toner particles.

Examples of the other external additive include inorganic particles, and examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surface of the inorganic particles as the other external additives may be preferably subjected to a hydrophobizing treatment. The hydrophobizing treatment is carried out by, for example, immersing inorganic particles in a hydrophobizing agent. The hydrophobizing agent is not particularly limited, but examples thereof include a silane-based coupling agent, a silicone oil, a titanate-based coupling agent, and an aluminum-based coupling agent. These may be used alone or in combination of two or more kinds thereof.

The amount of the hydrophobizing agent is usually, for example, from 1 part by weight to 10 parts by weight with respect to 100 parts by weight of the inorganic particles.

Examples of the external additives include resin particles (resin particles of polystyrene, PMMA, melamine resins, or the like), and cleaning activators (for example, particles of fluorine-based polymers other than zinc stearate particles).

The total external addition amount of the external additive is, for example, preferably from 0.01% by weight to 5% by weight, and more preferably from 0.01% by weight to 2.0% by weight, with respect to the toner particles.

Method for Preparing Toner

Next, a method for preparing a toner according to the present exemplary embodiment will be described.

The toner according to the present exemplary embodiment is obtained by preparing toner particles and then externally adding external additives with respect to the toner particles.

First, the toner particles may be prepared by any one of a dry preparation method (for example, a kneading and pulverizing method), a wet preparation method (for example, an aggregation and coalescence method, a suspension polymerization method, and a dissolution-suspension method). These preparation methods are not particularly limited, and known methods for preparing toner particles may be employed.

Furthermore, the toner according to the present exemplary embodiment is prepared, for example, by adding the external additive to the dried toner particles thus obtained and mixing them. The mixing is preferably carried out using, for example, a V blender, a Henschel mixer, a Loedige mixer, or the like. In addition and if desired, coarse particles of the toner may be removed using a vibrating classifier, a wind classifier, or the like.

Carrier

The carrier is not particularly limited and includes known carriers. Examples of the carrier include a coated carrier in which the surface of a core including magnetic powder is coated with a coating resin; a magnetic powder-dispersed carrier in which magnetic powder is dispersed and blended in a matrix resin; and a resin impregnated carrier in which porous magnetic powder is impregnated with a resin.

Further, the magnetic powder dispersed carrier and the resin impregnated carrier is a carrier in which the constituent particles of the carrier are used as a core, and are coated with a coating resin.

In the two-component developer, the mixing ratio (ratio by weight) between the toner and the carrier is as follows: preferably toner:carrier=1:100 to 30:100, and more preferably 3:100 to 20:100.

Cleaning Device

A device with a cleaning blade system which is provided with the cleaning blade 131 is used as the cleaning device 13.

Further, in addition to the cleaning blade system, a fur brush cleaning system or a system in which cleaning is carried out simultaneously with development is employed.

Transfer Device

Examples of the transfer device 40 include known transfer chargers such as a contact transfer charger that uses, for example, a belt, a roller, a film or a rubber blade; or a Scorotron transfer charger or Corotron transfer charger using corona discharge.

Intermediate Transfer Member

As the intermediate transfer member 50, a belt (intermediate transfer belt) including semiconductive polyimide, polyamideimide, polycarbonate, polyarylate, polyester, rubber or the like may be used. Further, as a form of the intermediate transfer member, those having a drum shape may be used in addition to those having a belt shape.

Figure 5:
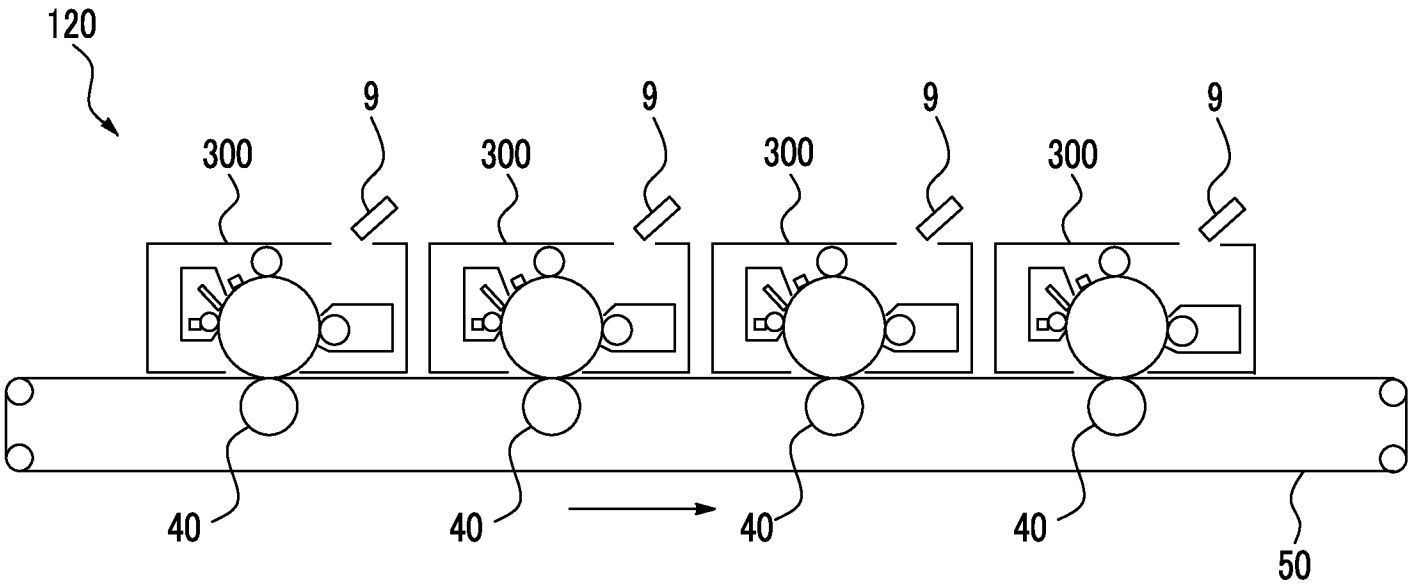
FIG. 5 is a schematic partial cross-sectional view showing another example of an image forming apparatus according to the present exemplary embodiment.

FIG. 5 is a schematic diagram showing another example of the image forming apparatus according to the present exemplary embodiment.

An image forming apparatus 120 shown in FIG. 5 is a tandem multicolor image forming apparatus having four process cartridges 300 installed therein. In the image forming apparatus 120, the four process cartridges 300 are disposed in parallel on an intermediate transfer member 50, and a configuration is employed in which one electrophotographic photoreceptor is used per color. The image forming apparatus 120 has the same configuration as the image forming apparatus 100, except that the image forming apparatus 120 has a tandem system.

In addition, the image forming apparatus (process cartridge) according to the present exemplary embodiment as described above is not limited to the above-described configuration, and a known configuration may be applied.

EXAMPLES

Hereinbelow, the invention will be described in more detail with reference to Examples, but the invention is not limited thereto.

Preparation of Electrophotographic Photoreceptor

Preparation of Electrophotographic Photoreceptor 1

Preparation of Undercoat Layer 100 parts by weight of zinc oxide (average particle size: 70 nm: manufactured by Tayca Corporation, specific surface area: 15 $m^2/g$) is stirred and mixed with 500 parts by weight of toluene, and 1.3 parts by weight of a silane coupling agent (KBM503: manufactured by Shin-Etsu Chemical Co., Ltd.) is added thereto, followed by stirring for 2 hours. Subsequently, toluene is removed by distillation under reduced pressure and the resultant is baked at a temperature of 120° C. for 3 hours to obtain zinc oxide surface-treated with the silane coupling agent.

110 parts by weight of the surface-treated zinc oxide is stirred and mixed with 500 parts by weight of tetrahydrofuran, into which a solution having 0.6 part by weight of alizarin dissolved in 50 parts by weight of tetrahydrofuran is added, followed by stirring at a temperature of 50° C. for 5 hours. Subsequently, the zinc oxide to which the alizarin is attached is collected by filtration under reduced pressure, and dried under reduced pressure at a temperature of 60° C. to obtain alizarin-attached zinc oxide.

38 parts by weight of a solution prepared by dissolving 60 parts by weight of the alizarin-attached zinc oxide, 13.5 parts by weight of a curing agent (blocked isocyanate, Sumidur 3175, manufactured by Sumitomo-Bayer Urethane Co., Ltd.) and 15 parts by weight of a butyral resin (S-Lec BM-1, manufactured by Sekisui Chemical Co., Ltd.) in 85 parts by weight of methyl ethyl ketone is mixed with 25 parts by weight of methyl ethyl ketone. The mixture is dispersed using a sand mill with glass beads having a diameter of 1 mmϕ for 2 hours to obtain a dispersion.

0.005 part by weight of dioctyltin dilaurate as a catalyst, and 40 parts by weight of silicone resin particles (Tospal 145, manufactured by GE Toshiba Silicone Co., Ltd.) are added to the obtained dispersion to obtain a coating liquid for forming an undercoat layer.

An undercoat layer having a thickness of 18.7 μm is obtained by coating the coating liquid for forming an undercoat layer thus obtained on a cylindrical aluminum substrate having a diameter of 30 am, a length of 340 mm and a thickness of 1 mm prepared as a conductive substrate by dipping coating, and carrying out drying and curing at a temperature of 170° C. for 40 minutes.

Preparation of Charge Generation Layer

A mixture including 15 parts by weight of hydroxygallium phthalocyanine having the diffraction peaks at Bragg angles (2θ±0.2°) of at least 7.3°, 16.0 °, 24.9°, and 28.0° in an X-ray diffraction spectrum of Cukα characteristic X rays as a charge generating substance, 10 parts by weight of a vinyl chloride-vinyl acetate copolymer resin (VMCH, manufactured by Nippon Unicar Co., Ltd.) as a binder resin, and 200 parts by weight of n-butyl acetate is dispersed using a sand mill with the glass beads having a diameter of 1 mmϕ for 4 hours. 175 parts by weight of n-butyl acetate and 180 parts by weight of methyl ethyl ketone are added to the obtained dispersion, followed by stirring, to obtain a coating liquid for forming a charge generation layer.

The obtained coating liquid for forming a charge generation layer is dip-coated on the undercoat layer formed in advance on the cylindrical aluminum substrate, and dried at room temperature (25° C.) to form a charge generation layer having a film thickness of 0.2 μm.

Preparation of Charge Transport Layer 45 parts by weight of a compound (d-1) as a non-reactive charge transport material, and 55 parts by weight of a compound (C-1) as a binder resin are added to and dissolved in 560 parts by weight of tetrahydrofuran and 240 parts by weight of toluene to obtain a coating liquid for a charge transport layer. This coating liquid is coated on the charge generation layer and dried at 135° C. for 45 minutes to form a charge transport layer having a film thickness of 25 μm.

Preparation of Protective Layer

Next, 5 parts by weight of LUBRON L2 (manufactured by Daikin Industries, Ltd.) and 0.2 part by weight of a fluorinated graft polymer (ARON GF300: manufactured by Toagosei Co., Ltd.) are repeatedly subjected to a 10-minute dispersion treatment three times with 300 parts by weight of a mixed solvent of THF/isobutyl acetate (ratio by weight of 7:3), using an ultrasonic homogenizer (manufactured by Nihonseiki Kaisha Ltd.) in a thermostat vessel at 20° C. to obtain a suspension. 100 parts by weight of a compound (a-1) as a reactive charge transport material and 2 parts by weight of VE-073 (manufactured by Wako Pure Chemical Industries, Ltd.) as a polymerization initiator are added to the suspension, followed by stirring and mixing them at room temperature (25° C.) for 12 hours, to obtain a coating liquid for forming a protective layer.

Next, the obtained coating liquid is coated on the charge transport layer previously formed on the cylindrical aluminum substrate at a push-up rate of 150 mm/min by a ring coating method. Thereafter, a curing reaction is carried out at a temperature of 160±5° C. for 60 minutes in the state where an oxygen concentration is 200 ppm or less in a nitrogen dryer having an oxygen concentration meter to form a protective layer. The film thickness of the protective layer is 7 μm.

Through the processes as described above, an electrophotographic photoreceptor is obtained.

Preparation of Electrophotographic Photoreceptors 1 to 51

By the method described in the electrophotographic photoreceptor 1, electrophotographic photoreceptors are formed by coating an undercoat layer and charge generation layer sequentially onto a cylindrical aluminum substrate. Thereafter, by the method described in the electrophotographic photoreceptor 1 except that the compositions of the coating liquid for forming a charge transport layer (the kinds and amounts of the binder resin and the non-reactive charge transport material), and the coating liquid for forming a protective layer (the kinds and amounts of the reactive charge transport material and the non-reactive charge transport material) are changed according to Tables 1 to 3, a protective layer is formed and an electrophotographic photoreceptor is prepared.

Preparation of Developer

Preparation of Resin Particle Dispersion 370 parts by weight of styrene, 30 parts by weight of n-butyl acrylate, 8 parts by weight of acrylic acid, 24 parts by weight of dodecanethiol, and 4 parts by weight of carbon tetrabromide are mixed and dissolved. The obtained solution is subjected to emulsion polymerization in a flask in which 6 g of a non-ionic surfactant (Nonipol 400: manufactured by Sanyo Chemical Industries, Ltd.) and 10 parts by weight of an anionic surfactant (Neogen SC: manufactured by Daiichi Kogyo Seiyaku Co., Ltd.) are dissolved in 550 parts by weight of ion exchange water. While this is slowly mixed for 10 minutes, 50 parts by weight of ion exchange water having 4 parts by weight of ammonium persulfate dissolved therein is put thereinto. After purging with nitrogen, the inside of the flask is stirred and the contents are heated in an oil bath up to 70° C. The emulsion polymerization is continued as it is for 5 hours. As a result, a resin particle dispersion in which resin particles having a volume average particle size D50v=150 nm, a glass transition temperature Tg=58° C., and a weight average molecular weight Mw=11500 are dispersed is obtained. The solid content concentration of this dispersion is 40% by weight.

Preparation of Colorant Particle Dispersion (1)

Carbon black (Mogaru L: manufactured by Cabot Corporation): 60 parts by weight

Non-ionic surfactant (Nonipol 400: manufactured by Sanyo Chemical Industries, Ltd.): 6 parts by weight Ion exchange water: 240 parts by weight The above-described components are mixed, dissolved, and stirred for 10 minutes using a homogenizer (ULTRA-TURRAX T50: manufactured by IKA Works Inc.), and then subjected to a dispersion treatment with an ultimizer to prepare a colorant particle dispersion (1) in which colorant (carbon black) particles having a volume average particle size of 250 nm are dispersed.

Preparation of Colorant Particle Dispersion (2)

Cyan pigment B 15:3: 60 parts by weight

Non-ionic surfactant (Nonipol 400: manufactured by Sanyo Chemical Industries, Ltd.): 5 parts by weight Ion exchange water: 240 parts by weight The above-described components are mixed, dissolved, and stirred for 10 minutes using a homogenizer (ULTRA-TURRAX T50: manufactured by IKA Works Inc.), and then subjected to a dispersion treatment with an ultimizer to prepare a colorant particle dispersion (2) in which colorant (Cyan pigment) particles having a volume average particle size of 250 nm are dispersed.

Preparation of Colorant Particle Dispersion (3)

Magenta pigment R122: 60 parts by weight

Non-ionic surfactant (Nonipol 400: manufactured by Sanyo Chemical Industries, Ltd.): 5 parts by weight Ion exchange water: 240 parts by weight The above-described components are mixed, dissolved, and stirred for 10 minutes using a homogenizer (ULTRA-TURRAX T50: manufactured by IKA Works Inc.), and then subjected to a dispersion treatment with an ultimizer to prepare a colorant particle dispersion (3) in which colorant (Magenta pigment) particles having a volume average particle size of 250 nm are dispersed.

Preparation of Colorant Particle Dispersion (4)

Yellow pigment Y180: 90 parts by weight

Non-ionic surfactant (Nonipol 400: manufactured by Sanyo Chemical Industries, Ltd.): 5 parts by weight Ion exchange water: 240 parts by weight The above-described components are mixed, dissolved, and stirred for 10 minutes using a homogenizer (ULTRA-TURRAX T50: manufactured by IKA Works Inc.), and then subjected to a dispersion treatment with an ultimizer to prepare a colorant particle dispersion (4) in which colorant (Yellow pigment) particles having a volume average particle size of 250 nm are dispersed.

Release Agent Particle Dispersion

Paraffin wax (RNP0190: manufactured by Nippon Seiro Co., Ltd., melting temperature 85° C.): 100 parts by weight Cationic surfactant (SANISOL B50: manufactured by Kao Corporation): 5 parts by weight Ion exchange water: 240 parts by weight The above-described components are dispersed for 10 minutes using a homogenizer (ULTRA-TURRAX T50: manufactured by IKA Works Inc.) in a round-shaped stainless steel flask, and then subjected to a dispersion treatment with a pressure discharge type homogenizer to prepare a release agent particle dispersion in which release agent particles having a volume average particle size of 550 nm are dispersed.

Preparation of Toner K1

Resin particle dispersion: 234 parts by weight

Colorant particle dispersion (1): 30 parts by weight

Release agent particle dispersion: 40 parts by weight

Poly(aluminum hydroxide) (Paho2S: manufactured by Asada Chemical Co.): 0.5 part by weight Ion exchange water: 600 parts by weight The above-described components are mixed and dispersed using a homogenizer (ULTRA-TURRAX T50: manufactured by IKA Works Inc.) in a round-shaped stainless steel flask, and the inside of the flask is heated to 40° C. in an oil bath for heating while being stirred. After keeping the mixture at 40° C. for 30 minutes, it is confirmed that an aggregate particle having a D50 of 4.5 μm is produced. Further, when the temperature of the oil bath for heating is raised and the mix solution is kept at 56° C. for one hour, the D50v becomes 5.3 μm. Then, after 26 parts by weight of the resin particle dispersion is added to the dispersion containing the flocculation particle, the mixture is heated to and kept at 50° C. for 30 minutes using the oil bath for heating. 1 N sodium hydroxide is added to the dispersion containing the aggregate particle to adjust the pH of the system at 7.0, and then the stainless steel flask is sealed and heated to 80° C. while continuing the stirring using a magnetic seal and kept for 4 hours. After cooling, the toner particles are separated by filtration, washed four times with ion exchange water, and freeze-dried to obtain toner particle K1. The D50v of the toner particle K1 is 5.9 μm, and the shape factor SF1 is 132.

Next, with respect to 100 parts by weight of the toner particle K1, 1 part by weight of rutile type titanium oxide (volume average particle size of 20 nm, surface-treated with n-decyltrimethoxysilane), 2.0 parts by weight of silica particles (volume average particle size of 40 nm, surface-treated with silicone oil, and prepared by a gas phase oxidation process), and 1 part by weight of cerium oxide particles (volume average particle size of 0.7 μm), and 0.3 part by weight of zinc stearate particles (particles obtained by pulverizing a mixture obtained by mixing tridecylalcohol having a molecular weight of 700 and zinc stearate at a weight ratio of 5:1 by a jet mill to give a number average particle size of 8.0 μm) are mixed by a 5-L Henschel mixer at a peripheral speed of 30 m/s for 15 minutes. Then, coarse particles are removed using a sieve having a 45-μm mesh to obtain a toner 1.

Preparation of Toner C1

In the same manner as for the toner particle K1 except that the colorant particle dispersion (2) is used instead of the colorant particle dispersion (1), a toner particle C1 is obtained. The D50v of the toner particle C1 is 5.8 μm and the shape factor SF1 is 131.

In addition, in the same manner as for the toner K1 except that the toner particle C1 is used instead of the toner particle K1, a toner C1 is obtained.

Preparation of Toner M1

In the same manner as for K1 except that the colorant particle dispersion (3) is used instead of the colorant particle dispersion (1), a toner particle M1 is obtained. The D50v of the toner particle M1 is 5.5 μm and the shape factor SF1 is 135.

In addition, in the same manner as for the toner K1 except that the toner particle M1 is used instead of the toner particle K1, a toner M1 is obtained.

Preparation of Toner Y1

In the same manner as for K1 except that the colorant particle dispersion (4) is used instead of the colorant particle dispersion (1), a toner particle Y1 is obtained. The D50v of the toner particle Y1 is 5.9 μm and the shape factor SF1 is 130.

In addition, in the same manner as for the toner K1 except that the toner particle Y1 is used instead of the toner particle K1, a toner Y1 is obtained.

Preparation of Carrier

Ferrite particles (volume average particle size: 50 μm): 100 parts by weight

Toluene: 14 parts by weight

Styrene/methacrylate copolymer (component ratio: 90/10): 2 parts by weight

Carbon black (R330: manufactured by Cabot Corporation): 0.2 part by weight

First, the components except for the ferrite particles are stirred for 10 minutes by a stirrer to prepare a dispersed coating solution. Next, the coating solution and the ferrite particles are put into a vacuum degassing type kneader, the mixture is stirred at 60° C. for 30 minutes, degassed under reduced pressure while being heated, and dried to obtain a carrier. The volume inherent resistance value at an applied electric field of 1000 V/cm of the carrier is $10^{11}$ Ωcm.

Preparation of Developers K1, C1, M1, and Y1

100 parts by weight of the carrier is mixed with 5 parts by weight of each of the toners K1, C1, M1, and Y1, and the mixture is stirred for 20 minutes at 40 rpm using a V blender and sieved with a 212-μm mesh to prepare each of developers K1, C1, M1, and Y1.

Examples 1 to 40 and Comparative Examples 1 to 11

The electrophotographic photoreceptor and the developer, thus prepared, are installed in DocuCentre Color 400 CP (manufactured by Fuji Xerox Co., Ltd.), and 5000 sheets of black solid images having an image density of 100% are printed on full paper under a normal environment (20° C., 50% RH). Further, by this image formation, zinc stearate-coated electrophotographic photoreceptors are taken as the electrophotographic photoreceptors of the respective Examples and the respective Comparative Examples.

Measurement and Evaluation

The electrophotographic photoreceptors of the respective Examples and Comparative Examples are measured and evaluated as follows. The results are shown in Tables 1 to 3.

Various Measurements

Measurement of Oxygen Permeability Coefficient

The oxygen permeability coefficient of the protective layer (the protective layer before coating with zinc stearate) of the electrophotographic photoreceptor of each Example and Comparative Example is measured as follows.

Under the same condition as the condition for forming the protective layer of the electrophotographic photoreceptor of each Example and Comparative Example, separately, a sample film having a thickness of 15 μm for measuring an oxygen permeability coefficient is formed. Further, by a gas permeability measuring device (MC3 manufactured by Toyo Seiki Kogyo Co., Ltd.), the oxygen permeability coefficient of the sample film at 25° C. is measured.

Measurement of Zinc Stearate Coverage

The zinc stearate coverage of the surface of the electrophotographic photoreceptor (the surface of the protective layer) of each Example and Comparative Example is measured as follows.

The zinc stearate coverage is determined based on the value of the ratio of zinc to all the elements, as measured by an X-ray photoelectron spectrophotometer JPS-9010 (manufactured by JEOL Ltd.). Since the X-ray photoelectron spectrophotometry (XPS) is for analysis of the outermost surface of the electrophotographic photoreceptor, the value of a ratio of zinc to all the elements for the increase in the zinc stearate coating amount is saturated. By taking the saturated value of the ratio of zinc to all the elements as a coverage 100%, the zinc stearate coverage of the electrophotographic photoreceptor surface is determined.

Various Evaluations

Conducting Image Formation 1

The electrophotographic photoreceptor and the developer of each Example and Comparative Example are installed in DocuCentre Color 400 CP (manufactured by Fuji Xerox Co., Ltd.), and a solid coating image portion with an image density of 100%, a halftone image portion with an image density of 10%, and an image evaluation pattern having a fine line image portion are output under a normal environment (20° C., 50% RH). Thereafter, 30000 sheets of a black solid image are continuously output, and then an image evaluation pattern is output again. Further, the light dose is adjusted using a filter, depending on the sensitivity of a charge generating material.

Evaluation of Stability in Electrical Characteristics

Before and after carrying out the image formation 1, the electrophotographic photoreceptor of each Example and Comparative Example is negatively charged with a Scorotron charger while applying −700 V to a grid under a normal environment (20° C., 50% RH), and the charged photoreceptor is then subjected to flash exposure at a light dose of 10 mJ/m$^2$ using a 780-nm semiconductor laser. Ten seconds after the exposure, the potential (V) at the surface of the photoreceptor is measured and the value is employed as a value of the residual potential. In any of the photoreceptors, the residual potential shows a negative value. In each photoreceptor, the value of (residual potential before the image formation 1 is carried out)−(residual potential after the image formation 1 is carried out) is calculated, and the stability in electrical characteristics is evaluated. A++ indicates the best characteristics.

A++: Less than 10 V

A+: 10 V or more and less than 20 V

A: 20 V or more and less than 30 V

B: 30 V or more and less than 50 V

C: 50 V or more

Evaluation of Scratch Resistance

The degree of generation of scratch on the photoreceptor surface after carrying out the image formation 1 is evaluated as follows. A++ indicates the best characteristics.

A++: Scratch is not found even with observation by a microscope.

A+: Scratch is not found with the naked eye, but slight scratch is found with observation by a microscope.

A: Slight scratch is found with the naked eye (not problematic in practical use).

B: Scratch is partially generated.

C: Scratch is fully generated.

Blade Turned-Up

The cleaning blade is brought into contact with the electrophotographic photoreceptor after carrying out the image formation 1 under the condition shown below, and the contact state of the cleaning blade (whether the blade is turned-up or not) after the photoreceptor is rotated 30 times is observed with the naked eye to carry out evaluation of the blade turned-up on the basis of the following criteria.

Materials for blade: Urethane rubber

Elastic force of blade: 53%

Pressurization pressure: 3.2 g/mm

TABLE 1

| | | Composition of protective layer | | | | Composition of charge transport layer | | | | Measurement and evaluation results | | | | |
|---|---|---|---|---|---|---|---|---|---|---|---|---|---|---|
| | Photo-recep-tor | Reactive charge transport materials | | Non-reactive charge transport materials | | Binder resin | | Non-reactive charge transport materials | | Oxygen permeability coefficient [×10$^{12}$ fm$^2$/ | Zinc stearate cov-erage | Stability in elec-trical character- | Scratch resis- | Blade |
| | No. | Kind | Parts | Kind | Parts | Kind | Parts | Kind | Parts | Pa · s] | [%] | istics | tance | turned-up |
| Example 1 | 1 | a-1 | 100 | — | 0 | c-1 | 55 | d-1 | 45 | 6.56 | 53.4 | A++ | A++ | Not generated |
| Example 2 | 2 | a-2 | 100 | — | 0 | c-1 | 55 | d-1 | 50 | 6.23 | 51.5 | A++ | A++ | Not generated |
| Example 3 | 3 | a-3 | 100 | — | 0 | c-1 | 55 | d-1 | 50 | 6.41 | 48.3 | A++ | A++ | Not generated |
| Example 4 | 4 | a-4 | 100 | — | 0 | c-1 | 55 | d-1 | 50 | 5.33 | 35.4 | A+ | A+ | Not generated |
| Example 5 | 5 | a-5 | 100 | — | 0 | c-1 | 55 | d-1 | 50 | 5.01 | 30.2 | A+ | A+ | Not generated |
| Example 6 | 6 | a-6 | 100 | — | 0 | c-1 | 55 | d-1 | 50 | 4.78 | 33.4 | A+ | A+ | Not generated |
| Example 7 | 7 | a-7 | 100 | — | 0 | c-1 | 55 | d-1 | 50 | 2.32 | 5.05 | A | A | Not generated |
| Example 8 | 8 | a-8 | 100 | — | 0 | c-1 | 55 | d-1 | 50 | 2.56 | 6.00 | A | A | Not generated |
| Example 9 | 9 | a-9 | 100 | — | 0 | c-1 | 55 | d-1 | 50 | 2.22 | 5.32 | A | A | Not generated |
| Example 10 | 10 | a-16 | 100 | — | 0 | c-1 | 55 | d-1 | 45 | 4.88 | 33.4 | A+ | A+ | Not generated |
| Example 11 | 11 | a-17 | 100 | — | 0 | c-1 | 55 | d-1 | 45 | 2.56 | 5.05 | A | A | Not generated |

TABLE 1-continued

| | Photo-recep-tor | Composition of protective layer: Reactive charge transport materials | | Composition of protective layer: Non-reactive charge transport materials | | Composition of charge transport layer: Binder resin | | Composition of charge transport layer: Non-reactive charge transport materials | | Measurement and evaluation results: Oxygen permeability coefficient [$\times 10^{12}$ fm$^2$/Pa · s] | Zinc stearate cov-erage [%] | Stability in elec-trical character-istics | Scratch resis-tance | Blade turned-up |
|---|---|---|---|---|---|---|---|---|---|---|---|---|---|---|
| | No. | Kind | Parts | Kind | Parts | Kind | Parts | Kind | Parts | | | | | |
| Example 12 | 12 | a-18 | 100 | — | 0 | c-1 | 55 | d-1 | 45 | 2.87 | 5.55 | A | A | Not generated |
| Example 13 | 13 | a-19 | 100 | — | 0 | c-1 | 55 | d-1 | 45 | 2.14 | 6.05 | A | A | Not generated |
| Example 14 | 14 | a-20 | 100 | — | 0 | c-1 | 55 | d-1 | 45 | 5.33 | 36.7 | A+ | A+ | Not generated |
| Example 15 | 15 | a-21 | 100 | — | 0 | c-1 | 55 | d-1 | 45 | 10.23 | 79.8 | A++ | A++ | Not generated |
| Example 16 | 16 | a-22 | 100 | — | 0 | c-1 | 55 | d-1 | 45 | 10.51 | 75.6 | A++ | A++ | Not generated |
| Example 17 | 17 | a-23 | 100 | — | 0 | c-1 | 55 | d-1 | 45 | 9.89 | 77.8 | A++ | A++ | Not generated |
| Example 18 | 18 | a-24 | 100 | — | 0 | c-1 | 55 | d-1 | 45 | 9.05 | 77.2 | A++ | A++ | Not generated |

TABLE 2

| | Photo-recep-tor | Composition of protective layer: Reactive charge transport materials | | Composition of protective layer: Non-reactive charge transport materials | | Composition of charge transport layer: Binder resin | | Composition of charge transport layer: Non-reactive charge transport materials | | Measurement and evaluation results: Oxygen permeability coefficient ($\times 10^{12}$ fm$^2$/Pa · s] | Zinc stearate cov-erage [%] | Stability in elec-trical character-istics | Scratch resis-tance | Blade turned-up |
|---|---|---|---|---|---|---|---|---|---|---|---|---|---|---|
| | No. | Kind | Parts | Kind | Parts | Kind | Parts | Kind | Parts | | | | | |
| Example 19 | 19 | a-1 | 80 | a-10 | 20 | c-1 | 55 | d-1 | 50 | 6.00 | 50.0 | A++ | A+ | Not generated |
| Example 20 | 20 | a-2 | 80 | a-10 | 20 | c-1 | 55 | d-1 | 50 | 6.34 | 52.1 | A++ | A+ | Not generated |
| Example 21 | 21 | a-3 | 80 | a-10 | 20 | c-1 | 55 | d-1 | 50 | 6.33 | 52.4 | A++ | A+ | Not generated |
| Example 22 | 22 | a-4 | 80 | a-10 | 20 | c-1 | 55 | d-1 | 50 | 7.21 | 40.3 | A+ | A++ | Not generated |
| Example 23 | 23 | a-5 | 80 | a-10 | 20 | c-1 | 55 | d-1 | 50 | 8.50 | 45.2 | A+ | A++ | Not generated |
| Example 24 | 24 | a-6 | 80 | a-10 | 20 | c-1 | 55 | d-1 | 50 | 7.56 | 43.1 | A+ | A++ | Not generated |
| Example 25 | 25 | a-7 | 80 | a-10 | 20 | c-1 | 55 | d-1 | 50 | 5.23 | 20.3 | A | A+ | Not generated |
| Example 26 | 26 | a-8 | 80 | a-10 | 20 | c-1 | 55 | d-1 | 50 | 4.55 | 15.3 | A | A+ | Not generated |
| Example 27 | 27 | a-9 | 80 | a-10 | 20 | c-1 | 55 | d-1 | 50 | 4.80 | 18.4 | A | A+ | Not generated |
| Example 28 | 23 | a-8 | 50 | a-10 | 50 | c-1 | 55 | d-1 | 50 | 20.56 | 85.5 | B | B | Not generated |
| Example 29 | 29 | a-1 | 100 | — | 0 | c-1 | 55 | d-1 | 50 | 6.50 | 50.2 | A++ | A++ | Not generated |
| Example 30 | 30 | a-1 | 100 | — | 0 | c-2 | 55 | d-1 | 50 | 6.23 | 51.4 | A++ | A++ | Not generated |
| Example 31 | 31 | a-1 | 100 | — | 0 | c-3 | 55 | d-1 | 50 | 6.55 | 51.5 | A++ | A++ | Not generated |
| Example 32 | 32 | a-1 | 100 | — | 0 | c-4 | 55 | d-1 | 50 | 6.31 | 51.3 | A++ | A++ | Not generated |
| Example 33 | 33 | a-1 | 100 | — | 0 | c-5 | 55 | d-1 | 50 | 6.04 | 51.4 | A++ | A++ | Not generated |
| Example 34 | 34 | a-1 | 100 | — | 0 | c-6 | 55 | d-1 | 50 | 6.25 | 50.2 | A++ | A++ | Not generated |
| Example 35 | 35 | a-1 | 100 | — | 0 | c-7 | 55 | d-1 | 50 | 6.15 | 48.5 | A++ | A++ | Not generated |
| Example 36 | 36 | a-1 | 100 | — | 0 | c-8 | 55 | d-1 | 50 | 6.00 | 49.5 | A++ | A++ | Not generated |
| Example 37 | 37 | a-1 | 100 | — | 0 | c-9 | 55 | d-1 | 50 | 5.85 | 51.0 | A++ | A++ | Not generated |
| Example 38 | 38 | a-1 | 100 | — | 0 | c-1 | 55 | d-2 | 50 | 6.53 | 52.3 | A++ | A++ | Not generated |
| Example 39 | 39 | a-1 | 100 | — | 0 | c-1 | 55 | d-3 | 50 | 6.25 | 51.4 | A++ | A++ | Not generated |
| Example 40 | 40 | a-1 | 100 | — | 0 | c-1 | 55 | d-4 | 50 | 6.05 | 50.8 | A++ | A++ | Not generated |

TABLE 3

| | Photo-recep-tor | Composition of protective layer: Reactive charge transport materials | | Composition of protective layer: Non-reactive charge transport materials | | Composition of charge transport layer: Binder resin | | Composition of charge transport layer: Non-reactive charge transport materials | | Measurement and evaluation results: Oxygen permeability coefficient ($\times 10^{12}$ fm$^2$/Pa · s] | Zinc stearate cov-erage [%] | Stability in elec-trical character-istics | Scratch resis-tance | Blade turned-up |
|---|---|---|---|---|---|---|---|---|---|---|---|---|---|---|
| | No. | Kind | Parts | Kind | Parts | Kind | Parts | Kind | Parts | | | | | |
| Comparative Example 1 | 41 | a-11 | 100 | — | 0 | c-1 | 55 | d-1 | 45 | 1.23 | 5.30 | C | B | Generated |
| Comparative Example 2 | 42 | a-11 | 80 | a-10 | 20 | c-1 | 55 | d-1 | 50 | 2.51 | 4.35 | B | C | Generated |
| Comparative Example 3 | 43 | a-1 | 100 | — | 0 | c-7 | 55 | d-1 | 50 | 1.85 | 5.43 | C | C | Generated |
| Comparative Example 4 | 44 | a-1 | 80 | a-10 | 20 | c-7 | 55 | d-1 | 50 | 2.15 | 4.53 | B | C | Generated |
| Comparative Example 5 | 45 | a-12 | 100 | — | 0 | c-1 | 55 | d-1 | 50 | 1.50 | 3.25 | D | C | Generated |

TABLE 3-continued

| | Photo-recep-tor | Composition of protective layer | | | | Composition of charge transport layer | | | | Measurement and evaluation results | | | | |
|---|---|---|---|---|---|---|---|---|---|---|---|---|---|---|
| | | Reactive charge transport materials | | Non-reactive charge transport materials | | Binder resin | | Non-reactive charge transport materials | | Oxygen permeability coefficient ($\times 10^{12}$ fm$^2$/Pa · s] | Zinc stearate cov-erage [%] | Stability in elec-trical character-istics | Scratch resis-tance | Blade turned-up |
| | No. | Kind | Parts | Kind | Parts | Kind | Parts | Kind | Parts | | | | | |
| Comparative Example 6 | 46 | a-13 | 100 | — | 0 | c-1 | 55 | d-1 | 50 | 1.23 | 5.03 | C | B | Generated |
| Comparative Example 7 | 47 | a-13 | 80 | a-10 | 20 | c-1 | 55 | d-1 | 50 | 2.44 | 4.44 | B | C | Generated |
| Comparative Example 8 | 48 | a-14 | 100 | — | 0 | c-1 | 55 | d-1 | 50 | 1.25 | 5.10 | C | B | Generated |
| Comparative Example 9 | 49 | a-14 | 80 | a-10 | 20 | c-1 | 55 | d-1 | 50 | 2.35 | 4.67 | B | C | Generated |
| Comparative Example 10 | 50 | a-15 | 100 | — | 0 | c-1 | 55 | d-1 | 50 | 1.45 | 5.20 | C | B | Generated |
| Comparative Example 11 | 51 | a-15 | 80 | a-10 | 20 | c-1 | 55 | d-1 | 50 | 2.22 | 4.56 | B | C | Generated |

From the results above, in the present Examples, it is found that good results are obtained for the evaluation of stability in electrical characteristics and scratch resistance, as compared with Comparative Examples.

In addition, in the present Examples, it is found that good results are obtained for the evaluation of blade turned-up, as compared with Comparative Examples.

Hereinafter, the details of the abbreviations or the like in Tables 1 and 2 are shown.

[Charge Transport Materials in Protective Layer]

(a-1): Exemplary compound (I-b)-21
(a-2): Exemplary compound (I-b)-23
(a-3): Exemplary compound (I-b)-25
(a-4): Exemplary compound (I-d)-7
(a-5): Exemplary compound (I-d)-8
(a-6): Exemplary compound (I-d)-10
(a-7): Exemplary compound (II)-171
(a-8): Exemplary compound (II)-176
(a-9): Exemplary compound (II)-180
(a-10): Compound represented by the following structural formula
(a-11): Compound represented by the following structural formula
(a-12): Compound represented by the following structural formula
(a-13): Compound represented by the following structural formula
(a-14): Compound represented by the following structural formula
(a-15): Compound represented by the following structural formula
(a-16): Exemplary compound (I-a)-21
(a-17): Exemplary compound (I-a)-25
(a-18): Exemplary compound (I-c)-11
(a-19): Exemplary compound (I-c)-17
(a-20): Exemplary compound (I-c)-121
(a-21): Exemplary compound (II)-35
(a-22): Exemplary compound (II)-187
(a-23): Exemplary compound (II)-38
(a-24): Exemplary compound (II)-184

(a-10)

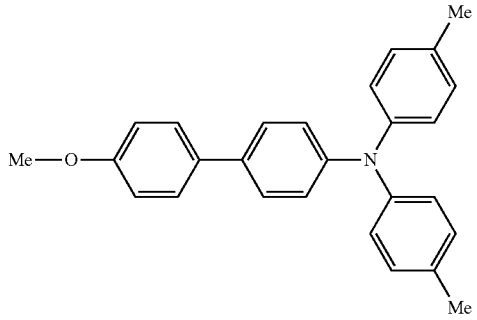

(a-11)

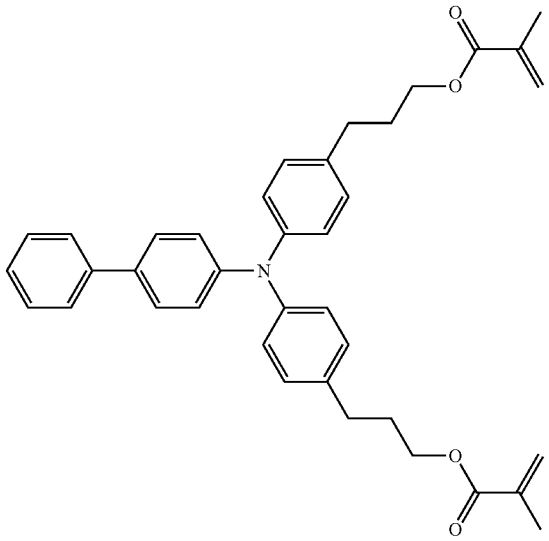

-continued
(a-12)
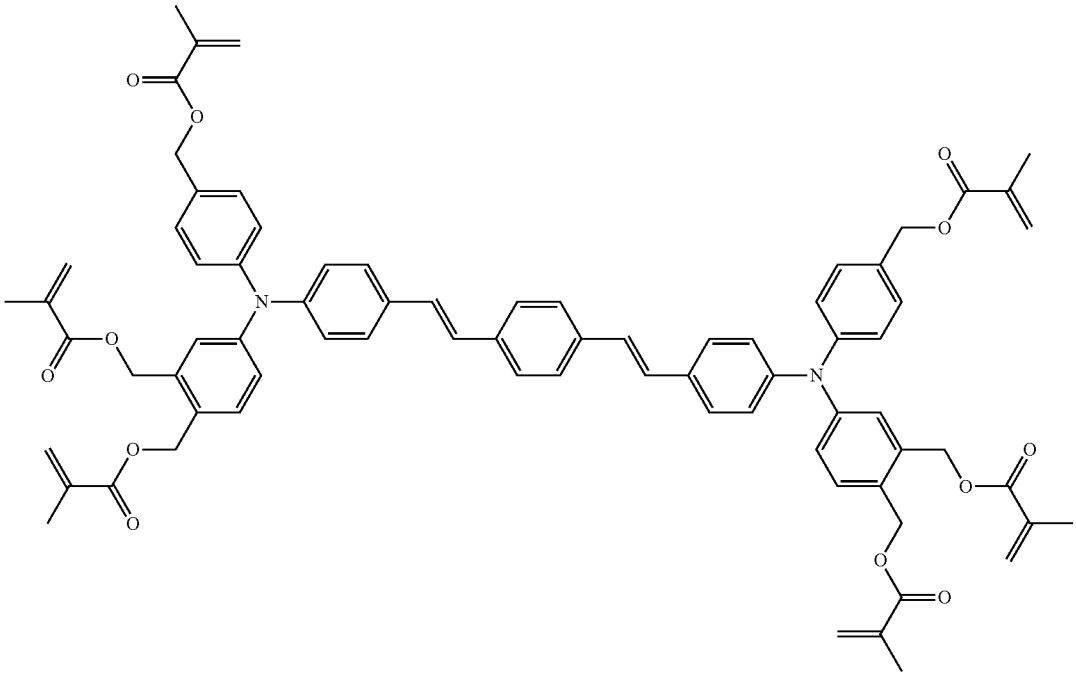
(a-13)
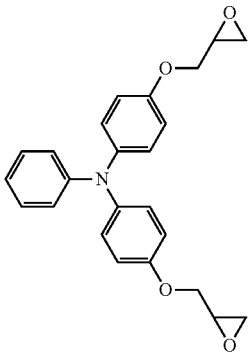
(a-14)
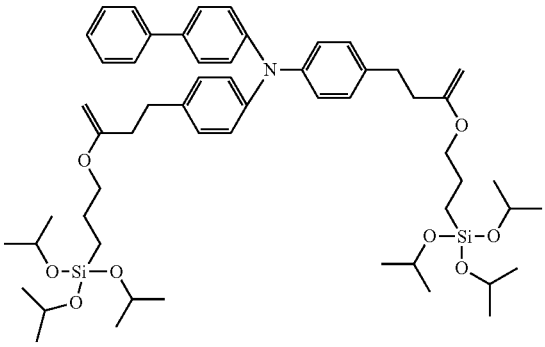
(a-15)
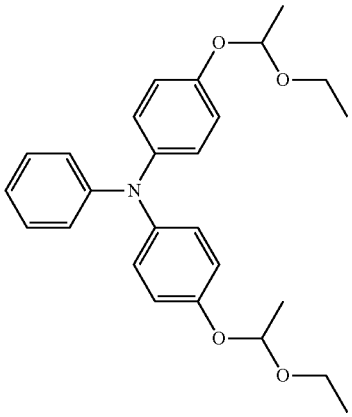

Binder Resin in Charge Transport Layer

Binder resins (C-1) to (C-9) (polycarbonate copolymers) are synthesized by the following preparation process.

Synthesis of Binder Resin C-1

In a flask equipped with a phosgene inlet tube, a thermometer, and a stirrer, 106.9 g (0.398 mole) of 1,1-bis(4-hydroxyphenyl)cyclohexane (hereinafter referred to as Z), 24.7 g (0.133 mole) of 4,4'-dihydroxybiphenyl (hereinafter referred to as BP), 0.41 g of hydrosulfite, 825 ml (sodium hydroxide 2.018 moles) of a 9.1% sodium hydroxide aqueous solution, and 500 ml of methylene chloride are combined and dissolved under a nitrogen atmosphere, maintained at from 18° C. to 21° C. while stirring, and 76.2 g (0.770 mole) of phosgene is introduced thereinto over 75 minutes to perform a phosgenation reaction. After the end of the phosgenation reaction, 1.11 g (0.0075 mole) of p-tert-butylphenol and 54 ml (sodium hydroxide 0.266 mole) of a 25% sodium hydroxide aqueous solution are added thereto, followed by stirring, and 0.18 mL (0.0013 mole) of triethylamine is added thereto to perform a reaction at a temperature of from 30° C. to 35° C. for 2.5 hours.

The separated methylene chloride phase is washed with an acid and water until the inorganic salts and the amines disappear, and then methylene chloride is removed to obtain a binder resin (C−1) (polycarbonate copolymer). The binder resin (C-1) [polycarbonate copolymer] has a ratio of the structural units of Z ((Z)-0) to BP ((BP)-0) of 75:25 in terms of a molar ratio.

Synthesis of Binder Resins (C-2) to (C-9)

In addition, the binder resins (C-2) to (C-9) are synthesized in the same manner as for the binder resin (C-1), except that the monomers used are changed such that they have the repeating structural units (denoted as "units" in Tables) according to Table 4.

TABLE 4

| Binder resin of charge transport layer | | | | | | | | | | | |
|---|---|---|---|---|---|---|---|---|---|---|---|
| Binder resin | | | | | | | | | | | |
| | | Viscosity average | Unit 1 | | | Unit 2 | | | Unit 3 | | |
| No. | Solubility parameter | molecular weight | Kind | Molar ratio | Solubility parameter | Kind | Molar ratio | Solubility parameter | Kind | Molar ratio | Solubility parameter |
| C-1 | 11.56 | 50,000 | (Z)-0 | 75 | 11.28 | (BP)-0 | 25 | 12.39 | — | — | — |
| C-2 | 11.67 | 50,000 | (Z)-0 | 65 | 11.28 | (BP)-0 | 35 | 12.39 | — | — | — |
| C-3 | 11.46 | 50,000 | (Z)-0 | 80 | 11.28 | (BP)-0 | 10 | 12.39 | (F)-0 | 10 | 12.02 |
| C-4 | 11.44 | 50,000 | (Z)-0 | 85 | 11.28 | (BP)-0 | 15 | 12.39 | — | — | — |
| C-5 | 11.52 | 50,000 | (Z)-0 | 70 | 11.28 | (BP)-1 | 30 | 12.07 | — | — | — |
| C-6 | 11.65 | 50,000 | (Z)-0 | 50 | 11.28 | (F)-0 | 50 | 12.02 | — | — | — |
| C-7 | 11.33 | 50,000 | (Z)-0 | 95 | 11.28 | (BP)-0 | 5 | 12.39 | — | — | — |
| C-8 | 11.79 | 50,000 | (z)-0 | 40 | 11.28 | (BP)-0 | 60 | 12.39 | — | — | — |
| C-9 | 12.23 | 50,000 | (z)-0 | 37 | 11.28 | (BP)-0 | 63 | 12.39 | — | — | — |

Charge Transport Materials in Charge Transport Layer (d-1): Compound represented by the following structural formula (d-2): Compound represented by the following structural formula (d-3): Compound represented by the following structural formula (d-4): Compound represented by the following structural formula (d-1)

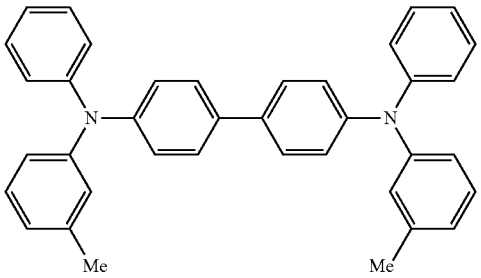

(d-2)

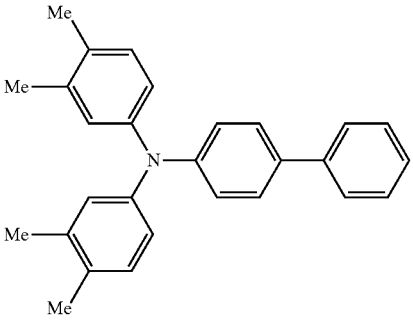

-continued (d-3)

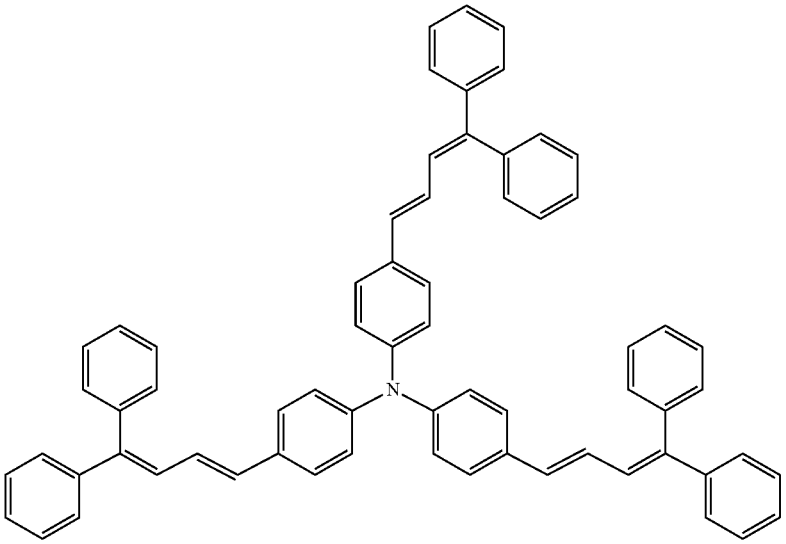

(d-4)

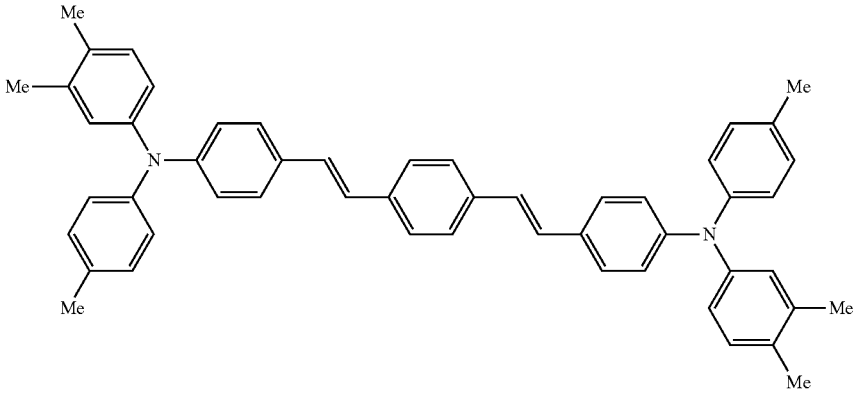

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising a conductive substrate and a photosensitive layer provided on the conductive substrate, wherein an outermost surface layer of the electrophotographic photoreceptor is composed of a cured film of a composition comprising a reactive charge transport material, a zinc stearate coverage of the surface of the outermost surface layer is 5.0% or more, and an oxygen permeability coefficient of the outermost surface layer before coating with zinc stearate is $2.0\times10^{12}$ $fm^2/Pa\cdot s$ or more,and wherein the reactive charge transport material is at least one selected from the group consisting of reactive compounds represented by the following formulae (I) and (II):

(I)

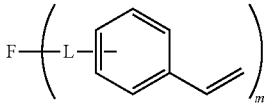

wherein F represents a charge transport skeleton; L represents a divalent linking group including two or more selected from the group consisting of an alkylene group, an alkenylene group. —C(═O)—, —N(R)—, —S—, and —O—: R represents a hydrogen atom, an alkyl group, an aryl group, or an aralkyl group; and m represents an integer of 1 to 8, (II)

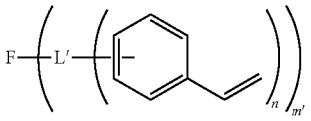

wherein F represents a charge transport skeleton; L 'represents an (n +l)-valent linking group including two or more selected from the group consisting of a trivalent or tetravalent group derived from an alkane or an alkene, alkylene group, an alkenylene group, —C(=O)—, —N(R)—, —S—, and —O—: R represents a hydrogen atom, an alkyl group. an aryl group, or an aralkyl group; m'represents an integer of 1 to 6; and n represent an integer of 2 to 3.

2. The electrophotographic photoreceptor according to claim 1, wherein a lower layer in contact with the outermost surface layer includes a non-reactive charge transport material and a polycarbonate copolymer having a solubility parameter as calculated by a Feders method of from 11.40 to 11.75.

3. The electrophotographic photoreceptor according to claim 2, wherein the polycarbonate copolymer has a repeating structural unit having a solubility parameter as calculated by the Feders method of from 12.20 to 12.40.

4. The electrophotographic photoreceptor according to claim 2, wherein the polycarbonate copolymer is a polycarbonate copolymer having a repeating structural unit represented by the following formula (PC-1):

(PC-1)

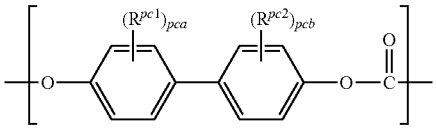

wherein $R^{pc1}$ and $R^{pc2}$ each independently represent a halogen atom, an alkyl group having 1 to 6 carbon atoms, a cycloalkyl group having 5 to 7 carbon atoms, or an aryl group having 6 to 12 carbon atoms; and pca and pcb each independently represent an integer of 0 to 4.

5. The electrophotographic photoreceptor according to claim 4, wherein a proportion of the repeating structural units represented by the formula (PC-1) is from 20% by mole to 40% by mole with respect to the polycarbonate copolymer.

6. The electrophotographic photoreceptor according to claim 2, wherein the polycarbonate copolymer is a polycarbonate copolymer having a repeating structural unit represented by the following formula (PC-2):

(PC-2)

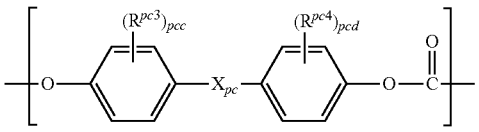

wherein $R^{pc3}$ and $R^{pc4}$ each independently represent a halogen atom, an alkyl group having 1 to 6 carbon atoms, a cycloalkyl group having 5 to 7 carbon atoms, or an aryl group having 6 to 12 carbon atoms;

pcc and pcd each independently represent an integer of 0 to 4; and $X_{pc}$ represents —$CR^{pc5}R^{pc6}$—, a 1,1 -cycloalkylene group having 5 to 11 carbon atoms, an α,ω-alkylene group having 2 to 10 carbon atoms, —O—, —S—, —SO—, or —$SO_2$—, wherein $R^{pc5}$ and $R_{pc6}$ each independently represent a hydrogen atom, a trifluoromethyl group, an alkyl group having 1 to 6 carbon atoms, or an aryl group having 6 to 12 carbon atoms.

7. The electrophotographic photoreceptor according to claim 6, wherein a proportion of the repeating structural units represented by the formula (PC-2) is from 35% by mole to 55% by mole with respect to the polycarbonate copolymer.

8. The electrophotographic photoreceptor according to claim 1, wherein the reactive compound represented by the formula (I) is at least one selected from the group consisting of reactive compounds represented by the formulae (I-a), (I-b), (I-c), and (I-d):

(I-a)

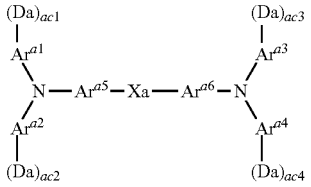

wherein $Ar^{a1}$ to $Ar^{a4}$ each independently represent a substituted or unsubstituted aryl group;

$Ar^{a5}$ and $Ar^{a6}$ each independently represent a substituted or unsubstituted arylene group;

Xa represents a divalent linking group formed by a combination of the groups selected from an alkylene group, —O—, —S—, and an ester group;

Da represents a group represented by the following formula (IA-a); and ac1 to ac4 each independently represent an integer of 0 to 2; provided that the total number of Da's is 1 or 2, (IA-a)

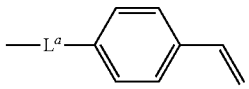

wherein $L^a$ is represented by *—$(CH_2)_{az}$—O—$CH_2$— and represents a divalent linking group linked to a group represented by $Ar^{a1}$ to $Ar^{a4}$ at *; and az represents an integer of 1 or 2, (I-b)

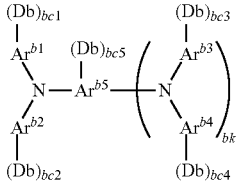

wherein $Ar^{b1}$ to $Ar^{b4}$ each independently represent a substituted or unsubstituted aryl group; $Ar^{b5}$ represents a substituted or unsubstituted aryl group, or a substituted or unsubstituted arylene group;

Db represents a group represented by the following formula (IA-b);

bc1 to bc5 each independently represent an integer of 0 to 2; and bk represents 0 or 1; provided that the total number of Db's is 1 or 2, (IA-b)

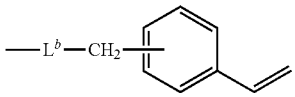

wherein $L^b$ includes a group represented by *—$(CH_2)_{bn}$—O— and represents a divalent linking group linked to a group represented by $Ar^{b1}$ to $Ar^{b5}$ at *; and bn represents an integer of 3 to 6, (I-c)

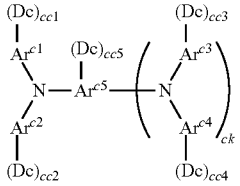

wherein $Ar^{c1}$ to $Ar^{c4}$ each independently represent a substituted or unsubstituted aryl group; $Ar^{c5}$ represents a substituted or unsubstituted aryl group, or a substituted or unsubstituted arylene group;

Dc represents a group represented by the following formula (IA-c);

cc1 to cc5 each independently represent an integer of 0 to 2; and ck represents 0 or 1; provided that the total number of Dc's is from 1 to 8, (IA-c)

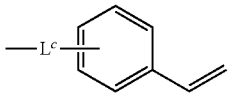

wherein $L^c$ represents a divalent linking group including one or more groups selected from the group consisting of the groups formed by a combination of —C(=O)—, —N(R)—, —S—, and —C(=O)—, and —O—, —N(R)—, or —S—; and R represents a hydrogen atom, an alkyl group, an aryl group, or an aralkyl group, (I-d)

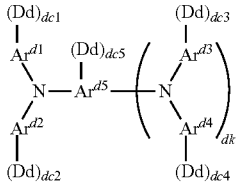

wherein $Ar^{d1}$ to $Ar^{d4}$ each independently represent a substituted or unsubstituted aryl group; $Ar^{d5}$ represents a substituted or unsubstituted aryl group, or a substituted or unsubstituted arylene group;

Dd represents a group represented by the following formula (IA-d);

dc1 to dc5 each independently represent an integer of 0 to 2; and dk represents 0 or 1; provided that the total number of Dd's is from 3 to 8, (IA-d)

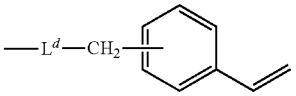

wherein $L^d$ includes a group represented by *—$(CH_2)_{dn}$—O—, and represents a divalent linking group linked to a group represented by $Ar^{d1}$ to $Ar^{d5}$ at *; and dn represents an integer of 1 to 6.

9. The electrophotographic photoreceptor according to claim 8, wherein the group represented by the formula (IA-c) is a group represented by the following formula (IA-c1):

(IA-c1)

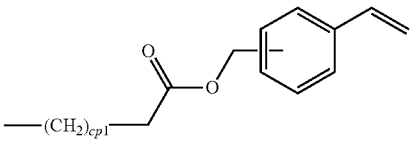

wherein cp1 represents an integer of 0 to 4.

10. The electrophotographic photoreceptor according to claim 1, wherein the compound represented by the formula (II) is a compound represented by the following formula (II-a):

(II-a)

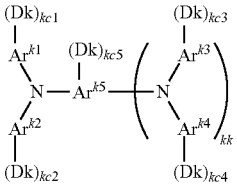

wherein $Ar^{k1}$ to $Ar^{k4}$ each independently represent a substituted or unsubstituted aryl group; $Ar^{k5}$ represents a substituted or unsubstituted aryl group, or a substituted or unsubstituted arylene group;

Dk represents a group represented by the following formula (IIA-a);

kc1 to kc5 each independently represent an integer of 0 to 2; and kk represents 0 or 1; provided that, the total number of Dk's is from 1 to 8, (IIA-a)

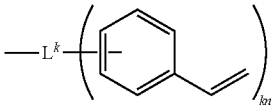

wherein $L^k$ represents a (kn +1)-valent linking group including two or more selected from the group consisting of a trivalent or tetravalent group derived from an alkane or an alkene, and an alkylene group, an alkenylene group, —(═O)—, —N(R)—, —S—, and —O—; R represents a hydrogen atom, an alkyl group, an aryl group, or an aralkyl group; and kn represents an integer of 2 to 3.

11. The electrophotographic photoreceptor according to claim 10, wherein the group linked to the charge transport skeleton represented by F of the compound represented by the formula (II) is a group represented by the following formula (IIA-a1) or (IIA-a2):

(IIA-a1)

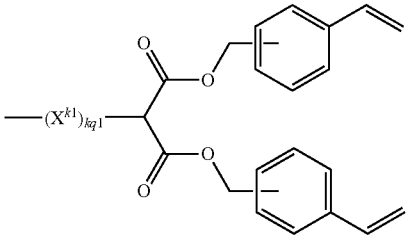

(IIA-a2)

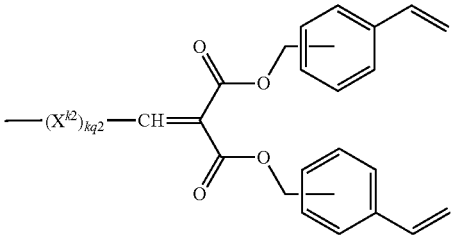

wherein $X^{k1}$ represents a divalent linking group; kq1 represents an integer of 0 or 1;

$X^{k2}$ represents a divalent linking group; and kq2 represents an integer of 0 or 1.

12. The electrophotographic photoreceptor according to claim 10, wherein the group linked to the charge transport skeleton represented by F of the compound represented by the formula (II) is a group represented by the following formula (IIA-a3) or (IIA-a4):

(IIA-a3)

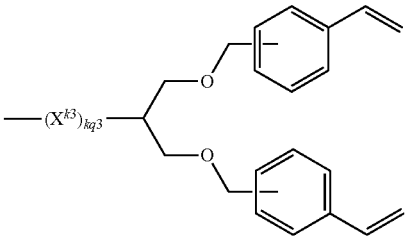

(IIA-a4)

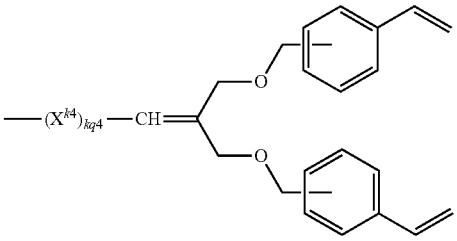

wherein $X^{k3}$ represents a divalent linking group; kq3 represents an integer of 0 or 1; $X^{k4}$ represents a divalent linking group; and kq4 represents an integer of 0 or 1.

13. The electrophotographic photoreceptor according to claim 1, wherein the zinc stearate coverage of the surface of the outermost surface layer is from 5.0% to 80.0%, and the oxygen permeability coefficient of the outermost surface layer before coating with zinc stearate is from $2.0\times10^{12}$ $fm^2$/Pa·s to $15.0\times10^{12}$ $fm^2$/Pa·s.

14. A process cartridge, which comprises the electrophotographic photoreceptor according to claim 1, and is detachable from an image forming apparatus.

15. An image forming apparatus comprising:

the electrophotographic photoreceptor according to claim 1;

a charging unit that charges the surface of the electrophotographic photoreceptor;

an electrostatic latent image forming unit that forms an electrostatic latent image on the surface of a charged electrophotographic photoreceptor;

a developing unit that develops the electrostatic latent image formed on the surface of the electrophotographic photoreceptor by a developer containing a toner to form a toner image; and a transfer unit that transfers the toner image on the surface of a recording medium.

16. The image forming apparatus according to claim 15, comprising a supply unit that supplies zinc stearate to the surface of the electrophotographic photoreceptor.

* * * * *